US011264192B2

(12) United States Patent
Fukuda et al.

(10) Patent No.: US 11,264,192 B2
(45) Date of Patent: Mar. 1, 2022

(54) CIRCUIT INTERRUPTER

(71) Applicant: Panasonic Intellectual Property Management Co., Ltd., Osaka (JP)

(72) Inventors: Yoshihisa Fukuda, Osaka (JP); Shinya Kimoto, Osaka (JP); Kenji Kanematsu, Osaka (JP); Kazuhisa Kinoshita, Osaka (JP); Masato Nakamura, Hyogo (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/040,398

(22) PCT Filed: Mar. 19, 2019

(86) PCT No.: PCT/JP2019/011418
§ 371 (c)(1),
(2) Date: Sep. 22, 2020

(87) PCT Pub. No.: WO2019/188582
PCT Pub. Date: Oct. 3, 2019

(65) Prior Publication Data

US 2021/0066007 A1 Mar. 4, 2021

(30) Foreign Application Priority Data

Mar. 28, 2018 (JP) ..... JP2018-063264

(51) Int. Cl.
*H01H 33/02* (2006.01)
*H01H 33/28* (2006.01)
(Continued)

(52) U.S. Cl.
CPC ..... *H01H 33/78* (2013.01); *H01H 33/025* (2013.01); *H01H 33/28* (2013.01); *H01H 33/56* (2013.01); *H01H 33/7015* (2013.01)

(58) Field of Classification Search
CPC ..... H01H 33/78; H01H 33/025; H01H 33/28; H01H 33/56; H01H 33/7015; H01H 39/00;
(Continued)

(56) References Cited

U.S. PATENT DOCUMENTS 4,250,365 A 2/1981 McConnell
5,539,365 A * 7/1996 Lepretre ..... H01H 71/121 218/17
(Continued)

FOREIGN PATENT DOCUMENTS

DE 928 658 C 6/1955
JP 48-008644 1/1973
(Continued)

OTHER PUBLICATIONS

Official Communication issued in International Patent Application No. PCT/JP2019/011418, dated Jun. 4, 2019, along with an English translation thereof.
(Continued)

*Primary Examiner* — William A Bolton
(74) *Attorney, Agent, or Firm* — Greenblum & Bernstein, P.L.C.

(57) ABSTRACT

A circuit interrupter includes a fixed terminal, a movable contactor, a moving mechanism, a squib, and accommodation. The fixed terminal includes a fixed contact. The movable contactor includes a movable contact connected to the fixed contact. The moving mechanism is configured to move the movable contactor from a closed position where the movable contact is connected to the fixed contact to an open
(Continued)

position where the movable contact is separated from the fixed contact. The squib is configured to generate gas by combustion. The accommodation is for accommodating the fixed contact and the movable contactor. In the circuit interrupter, the gas is introduced into the accommodation.

14 Claims, 31 Drawing Sheets

(51) Int. Cl.
*H01H 33/56* (2006.01)
*H01H 33/70* (2006.01)
*H01H 33/78* (2006.01)

(58) Field of Classification Search
CPC ..... H01H 39/002; H01H 39/006; H01H 9/30; H01H 37/74; H01H 50/00; H01H 33/88; H01H 33/90; H01H 51/00; H01H 2051/2218; H01H 71/128
USPC ..... 218/49, 48, 90, 95, 94, 93, 92, 111
See application file for complete search history.

(56) References Cited

U.S. PATENT DOCUMENTS 6,107,590 A * 8/2000 Skindhoj ..... H01H 39/00 218/1
6,194,988 B1 * 2/2001 Yamaguchi ..... H01H 39/006 180/279
6,252,190 B1 6/2001 Niemeyer
6,285,270 B1 * 9/2001 Lane ..... H01H 3/28 335/35
6,412,416 B1 * 7/2002 Rouse ..... F42B 5/15 102/334
6,418,005 B1 7/2002 Endo et al.
8,957,335 B2 * 2/2015 Sprenger ..... B23D 15/145 200/61.04
9,384,931 B2 * 7/2016 Fasano ..... H01H 3/46
2013/0056344 A1 * 3/2013 Borg ..... H01H 39/00 200/81 R
2016/0233039 A1 * 8/2016 Kanematsu ..... H01H 50/00
2016/0343524 A1 11/2016 Gaudinat et al.
2016/0351363 A1 12/2016 Gaudinat et al.
2017/0213676 A1 7/2017 Lell
2018/0047533 A1 2/2018 Kim

FOREIGN PATENT DOCUMENTS

JP 59-090323 5/1984
JP 61-260528 11/1986
JP 11-102633 4/1999
JP 2010-153371 7/2010
JP 2017-507469 3/2017

OTHER PUBLICATIONS

Extended European Search Report, dated Sep. 2, 2021, by the European Patent Office (EPO), for European Patent Application No. 19777142.1.

* cited by examiner

CIRCUIT INTERRUPTER

CROSS-REFERENCE TO RELATED APPLICATIONS

This application is a National Stage of International Application No. PCT/JP2019/011418 filed Mar. 19, 2019, claiming priority to Japanese Patent Application No. JP2018-063264 filed on Mar. 28, 2018, the content of each noted application is hereby incorporated by reference in its entirety.

TECHNICAL FIELD

The present disclosure generally relates to circuit interrupters and in particular to a circuit interrupter for interrupting a circuit where a current flows.

BACKGROUND ART

Patent Literature 1 discloses a breaker including a pyrotechnic actuator which is intended to be mounted on an automobile, in particular, an electric vehicle.

The breaker of Patent Literature 1 includes a conductor, a housing, a matrix, a punch, and a pyrotechnic actuator.

The housing is partially intersected by the conductor. Opposite ends of the conductor serve as two connection terminals for the breaker. The matrix and the punch are placed on opposite sides (upper and lower sides) of the conductor.

The pyrotechnic actuator moves the punch from a first position to a second position when ignited. In movement of the punch from the first position to the second position, the punch, and the matrix break (chop) the conductor. The punch includes a groove. While the punch is in the second position, the groove of the punch is engaged with the matrix. Thereby, a space inside the housing is partitioned into two cutoff chambers.

When the punch moves from the first position to the second position and cuts the conductor, an electric arc may be formed. This electric arc travels a pathway between the cutoff chamber and a bottom of the groove of the punch. To increase a voltage of the electric arc, provided to a vicinity of the pathway is a material pulled out by ablation due to the electric arc.

In interrupters such as breakers, it is desired to extinguish an arc rapidly.

CITATION LIST

Patent Literature

Patent Literature 1 JP 2017-507469 A

SUMMARY OF INVENTION

In view of the above insufficiency, an object of the present disclosure would be to propose a circuit interrupter capable of extinguishing an arc quickly when the arc is developed.

A circuit interrupter according to one aspect of the present disclosure includes a fixed terminal, a movable contactor, a moving mechanism, a squib, and accommodation. The fixed terminal includes a fixed contact. The movable contactor includes a movable contact connected to the fixed contact. The moving mechanism is configured to move the movable contactor from a closed position where the movable contact is connected to the fixed contact to an open position where the movable contact is separated from the fixed contact. The squib is configured to generate gas by combustion. The accommodation is for accommodating the fixed contact and the movable contactor. The gas is introduced into the accommodation.

A circuit interrupter according to another aspect of the present disclosure includes a fixed terminal, a movable contactor, an excitation coil, and a moving mechanism. The fixed terminal includes a fixed contact. The movable contactor includes a movable contact connected to the fixed contact. The squib is configured to generate gas by combustion. The excitation coil is configured to move the movable contactor from a closed position where the movable contact is connected to the fixed contact to a first open position where the movable contact is separated from the fixed contact. The moving mechanism is configured to move the movable contactor to a second open position where the movable contact is separated from the fixed contact.

Advantageous Effects of Invention

According to the present disclosure, it is possible to extinguish an arc quickly when the arc is developed.

DESCRIPTION OF EMBODIMENTS

Embodiments and variations described below are some of example of the present disclosure. Various modifications may be made to the above-described embodiment and variations depending on design and the like as long as the object of the present disclosure can be achieved. Figures referred to in the following embodiments and variations are schematic, and there is no guarantee that ratios regarding sizes and thicknesses of components shown in the figures reflect actual ratios.

(1) Embodiments

A circuit interrupter (current interrupter) 100 according to embodiment 1 will be described with reference to FIGS. 1-7.

(1.1) Overview

Figure 1:
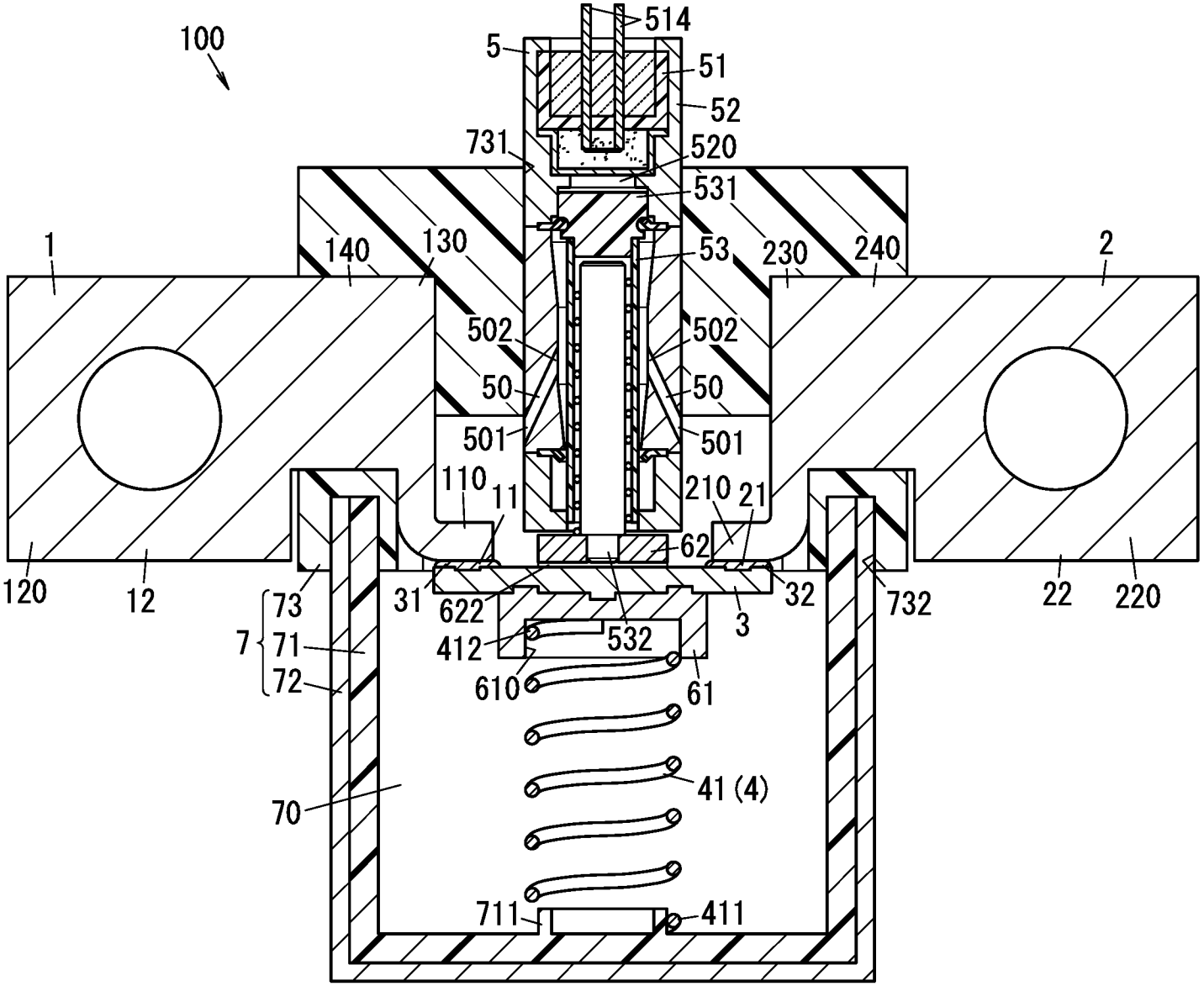
FIG. 1 is a cross-sectional view of a circuit interrupter according to embodiment 1 of the present disclosure.

The circuit interrupter 100 according to embodiment 1 includes, as shown in FIG. 1, a first fixed terminal (fixed terminal) 1, a second fixed terminal 2, a movable contactor (movable terminal) 3, a holding unit 4, a pyroactuator 5, and an accommodation 70.

The first fixed terminal 1 includes a first fixed contact (fixed contact) 11. The first fixed terminal 1 includes a first electrode 12 to be connected to a first end of electric circuitry.

The second fixed terminal 2 includes a second fixed contact 21. The second fixed terminal 2 includes a second electrode 22 to be connected to a second end of the electric circuitry.

The movable contactor 3 includes a first movable contact (movable contact) 31. The first movable contact 31 is connected to the first fixed contact 11. The movable contactor 3 includes a second movable contact 32. The second movable contact 32 is connected to the second fixed contact 21. In the present embodiment, the movable contactor 3 is formed as a separate part from each of the first fixed terminal 1 and the second fixed terminal 2.

The first fixed contact 11, the second fixed contact 21, and the movable contactor 3 (the first movable contact 31 and the second movable contact 32) are accommodated in the accommodation 70.

The holding unit 4 holds the movable contactor 3 so that the first movable contact 31 is connected to the first fixed contact 11 and the second movable contact 32 is connected to the second fixed contact 21. In particular, the holding unit 4 holds the movable contactor 3 so that the first movable contact 31 and the second movable contact 32 are connected to the first fixed contact 11 and the second fixed contact 21, respectively, while no current flows through the movable contactor 3 (during a non-conduction state).

Hereinafter, a position of the movable contactor 3 where the first movable contact 31 is connected to the first fixed contact 11 is referred to as a closed position. In the closed position, the second movable contact 32 is connected to the second fixed contact 21, too.

As shown in FIG. 1, the pyroactuator 5 includes a squib 51, a case 52, and a piston 53.

The squib 51 is accommodated in the case 52. The squib 51 is configured to generate gas by combustion. The squib 51 includes a heating element and an explosive (fuel). When the heating element is supplied with an electric signal, the heating element generates heat and then the explosive ignites. When the squib 51 is ignited, the explosive combusts to generate gas. The gas generated by the squib 51 has electrically insulating properties. Examples of the gas generated by the squib 51 may include a carbon monoxide gas, a carbon dioxide gas, and a nitrogen gas. The gas generated by the squib 51 is introduced into the pressurized chamber 520 to increase the pressure in the pressurized chamber 520. In summary, the pressurized chamber 520 receives the pressure of the gas generated by the squib 51.

The piston 53 receives pressure in the pressurized chamber 520 with its first end 531 and then is moved. The piston 53 applies a force in a direction away from the fixed terminal (the first fixed terminal) 1 to the movable contactor 3 (directly or indirectly) with its second end 532 to cause movement of the movable contactor 3. More specifically, the piston 53 receives the pressure of the pressurized chamber 520 with the first end 531 and is pressed by the increased pressure in the pressurized chamber 520 to press the movable contactor 3 with the second end 532. The piston 53 receives a large pressure in the pressurized chamber 520 and moves in a direction away from the squib 51 (a downward direction in FIG. 1) at a high speed to press the movable contactor 3. The pressure in the pressurized chamber 520 presses the piston 53 from a first position (a position shown in FIG. 1) to a second position (a position shown in FIG. 7). Movement of the piston 53 from the first position to the second position expands the pressurized chamber 520 (a space inside the case 52 pressure of which is increased by introduction of the gas of the squib 51).

Figure 6:
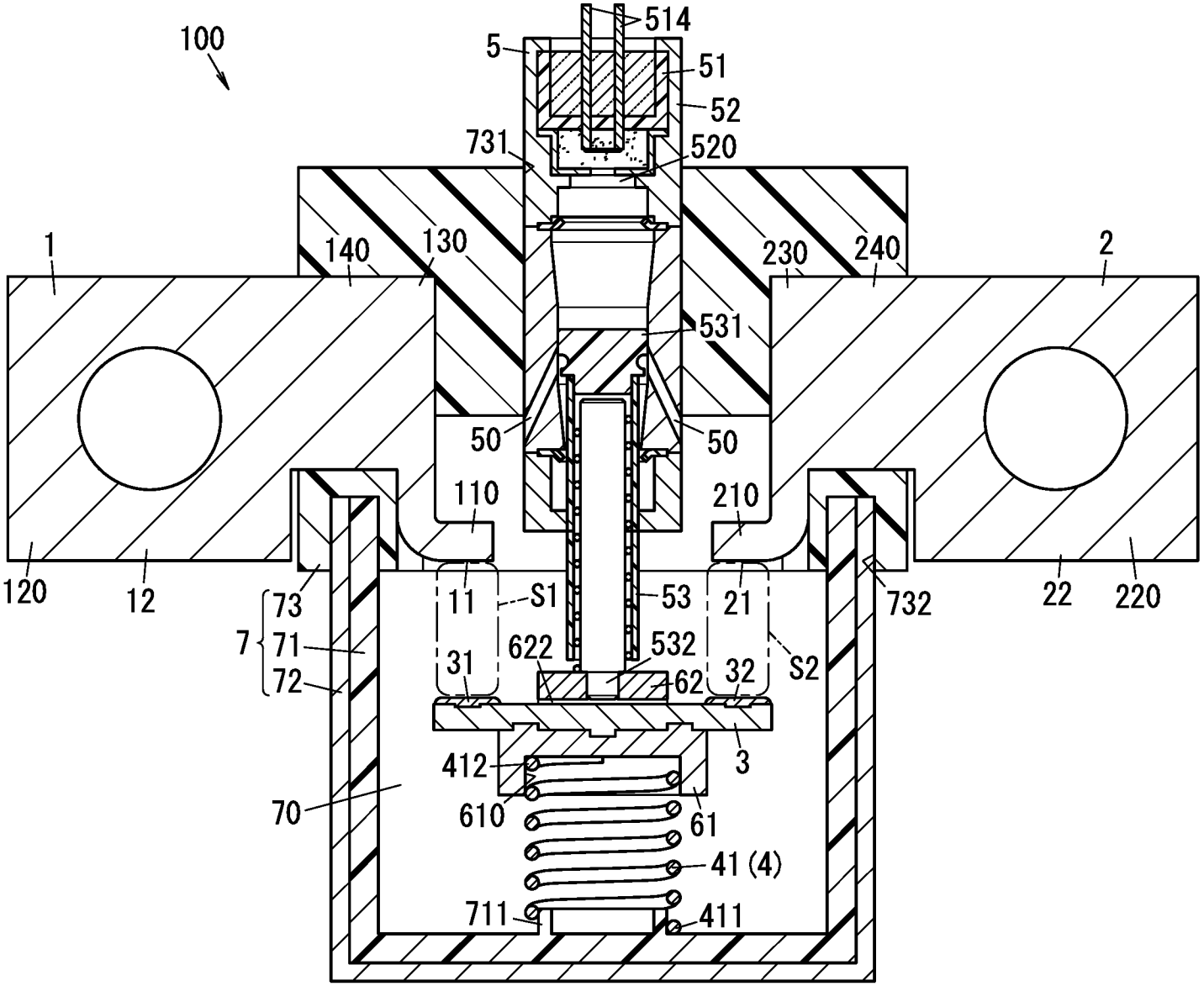
FIG. 6 is a cross-sectional view of the above circuit interrupter in operation.
Figure 7:
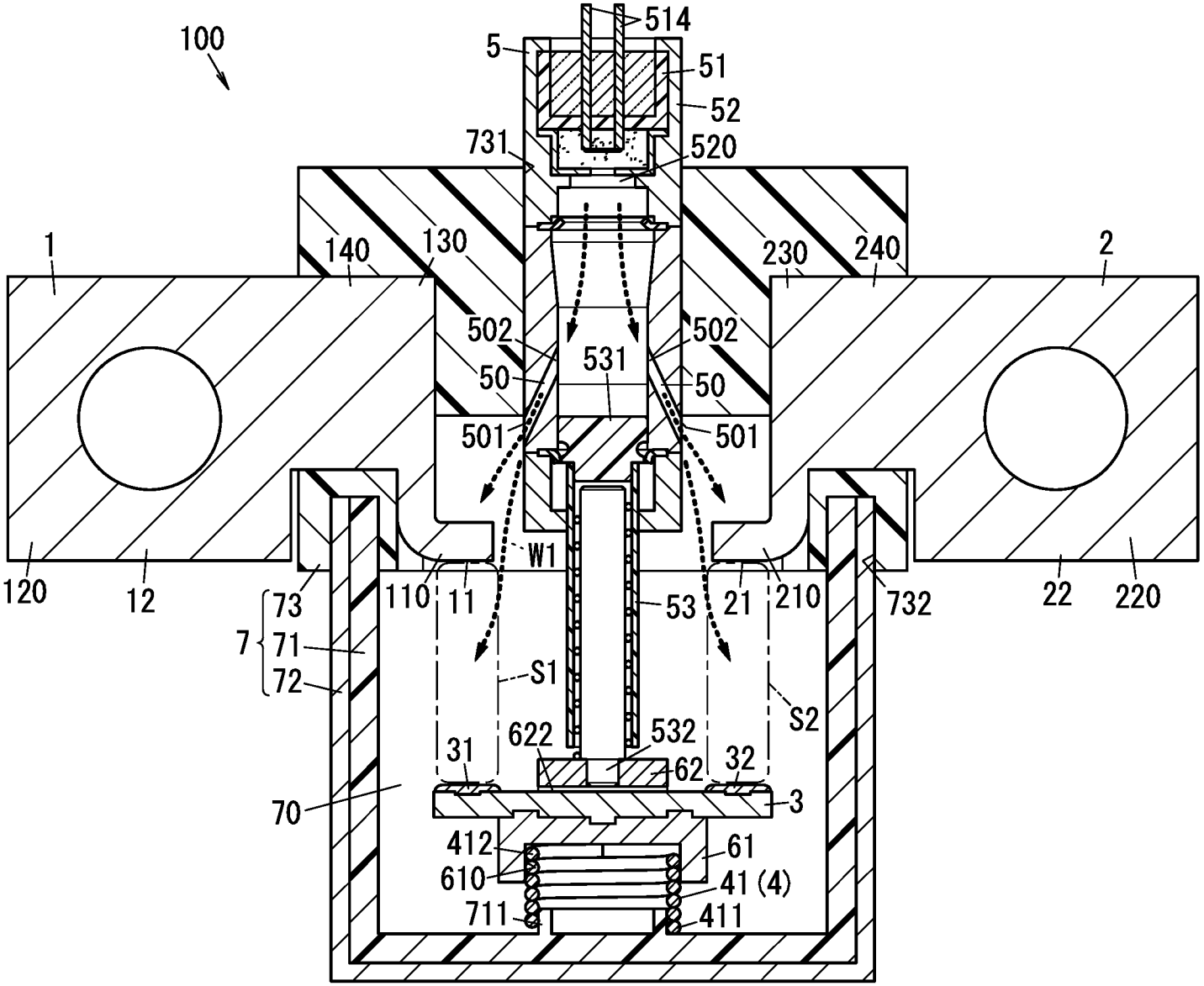
FIG. 7 is a cross-sectional view of the above circuit interrupter after operation.

The movable contactor 3 is pressed by the piston 53 and then moves within the accommodation 70. As shown in FIGS. 6-7, the movable contactor 3 is pressed by the piston 53 and therefore the first movable contact 31 is separated from the first fixed contact 11 and the second movable contact 32 is separated from the second fixed contact 21. Thus, an electric circuit between the first electrode 12 and the second electrode 22 is interrupted. As described above, in the present embodiment, the pressurized chamber 520 and the piston 53 function as a moving mechanism configured to move the movable contactor 3 from a position where the movable contact (first movable contact) 31 is connected to the fixed contact (first fixed contact) 11 to a position where the movable contact is separated from the fixed contact.

Hereinafter, a position of the movable contactor 3 where the first movable contact 31 is most separated from the first fixed contact 11 is referred to as an open position (a position of the movable contactor 3 shown in FIG. 7). In the open position, the second movable contact 32 is separated from the second fixed contact 21, too.

As shown in FIG. 1, there is a channel 50 provided to the side wall of the case 52. The channel 50 interconnects the inside and the outside of the case 52. The channel 50 includes a first end 501 connected to the accommodation 70 and a second end 502 connected to the inside space of the case 52. However, while the piston 53 is in the first position, the second end 502 of the channel 50 is not connected to the pressurized chamber 520 (see FIG. 1).

Movement of the piston 53 from the first position (see FIG. 1) to the second position (see FIG. 7) extends the pressurized chamber 520, thereby allowing the second end 502 of the channel 50 to be connected to the pressurized chamber 520. As a result, the pressurized chamber 520 and the accommodation 70 are interconnected by the channel 50. Therefore, the gas generated by the squib 51 is introduced into the accommodation 70 through the pressurized chamber 520 and the channel 50.

The first fixed contact 11 and the first movable contact 31 are accommodated in the accommodation 70. Here, as described above, the gas generated by the squib 51 is introduced into the accommodation 70 Thus, the arc generated between the fixed contact (first fixed contact) 11 and the movable contact (first movable contact) 31 (i.e., the arc generated in the predetermined space S1) is cooled by the gas generated in the squib 51. The term "cooling of the arc" as used herein means to enhance the insulating properties of the plasma of the arc discharge or the metal vapor. For example, cooling of the arc can be achieved by increasing the pressure of the predetermined space S1 by introduction of electrically insulating gas, blowing the arc with electrically insulating gas, or the like. When the arc is cooled, an electric field strength of the arc (a voltage per unit length) is increased. This can reduce the length of the arc that is possibly developed when a certain constant voltage is applied across the arc. Thereby, arc extinction can be promoted.

Thus, in the circuit interrupter 100, when the movable contact (first movable contact) 31 is pulled away from the fixed contact (first fixed contact) 11, the gas generated by the squib 51 is introduced into the accommodation 70 (in detail, the predetermined space S1). When the arc is developed between the contacts, the arc is cooled by the gas. Accordingly, the circuit interrupter 100 can quickly extinguish the arc.

(1.2) Details

Hereinafter, the circuit interrupter 100 according to the present embodiment will be described in detail with reference to FIGS. 1-7.

(1.2.1) Power Supply System

Figure 5:
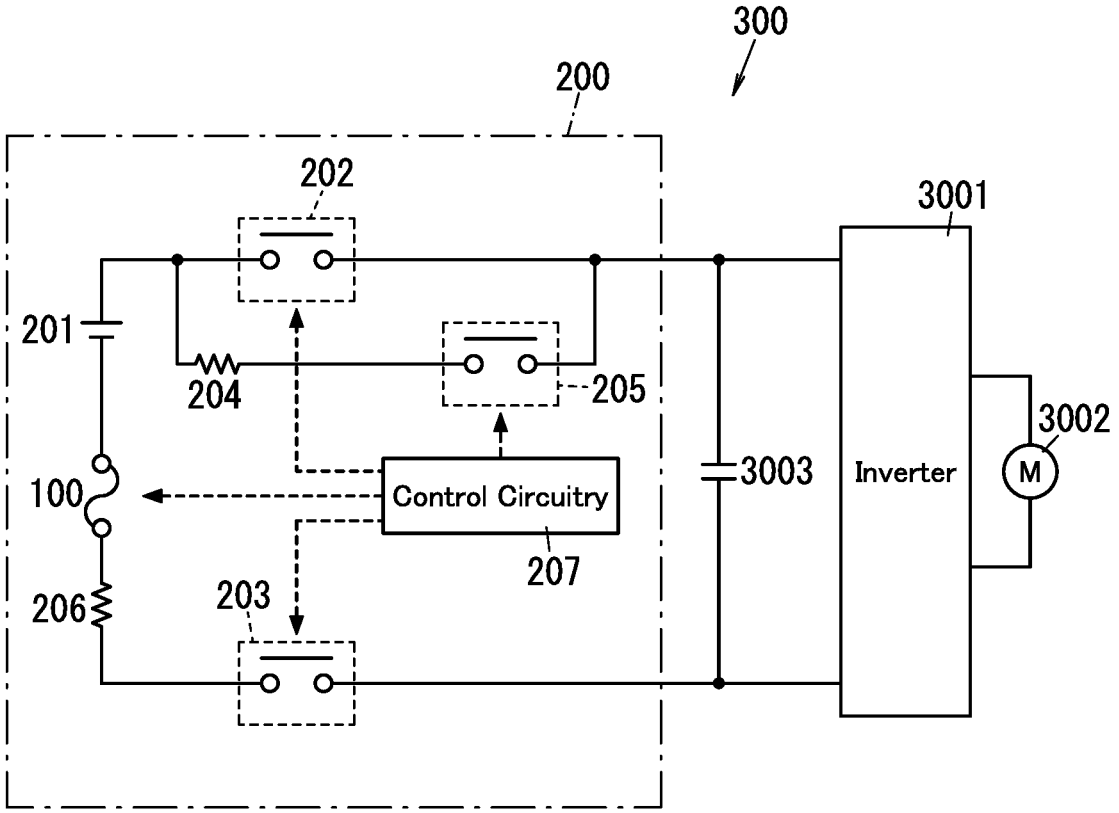
FIG. 5 is a circuit diagram for illustration of a power supply system including the above circuit interrupter.

As shown in FIG. 5, the circuit interrupter 100 of the present embodiment is used, for example, as a fuse in the power supply system 200.

The power supply system 200, for example, is mounted on a vehicle 300 such as an electric vehicle and drives a motor 3002 connected via an inverter 3001 to allow the vehicle 300 to run. In the vehicle 300, as shown in FIG. 5, a precharge capacitor 3003 is connected in parallel with the inverter 3001.

In power transfer, the inverter 3001 converts DC power supplied from the power supply system 200 into AC power and supplies it to the motor 3002. In power regeneration, the inverter 3001 converts AC power supplied from the motor 3002 into DC power and supplies it to the power supply system 200. The motor 3002 is, for example, a three-phase AC synchronous motor.

The power supply system 200 includes a battery 201, a first main relay 202, a second main relay 203, a precharge resistor 204, a precharge relay 205, a current sensor (shunt resistor) 206, and control circuitry 207 in addition to the circuit interrupter 100.

The battery 201 includes a plurality of battery cells connected in series. Examples of the battery cells may include nickel metal hydride battery cells and lithium ion battery cells.

The first main relay 202 includes a first end connected to a positive electrode of the battery 201 and a second end connected to a first input terminal (high potential side input terminal) of the inverter 3001.

The second main relay 203 includes a first end connected to a negative electrode of the battery 201 through the current sensor 206 and the circuit interrupter 100 and a second end connected to a second input terminal (low potential side input terminal) of the inverter 3001.

A series circuit of the precharge resistor 204 and the precharge relay 205 is connected in parallel with the first main relay 202.

The control circuitry 207 controls operations of the first main relay 202, the second main relay 203, the precharge relay 205, and the circuit interrupter 100.

When power supply to the motor 3002 is started, the control circuitry 207 closes the precharge relay 205 and the second main relay 203 to charge the precharge capacitor 3003. Thus, inrush current to the motor 3002 is suppressed. After completion of charging of the precharge capacitor 3003, the control circuitry 207 opens the precharge relay 205 and closes the first main relay 202 to start power supply from the power supply system 200.

The control circuitry 207 also detects occurrence of an abnormality in circuitry including the power supply system 200 based on a current detected by the current sensor 206. When an abnormality occurs in the circuitry including the power supply system 200, the control circuitry 207 operates (activates) at least one of the first main relay 202, the second main relay 203, and the circuit interrupter 100 to interrupt the circuitry.

The control circuitry 207 opens at least one of the first main relay 202 and the second main relay 203 when, for example, time in which the magnitude of the current detected by the current sensor 206 exceeds a first threshold value continues for first time. Thereby the circuitry is interrupted. In this case, for example, when the opened relay (the first main relay 202 and/or the second main relay 203) is closed again by the control circuitry 207, the circuitry is made again and therefore the power supply from the power supply system 200 to the motor 3002 is resumed.

On the other hand, for example, when time in which the magnitude of the current detected by the current sensor 206 exceeds a second threshold value (>the first threshold value) continues for second time, the control circuitry 207 operates the circuit interrupter 100. Thereby, the circuitry is interrupted. The circuit interrupter 100 is a breaker for breaking an electrical circuit (path) of circuitry. The circuit interrupter 100 continues to break the electric circuit once operated (activated). After activation of the circuit interrupter 100, the power supply from the power supply system 200 to the motor 3002 is stopped. Therefore, in the event of an accident or the like of the vehicle 300, operation of the circuit interrupter 100 can separate the power supply system 200.

(1.2.2) Configuration

Next, the configuration of the circuit interrupter 100 will be described with reference to FIGS. 1-4.

As described above, the circuit interrupter 100 includes the first fixed terminal 1, the second fixed terminal 2, the movable contactor 3, the holding unit 4, and the pyroactuator 5. Further, as shown in FIG. 1, the circuit interrupter 100 includes a first yoke (lower yoke) 61, a second yoke (upper yoke) 62, and a housing 7 including the accommodation 70.

The movable contactor 3 of the present embodiment is a plate member made of a metallic material with electrical conductivity and is formed to have length in one direction. The movable contactor 3 includes the first movable contact 31 and the second movable contact 32 at respective first and second ends in its length direction. The first fixed terminal 1 and the second fixed terminal 2 are arranged side by side along the length direction of the movable contactor 3. The first fixed terminal 1 includes the first fixed contact 11 at a position facing the first movable contact 31 of the movable contactor 3 and the second fixed terminal 2 includes the second fixed contact 21 at a position facing the second movable contact 32 of the movable contactor 3.

Hereinafter, for convenience of explanation, an upward/downward direction defines a direction in which the first fixed contact 11 and the first movable contact 31 face each other (a direction in which the second fixed contact 21 and the second movable contact 32 face each other; an upward/downward direction in FIG. 1) and an upward direction defines a direction from the first movable contact 31 toward the first fixed contact 11. Further, a rightward/leftward direction defines a direction in which the first fixed terminal 1 and the second fixed terminal 2 are aligned side by side (a rightward/leftward direction in FIG. 1) and a rightward direction defines a direction from the first fixed terminal 1 toward the second fixed terminal 2. That is to say, in the following description, the upward, downward, rightward, and leftward directions are supposed to be defined on the basis of the directions shown in FIG. 1. Furthermore, in the following description, a direction perpendicular to both the upward/downward direction and the rightward/leftward direction (i.e., the direction coming out of the paper on which FIG. 1 is depicted) is defined herein to be a forward/backward direction. However, these directions are not intended to limit the usage of the circuit interrupter 100.

The first fixed terminal 1 and the second fixed terminal 2 are placed to be arranged side by side in the rightward/leftward direction (see FIG. 1). Each of the first fixed terminal 1 and the second fixed terminal 2 is made of a metallic material with electrical conductivity. The first fixed terminal 1 and the second fixed terminal 2 function as terminals for connecting the external electric circuitry (the circuitry constituting the power supply system 200) to the first fixed contact 11 and the second fixed contact 21. In the present embodiment, each of the first fixed terminal 1 and the second fixed terminal 2 is made of copper (Cu) as an example. However, not limited thereto, each of the first fixed terminal 1 and the second fixed terminal 2 may be made of an electrically conductive material other than copper.

Figure 2:
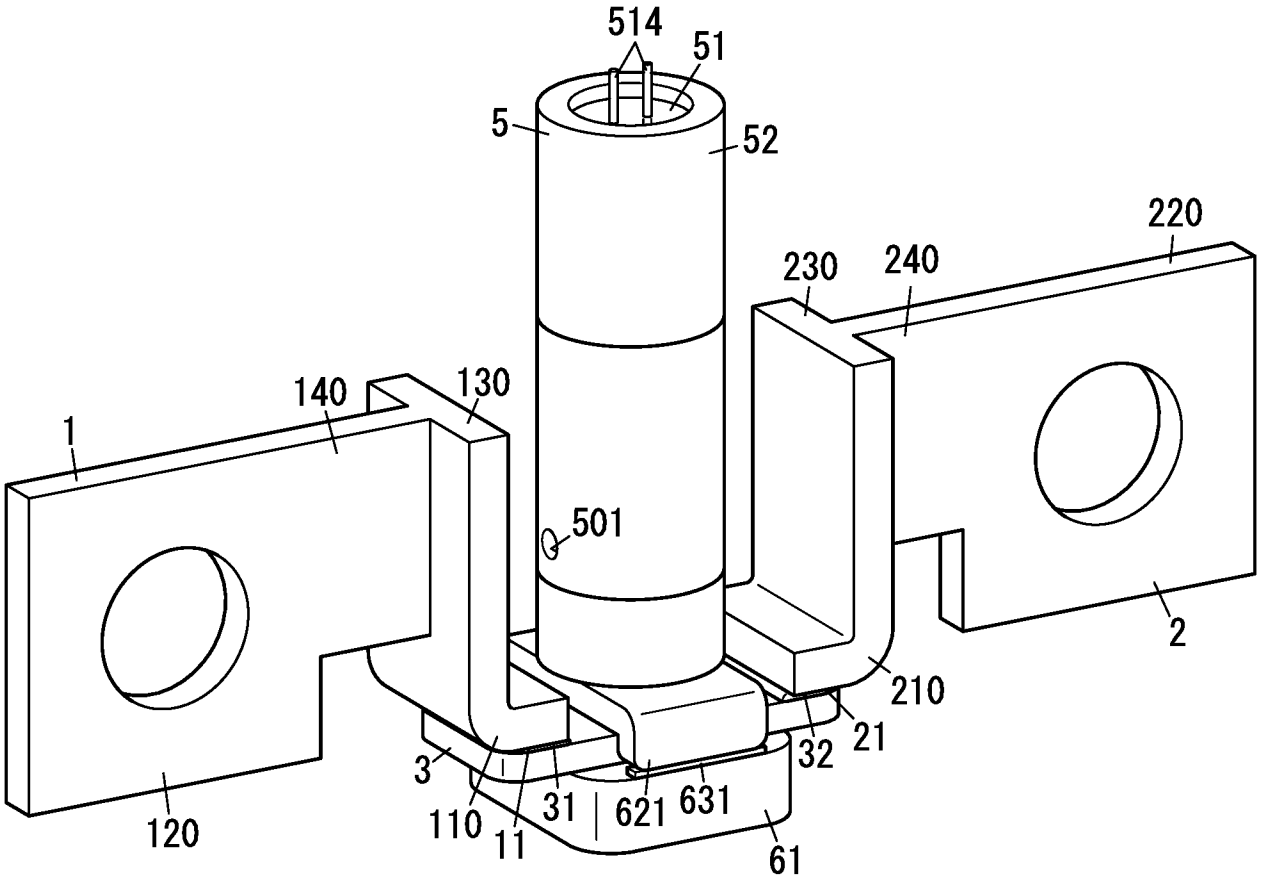
FIG. 2 is a perspective view of primary part of the above circuit interrupter.

As shown in FIG. 2, the first fixed terminal 1 includes a connection piece 110, an electrode piece 120, an interconnection piece 130, and a circuit piece 140 which are formed as an integral part.

The connection piece 110 has a rectangular plate shape with a thickness in the upward/downward direction and a length in the forward/backward direction. In the present embodiment, a lower surface of the connection piece 110 functions as the first fixed contact 11 but is not limited thereto. The first fixed contact 11, for example, may be made of a separate member from the connection piece 110 and fixed to the connection piece 110 by welding or the like.

The electrode piece 120 has a plate shape with a thickness in the forward/backward direction. The electrode piece 120 has a square shape and includes a through hole in its center. The electrode piece 120 is configured to be connected to the first end of the external electric circuitry. That is, the electrode piece 120 functions as the first electrode 12 to be connected to the first end of the external electric circuitry.

The interconnection piece 130 has a rectangular plate shape with a thickness in the rightward/leftward direction and a length in the upward/downward direction. A lower side of the interconnection piece 130 is connected to a left side of the connection piece 110.

The circuit piece 140 has a plate shape with a thickness in the forward/backward direction. The circuit piece 140 interconnects the electrode piece 120 and the interconnection piece 130. A left side of the circuit piece 140 is coupled to an upper portion of a right side of the electrode piece 120. The right side of the circuit piece 140 is coupled to a center of a left surface of the interconnection piece 130.

As shown in FIG. 2, the second fixed terminal 2 includes a connection piece 210, an electrode piece 220, an interconnection piece 230, and a circuit piece 240 which are formed as an integral part.

The connection piece 210 has a rectangular plate shape with a thickness in the upward/downward direction and a length in the forward/backward direction. In the present embodiment, a lower surface of the connection piece 210 functions as the second fixed contact 21 but is not limited thereto. The second fixed contact 21, for example, may be made of a separate member from the connection piece 210 and fixed to the connection piece 210 by welding or the like.

The electrode piece 220 has a plate shape with a thickness in the forward/backward direction. The electrode piece 220 has a square shape and includes a through hole in its center. The electrode piece 220 is configured to be connected to the second end of the external electric circuitry. That is, the electrode piece 220 functions as the second electrode 22 to be connected to the second end of the external electric circuitry.

The interconnection piece 230 has a rectangular plate shape with a thickness in the rightward/leftward direction and a length in the upward/downward direction. A lower side of the interconnection piece 230 is coupled to a right side of the connection piece 210.

The circuit piece 240 has a plate shape with a thickness in the forward/backward direction. The circuit piece 240 interconnects the electrode piece 220 and the interconnection piece 230. The right side of the circuit piece 240 is coupled to an upper portion of the left side of the electrode piece 220. The left side of the circuit piece 240 is coupled to a center of a right surface of the interconnection piece 230.

As shown in FIG. 1, the first fixed terminal 1 is fixed to the housing 7 so that the electrode piece 120 protrudes outside from a left wall of the housing 7 and a lower end of the interconnection piece 130 and the connection piece 110 are placed in an inside space of the housing 7 (the accommodation 70). The second fixed terminal 2 is fixed to the housing 7 so that the electrode piece 220 protrudes outside from a right wall of the housing 7 and a lower end of the interconnection piece 230 and the connection piece 210 are placed in the inside space of the housing 7 (the accommodation 70).

Figure 3:
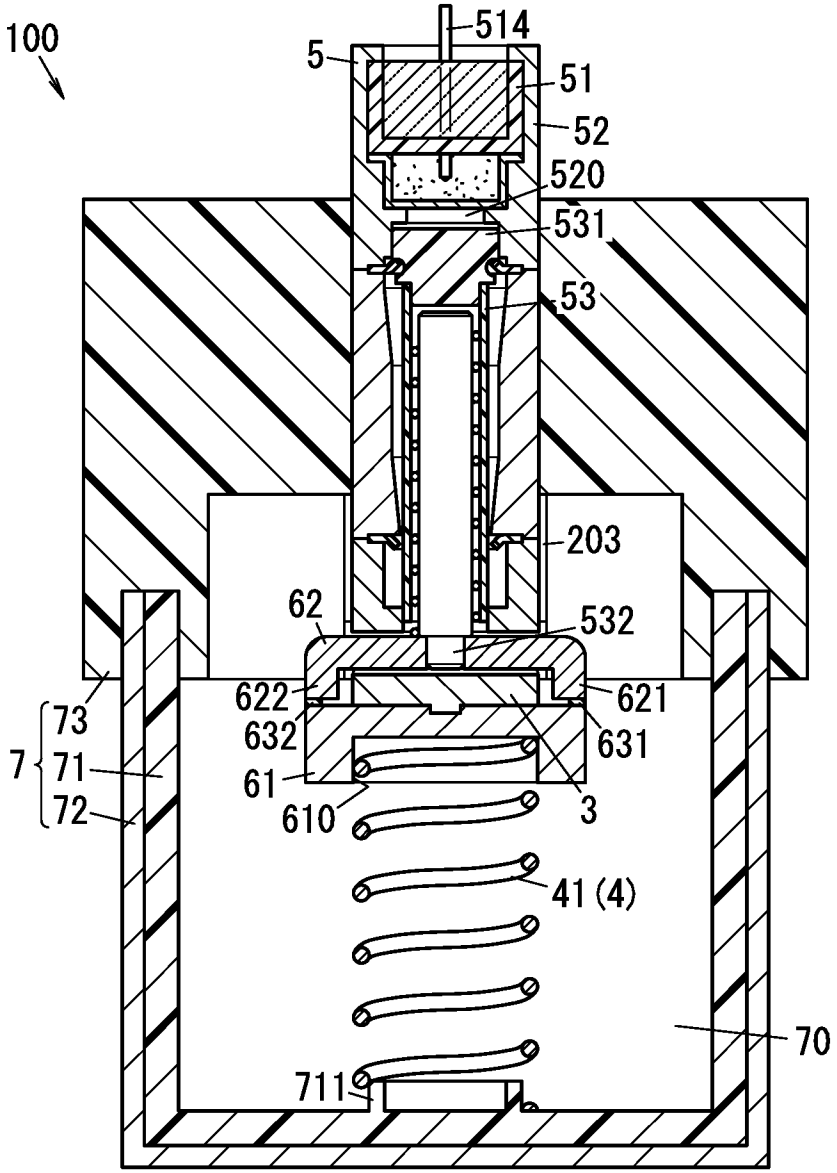
FIG. 3 is a cross-sectional view in a direction perpendicular to the sheet of FIG. 1, of the above circuit interrupter.

As shown in FIGS. 1-3, the movable contactor 3 has a plate shape which has a thickness in the upward/downward direction and is lager in the rightward/leftward direction than in the forward/backward direction. The movable contactor 3 is placed below the connection piece 110 and the connection piece 210 to allow its opposite ends in a length direction (the rightward/leftward direction to face (be connected to) the first fixed contact 11 and the second fixed contact 21. The first movable contact 31 is provided to a part of the movable contactor 3 which faces the first fixed contact 11 and the second movable contact 32 is provided to a part of the movable contactor 3 which faces the second fixed contact 21 (see FIG. 1).

In the present embodiment, the first movable contact 31 is in contact with the first fixed contact 11. More particularly, the first movable contact 31 is in surface contact with the first fixed contact 11. The second movable contact 32 is in contact with the second fixed contact 21. More particularly, the second movable contact 32 is in surface contact with the second fixed contact 21.

In the present embodiment, the first movable contact 31 is a separate member from the movable contactor 3, is made of silver (Ag), and is fixed to the movable contactor 3 by welding or the like. Similarly, the second movable contact 32 is a separate member from the movable contactor 3, is made of silver (Ag) and is fixed to the movable contactor 3 by welding or the like. However, not limited thereto, each of the first movable contact 31 and the second movable contact 32 may be formed integrally with the movable contactor 3 by striking the movable contactor 3 partially.

As shown in FIG. 1, the movable contactor 3 is accommodated in the inside space of the housing 7 (the accommodation 70). The movable contactor 3 is held by the holding unit 4 so that the first movable contact 31 and the second movable contact 32 are connected to the first fixed contact 11 and the second fixed contact 21, respectively.

The first fixed terminal 1 and the second fixed terminal 2 are short-circuited through the movable contactor 3. That is, the first electrode 12 of the first fixed terminal 1 is electrically connected to the second electrode 22 of the second fixed terminal 2 through the first fixed contact 11, the first movable contact 31, the movable contactor 3, the second movable contact 32 and the second fixed contact 21 (see FIG. 2). Therefore, when the first electrode 12 and the second electrode 22 are electrically connected to the first end and the second end of the electric circuitry respectively, the circuit interrupter 100 forms an electric path between the first electrode 12 and the second electrode 22.

As shown in FIGS. 1, 3, the housing 7 includes an inner hollow cylinder 71, an outer hollow cylinder 72, and a cover member 73.

The inner hollow cylinder 71 is made of a material having electrically insulating properties, for example, a resin material. The inner hollow cylinder 71 has a bottomed hollow circular cylindrical shape with a closed lower surface and an open upper surface. A holding rib 711 which has a hollow circular cylindrical shape is provided to an upper surface of a lower wall of the inner hollow cylinder 71 (a bottom surface of the inner hollow cylinder 71). The holding rib 711 is formed concentrically with the inner hollow cylinder 71.

The outer hollow cylinder 72 is made of, for example, a metal material. The outer hollow cylinder 72 is preferably made of a non-magnetic metal material. Examples of the non-magnetic metallic material may include an austenitic stainless steel such as SUS304. However, the material of the outer hollow cylinder 72 may not be non-magnetic and may be, for example, an alloy containing iron as a main component, such as 42 alloy.

The outer hollow cylinder 72 is concentric with the inner hollow cylinder 71 and has a bottomed hollow circular cylindrical shape with a closed lower surface and an open upper surface. The outer hollow cylinder 72 is provided to surround a periphery of the inner hollow cylinder 71. In other words, the outer hollow cylinder 72 is a strength member for improving the strength of the housing 7 (the strength of an outer wall of the accommodation 70).

The inner hollow cylinder 71 may be integrally formed with the outer hollow cylinder 72 by, for example, insert molding or the like. The housing 7 may not include the outer hollow cylinder 72.

The cover member 73 is made of a material having electrically insulating properties, for example, a resin material. The cover member 73 has a bottomed hollow cylindrical shape with a closed upper surface and a lower surface having an opening. The cover member 73, for example, may be formed integrally with the first fixed terminal 1 and the second fixed terminal 2 by insert molding.

A thickness of an upper wall of the cover member 73 is larger than a thickness of a side wall of the cover member 73. A through hole 731 which is concentric with the cover member 73 is formed in a center of the upper wall of the cover member 73. The pyroactuator 5 is placed inside the through hole 731 of the cover member 73. A lower end of the pyroactuator 5 protrudes from a lower surface (inner surface) of the upper wall of the cover member 73. The through hole 731 is hermetically closed by the pyroactuator 5 (a case 52 thereof).

An annular recessed groove 732 is formed in a lower surface of the side wall of the cover member 73. By inserting upper edges of the inner hollow cylinder 71 and the outer hollow cylinder 72 into the recessed groove 732, the inner hollow cylinder 71 and the outer hollow cylinder 72 are coupled to the cover member 73. As a result, the housing 7 has the airtight inside space (the accommodation 70) surrounded by the inner hollow cylinder 71 and the cover member 73. The first fixed contact 11, the second fixed contact 21, and the movable contactor 3 are accommodated in the inside space (the accommodation 70) of the housing 7.

In the present embodiment, the shape of the housing 7 is a substantially circular cylindrical shape having an inside space (the accommodation 70) but may not be limited thereto. It is sufficient that the housing 7 has any shape as long as it has an inside space (the accommodation 70) for accommodating the first fixed contact 11, the second fixed contact 21, and the movable contactor 3. The housing 7 may have another shape such as a hollow polygonal prism (for example, a hollow rectangular parallelepiped shape).

The first yoke 61 is a ferromagnetic body and may be made of a metallic material such as iron. The first yoke 61 is fixed to the lower surface of the movable contactor 3 and is integral with the movable contactor 3 (see FIGS. 1, 3). That is, the first yoke 61 is fixed to an opposite surface of the movable contactor 3 from a surface where the first movable contact 31 and the second movable contact 32 are placed.

When a current flows through the movable contactor 3, the first yoke 61 allows a magnetic field caused by the current to pass through the first yoke 61. That is, when the first yoke 61 is not provided, the (concentric) magnetic field around the current flowing through the movable contactor 3 is generated. When the first yoke 61 is provided, the magnetic field is changed so as to pass through the first yoke 61. Therefore, the center of the magnetic field acting on the current flowing through the movable contactor 3 is attracted toward the surface where the first movable contact 31 and the second movable contact 32 are placed (i.e., the upper surface). As a result, a relatively upward force is generated in the movable contactor 3. Therefore, the connection between the pair of the first movable contact 31 and the second movable contact 32 and the pair of the first fixed contact 11 and the second fixed contact 21 are more easily maintained in a case where the first yoke 61 is provided than in a case where the first yoke 61 is not provided.

An engagement recess 610 which is a circular cylindrical recess is formed in a lower surface of the first yoke 61.

The second yoke 62 is a ferromagnetic body and may be made of a metallic material such as iron. The second yoke 62 is positioned and fixed at a position facing the first yoke 61 with the movable contactor 3 in-between and is separated from the movable contactor 3. The second yoke 62 may be in contact with the second end 532 (lower end) of the piston 53 of the pyroactuator 5. In this embodiment, the second yoke 62 is fixed to the second end 532 (lower end) of the piston 53 of the pyroactuator 5. The second yoke 62 is placed to face the center of the movable contactor 3 (see FIG. 2) but not to be in contact with the movable contactor 3 by a gap (see FIG. 3). The second yoke 62 is electrically insulated from the movable contactor 3.

The second yoke 62 includes a pair of protrusion parts 621, 622 (see FIG. 3) protruding in the upward direction at its both ends in the forward/backward direction. In other words, formed on both ends in the forward/backward direction of the upper surface of the second yoke 62 are the protrusion parts 621, 622 respectively facing the side surface in the forward/backward direction of the movable contactor 3. As shown in FIG. 3, a distal end surface (lower end surface) of the protrusion part 621 which is a front one of the pair of protrusion parts 621,622 faces a front end of the first yoke 61 and a distal end surface (lower end surface) of the protrusion part 622 which is a back one of the pair faces a back end of the first yoke 61. Therefore, when a current flows between the first fixed terminal 1 and the second fixed terminal 2 through the movable contactor 3, a magnetic flux passing through a magnetic path formed by the first yoke 61 and the second yoke 62 is developed. At this time, the front end of the first yoke 61 and the protrusion part 621 at the front end of the second yoke 62 are magnetized to have different polarities. The back end of the first yoke 61 and the protrusion part 622 at the back end of the second yoke 62 are magnetized to have different polarities. As a result, an attraction force acts between the first yoke 61 and the second yoke 62. The second yoke 62 is fixed to the second end 532 (lower end) of the piston 53 and therefore the attraction force moves the first yoke 61 in the upward direction. When the first yoke 61 is move in the upward direction, an upward force is applied to the movable contactor 3 by the first yoke 61.

While a current flows through the movable contactor 3, this current may cause an electromagnetic repulsive force separating the first movable contact 31 and the second movable contact 32 from the first fixed contact 11 and the second fixed contact 21. That is, when a current flows through the movable contactor 3, the Lorentz force may cause the electromagnetic repulsive force, which moves the movable contactor 3 downward, on the movable contactor 3.

In the present embodiment, as described above, the magnetic field is changed by the first yoke 61 to pass through the first yoke 61 and therefore an upward force is generated in contrast to a case where the first yoke 61 is not provided. The above-mentioned attraction force acts between the first yoke 61 and the second yoke 62. Consequently, the current flowing through the movable contactor 3 causes a force moving the movable contactor 3 upward, i.e. a force pressing the first movable contact 31 and the second movable contact 32 onto the first fixed contact 11 and the second fixed contact 21, respectively.

As described above, the first yoke 61 and the second yoke 62 serves as a connection maintenance mechanism which produces a force maintaining the connection between the pair of the first movable contact 31 and the second movable contact 32 and the pair of the first fixed contact 11 and the second fixed contact 21 by using a current flowing through the movable contactor 3.

Placed between the protrusion parts 621, 622 of the second yoke 62 and the both ends in the forward/backward direction of the upper surface of the first yoke 61 are spacers 631, 632 made of a material having electrically insulating properties, for example, a resin material (see FIG. 3). Thus, the electrically insulating properties between the second yoke 62 and the first yoke 61 are ensured.

As shown in FIGS. 1, 3, the holding unit 4 of the present embodiment includes a contact pressure spring 41. The contact pressure spring 41 is a coil spring. The contact pressure spring 41 is placed between the bottom surface (inner surface) of the inner hollow cylinder 71 and the lower surface of the first yoke 61. The contact pressure spring 41 has a coil axis extending along the upward/downward direction. The holding rib 711 of the inner hollow cylinder 71 is inserted into an inside of a first end 411 of the contact pressure spring 41. A second end 412 of the contact pressure spring 41 is inserted into the engagement recess 610 of the first yoke 61. The contact pressure spring 41 gives an upward elastic force to the movable contactor 3 via the first yoke 61. That is, the circuit interrupter 100 includes as the holding unit 4 an elastic part (the contact pressure spring 41) for providing to the movable contactor 3 an elastic force in a direction in which the movable contact (first movable contact) 31 is connected to the fixed contact (first fixed contact) 11 (in a direction toward the closed position).

The contact pressure spring 41 presses the movable contactor 3 in the upward direction through the first yoke 61. The contact pressure spring 41 holds the movable contactor 3 so that the first movable contact 31 is connected to the first fixed contact 11 and the second movable contact 32 is connected to the second fixed contact 21.

Figure 4:
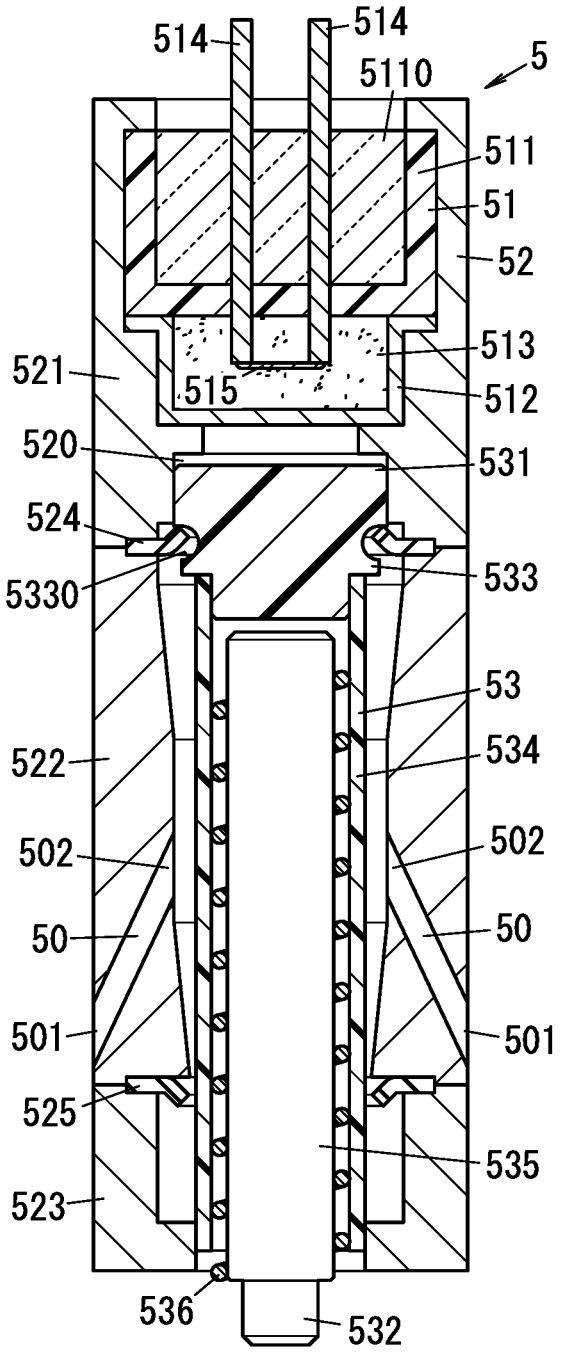
FIG. 4 is a cross-sectional view of a pyroactuator included in the above circuit interrupter.

FIG. 4 shows a cross-sectional view of the pyroactuator 5 of the present embodiment. The pyroactuator 5 of the present embodiment has a so-called pin pusher structure configured to push out the piston 53 (the pin 535) by use of gas generated in the squib 51.

As shown in FIG. 4, the pyroactuator 5 includes the squib 51, a case 52 having the pressurized chamber 520 therein, and the piston 53.

The squib 51 includes a body 511, a metal sleeve (metal CAN) 512, a combustion part 513, a pair of pin electrodes 514, and a heating element 515.

The body 511 is made of, for example, a resin material or the like having electrically insulating properties and has a bottomed hollow circular cylindrical shape with an open upper surface and a closed lower surface. The inside space S110 of the body 511 is sealed with a sealing material having electrically insulating properties such as glass.

The metal sleeve 512 is made of metal such as stainless steel, for example, and includes a hollow circular cylindrical part having a bottomed hollow circular cylinder with an open upper surface and a closed lower surface and a flange part protruding laterally from an upper end of the hollow circular cylindrical part, which are formed integrally. Formed in a center of a lower wall of the metal sleeve 512 (the hollow circular cylindrical part thereof) is a cross groove with a depth not penetrating through the lower wall or the like. That is, a portion of the lower wall of the metal sleeve 512 serves as a lower strength portion which is lower in strength (more easily broken) than the other portion of the metal sleeve 512. The metal sleeve 512 is coupled to the body 511 at the flange with bond to cover the lower surface of the body 511.

The combustion part 513 includes an explosive such as nitrocellulose, for example. The combustion part 513 is placed in a space surrounded by the body 511 and the metal sleeve 512. The explosive contained in the combustion part 513 may be any material that generates an electrically insulating gas by combustion and is not limited to nitrocellulose.

Each of the pair of pin electrodes 514 has a first end positioned within the combustion part 513 (in the space surrounded by the body 511 and the metal sleeve 512) and a second end exposed outside the pyroactuator 5 through the body 511. The second ends of the pair of pin electrodes 514 are connected to the control circuitry 207.

The heating element 515 is an element that generates heat by energization. In the present embodiment, the heating element 515 is a nichrome wire. The heating element 515 is placed in the combustion part 513 (the space surrounded by the body 511 and the metal sleeve 512). The heating element 515 is connected between the first ends of the pair of pin electrodes 514.

In the squib 51, when a current from the control circuitry 207 flows between the pair of pin electrodes 514, the heating element 515 generates heat and this causes increase in the temperature of the combustion part 513. When the temperature of the combustion part 513 (a surrounding part of the heating element 515) exceeds an ignition temperature, the explosive combusts explosively to generate a large amount of gas (for example, carbon monoxide gas, carbon dioxide gas, nitrogen gas) instantaneously. When the pressure in the combustion part 513 exceeds a withstand pressure of the low strength portion of the metal sleeve 512 due to generation of gas, the low strength portion is broken and the gas generated by combustion is discharged to the outside (in this embodiment, the lower pressurized chamber 520) through the broken portion.

As shown in FIG. 4, the piston 53 includes a base 533, a cylinder 534, the pin (rod) 535, and a spring 536.

The base 533 is formed of an electrically insulating material such as, for example, resin, and is made of, for example, polycarbonate or polybutylene terephthalate. The base 533 includes a first columnar section, a second columnar section, and a third columnar section in this order from the top each of which has a circular cylindrical shape. The first columnar section, the second columnar section, and the third columnar section are connected (concentrically) in the upward/downward direction with their axes being aligned. An outer diameter of the first columnar section is larger than an outer diameter of the second columnar section and the outer diameter of the second columnar section is larger than an outer diameter of the third columnar section. An annular holding groove 5330 which is concentric with the first columnar section and the second columnar section is formed at a boundary between the first columnar section and the second columnar section on an outer side surface of the base 533.

In the present embodiment, a bottom surface (upper surface) of the first columnar section of the base 533 serves as the first end 531 of the piston 53.

The cylinder 534 is made of an electrically insulating material such as resin. The cylinder 534 is formed in a hollow circular cylindrical shape. An inner diameter of the cylinder 534 is approximately equal to the outer diameter of the third columnar section of the base 533 but is smaller than the outer diameter of the second columnar section of the base 533. The outer diameter of the cylinder 534 is smaller than the outer diameter of the second columnar section of the base 533. The third columnar section of the base 533 is fitted into an opening in the upper surface of the cylinder 534 and thus the cylinder 534 and the base 533 are coupled to each other.

The pin 535 is made of an electrically insulating material such as, for example, resin, and is made of, for example, polycarbonate or polybutylene terephthalate. The pin 535 includes a large diameter portion and a small diameter portion in this order from the top each of which has a circular cylindrical shape. The large diameter portion and the small diameter portion are (concentrically) connected in the upward/downward direction with their axes being aligned. A length in an axial direction (the upward/downward direction) of the large diameter portion of the pin 535 is comparable to the length of the cylinder 534. Specifically, the length of the pin 535 is slightly greater than the distance between the bottom surface (lower surface) of the base 533 coupled to the cylinder 534 and the lower end of the cylinder 534. As shown in FIG. 1, the small diameter portion of the pin 535 is fixed in the through hole of the second yoke 62. In the present embodiment, part including the small diameter portion of the pin 535 serves as the second end 532 of the piston 53.

As shown in FIG. 4, the spring 536 is a coil spring. The spring 536 defines a relative position between the cylinder 534 and the pin 535. Specifically, the spring 536 is sandwiched between an inner side surface of the cylinder 534 and an outer side surface of the pin 535 to hold the pin 535 inside the cylinder 534.

The case 52 includes a holder 521, a sleeve 522, a cap 523, a first holding spring 524, and a second holding spring 525. The case 52 is formed in a substantially hollow circular cylindrical shape as a whole.

The holder 521 of the case 52 is made of metal, for example, aluminum or an aluminum alloy. The holder 521 has a substantially hollow circular cylindrical shape with open upper and lower surfaces and has an inner side surface which is a circumferential surface with multiple steps. The holder 521 holds the squib 51 and the piston 53.

The squib 51 is fitted into a space at an upper part of the holder 521 of the case 52. An inner surface of the upper part of the holder 521 has a shape in substantially close contact with the outer surface of the squib 51 (the outer side surface of the body 511, the outer surface of the flange part of the metal sleeve 512, the outer side surface of the hollow circular cylindrical part of the metal sleeve 512). The opening on the upper side of the holder 521 (the inner space thereof) is closed by the squib 51.

The base 533 of the piston 53 is fitted into a space of a lower part of the holder 521 of the case 52. An inner surface of the lower part of the holder 521 has a shape in substantially close contact with the outer side surface of the first columnar section of the base 533. An opening on a lower side of the holder 521 (the inner space thereof) is closed by the piston 53 (the base 533 thereof).

By attaching the squib 51 and the piston 53 to the case 52, a closed airtight space is formed between the lower surface of the squib 51 (the metal sleeve 512 thereof), the upper surface of the piston 53 (the base 533 thereof) and the inner surface of the case 52 (the holder 521 thereof). The gas generated by the squib 51 is introduced into the airtight space through the broken portion of the lower wall of the metal sleeve 512. That is, the airtight space functions as the pressurized chamber 520 that receives the pressure of the gas generated by the squib 51.

The sleeve 522 of the case 52 is made of metal, for example, steel. The sleeve 522 is placed below the holder 521 to make its outer side surface continuous to an outer side surface of the holder 521. The sleeve 522 is formed in a substantially cylindrical shape having open upper and lower surfaces. The sleeve 522 includes a first cylindrical portion, a second cylindrical portion and a third cylindrical portion which have a hollow circular cylindrical shape and are arranged in this order from above. The first cylindrical portion, the second cylindrical portion and the third cylindrical portion are connected in the upward/downward direction with these axes aligned (concentrically). The inner surface of the first cylindrical portion is formed in a tapered shape with a smaller diameter toward the lower side. The inner side surface of the second cylindrical portion is formed in a hollow circular cylindrical shape having a constant diameter. The inner diameter of the second cylindrical portion is substantially equal to the outer diameter of the first columnar section (the largest diameter portion) of the base 533 of the piston 53. The inner side surface of the third cylindrical portion is formed in a tapered shape with a smaller diameter toward the lower side. The diameter of the inner side surface of the third cylindrical portion is substantially equal to the outer diameter of the first columnar section of the base 533 (the largest diameter portion in the base 533) at its upper end and becomes smaller toward the lower end. In other words, the third cylindrical portion of the sleeve 522 has a shape not allowing the base 533 of the piston 53 to pass therethrough.

There are two channels 50 interconnecting the inside and the outside of the case 52 formed in the side wall of the sleeve 522 of the case 52. As shown in FIG. 1, each channel 50 includes a first end 501 connected to the accommodation 70 and a second end 502 connected to the inside space of the case 52. Each channel 50 has a circular cylindrical shape having a constant diameter. One of the two channels 50 (a left channel 50 in FIG. 1) is formed in part of the side wall of the sleeve 522 of the case 52 which faces the first fixed terminal 1. The channel 50 guides the gas generated by the squib 51 to allow the gas to blow into the predetermined space S1 between the first movable contact 31 and the first fixed contact 11 (a space including a track of movement of the first movable contact 31, see FIG. 7). That is, the gas generated by the squib 51 is introduced into the predetermined space S1 between the fixed contact (first fixed contact) 11 and the movable contact (first movable contact) 31 while the movable contactor 3 is in the open position. The other of the two channels 50 (a right channel 50 in FIG. 1) is formed in part of the side wall of the sleeve 522 of the case 52 which faces the second fixed terminal 2.

The channel 50 guides the gas generated by the squib 51 to allow the gas to blow into the predetermined space S2 between the second movable contact 32 and the second fixed contact 21 (a space including a track of movement of the second movable contact 32). Each of the two channels 50 extends obliquely downward from the inside to the outside of the case 52.

In the present embodiment, each channel 50 is linear. However, the shape of the channel 50 is not particularly limited, and may be another shape such as a curved shape, for example. The diameter of the channel 50 is not particularly limited. The direction in which the channel 50 extends is not particularly limited, and may extend laterally (in a horizontal direction), for example. Further, there is no particular limitation on the position where the channel 50 is formed, and the channel 50 may be formed, for example, in a front portion or a back portion of the side wall of the sleeve 522 of the case 52. However, it is preferable that each of the channels 50 is formed in a shape, a diameter, an orientation, and a position to allow the gas generated by the squib 51 to blow into the predetermined space S1 or the predetermined space S2.

The cap 523 of the case 52 is made of metal, for example, steel. The cap 523 is placed below the sleeve 522 to make its outer side surface continuous to the outer side surface of the sleeve 522. The cap 523 has a hollow circular cylindrical shape with both upper and lower surfaces open. A projecting portion (flange) projecting inward is formed at the lower surface of the cap 523. An inner diameter of the projecting portion (flange) is approximately equal to the outer diameter of the cylinder 534 of the piston 53. The piston 53 is an operating pin which moves in one direction in response to reception of the pressure of the gas generated by the squib 51.

In the present embodiment, the outer diameters of the holder 521, the sleeve 522, and the cap 523 are equal to each other.

The first holding spring 524 includes a clamping portion having a hollow disk shape and a holding portion having a hollow frustoconical shape protruding obliquely upward from an inner side surface of the clamping portion. The clamping portion of the first holding spring 524 is sandwiched between the holder 521 and the sleeve 522 of the case 52. Thereby, the first holding spring 524 is sandwiched between the holder 521 and the sleeve 522. The first holding spring 524 seals a gap at a boundary between the holder 521 and the sleeve 522. The holding portion is in contact with the holding groove 5330 of the base 533 of the piston 53 and applies an upward force to the base 533 to hold the base 533 (prevent downward movement of the base 533).

The second holding spring 525 includes a clamping portion having a hollow disk shape and a holding portion having a hollow frustoconical shape protruding obliquely downward from an inner side surface of the clamping portion. The clamping portion of the second holding spring 525 is sandwiched between the sleeve 522 and the cap 523 of the case 52. Thereby, the second holding spring 524 is sandwiched between the sleeve 522 and the cap 523. The second holding spring 525 seals a gap at a boundary between the sleeve 522 and the cap 523. A protruding tip of the holding portion is away from the outer side surface of the cylinder 534 of the piston 53. A diameter of the protruding tip of the holding portion is approximately equal to the outer diameter of the second columnar section of the base 533 of the piston 53.

As shown in FIG. 4, in a state where the squib 51 and the piston 53 is attached to the case 52, the pin electrode 514 of the squib 51 protrudes from the upper surface of the case 52. Further, the small diameter portion of the pin 535 protrudes downward from the lower surface of the case 52.

As shown in FIG. 1, the pyroactuator 5 is attached to the housing 7 so that the case 52 closes the through hole 731 of the cover member 73. In this state, the second end of the piston 53 (the lower end of the pin 535) faces the center of the movable contactor 3 (the center in the length direction and the width direction).

(1.2.3) Operation

Next, the operation of the circuit interrupter 100 having the above-described configuration will be described with reference to FIGS. 1, 6, 7.

As to the circuit interrupter 100, the first electrode 12 is connected to the first end of the electric circuitry (e.g., the circuitry constituting the power supply system 200) and the second electrode 22 is connected to the second end of the electric circuitry. Here, the first end of the electric circuitry is given a higher potential than the second end.

In a normal state of the electric circuitry, the movable contactor 3 is held by the spring force of the pressure spring 41 and the like so that the first movable contact 31 is connected to the first fixed contact 11 and the second movable contact 32 is connected to the second fixed contact 21 (see FIG. 1). In summary, in the normal state of the electric circuitry, the movable contactor 3 is in the closed position where the first movable contact 31 is in contact with the first fixed contact 11 and the second movable contact 32 is in contact with the second fixed contact 21. At this time, a current flows from the first electrode 12 to the second electrode 22 by passing through the first fixed contact 11, the first movable contact 31, the movable contactor 3, the second movable contact 32, and the second fixed contact 21 in this order.

At this time, the contact between the first movable contact 31 and the first fixed contact 11 and the contact between the second movable contact 32 and the second fixed contact 21 are maintained by the spring force of the contact pressure spring 41, the attraction force between the first yoke 61 and the second yoke 62, and the like. Incidentally, even if an overcurrent or the like flows in the circuit interrupter 100, contact between the contacts is maintained due to the attraction force between the first yoke 61 and the second yoke 62 and the like as long as the magnitude of the overcurrent is relatively small.

When the current flowing through becomes an abnormal current with its value equal to or higher than a prescribed value (in an abnormal state of the electric circuitry), the control circuitry 207 detects the abnormal current. Upon detecting the abnormal current, the control circuitry 207 operates (activates) the circuit interrupter 100 to break the electric circuitry.

Specifically, the control circuitry 207 allows a current to flow between the pair of pin electrodes 514 to energize the heating element 515. When energized, the heating element 515 generates heat and increases the temperature of the combustion part 513. When the temperature of the combustion part 513 exceeds the ignition temperature of the explosive, the explosive is combusted to generate a large amount of gas and the low strength portion of the lower wall of the metal sleeve 512 is broken by the pressure of the gas and the gas is discharged to the pressurized chamber 520 through the broken portion. Since the combustion part 513 explosively combusts to generate a large amount of gas, the pressure in the pressurized chamber 520 rapidly increases in a short time.

In an initial state, the piston 53 is in the first position (see FIG. 1). The piston 53 receives the pressure in the pressurized chamber 520 with the first end 531 (the upper surface of the base 533) and then is pressed downward to press the movable contactor 3 downward with the second end 532 (the pin 535). The piston 53 applies a force to part of the movable contactor 3 between the first movable contact 31 and the second movable contact 32 to move the movable contactor 3 downward. The piston 53 moves to the second position (see FIG. 7) while pressing the movable contactor 3.

Specifically, in the piston 53, the bottom surface (upper surface) of the base 533 receives the pressure in the pressurized chamber 520 and the base 533 starts to move downward together with the cylinder 534 against the spring force of the first holding spring 524. An initial speed of the base 533 (the piston 53) at this time becomes very large because of the large pressure in the pressurized chamber 520. The pin 535 receives a downward force from the cylinder 534 via the spring 536 and starts to move downward slightly later from the start of downward movement of the cylinder 534. The pin 535, the second yoke 62, the first yoke 61 and the movable contactor 3 is provided as an integral part. Due to downward movement of the pin 535, the movable contactor 3 is pressed downward and then moves downward. Here, after start of downward movement of the base 533, an elastic force stored in the spring 536 acts on the pin 535 and therefore a very large downward force is applied on the pin 535 and thus the initial speed also increases.

A force pressing the movable contactor 3 downward exceeds a force supporting the movable contactor 3 upward (the spring force of the contact pressure spring 41, the attraction force between the first yoke 61 and the second yoke 62, and the like), the movable contactor 3 moves downward while compressing the contact pressure spring 41 through the first yoke 61. Thus, the first movable contact 31 is separated from the first fixed contact 11 and the second movable contact 32 is separated from the second fixed contact 21 (see FIG. 6). As a result, the electric path between the first fixed terminal 1 and the second fixed terminal 2 is interrupted and the current flowing through the electric path between the first fixed terminal 1 and the second fixed terminal 2 is interrupted.

The piston 53, the first yoke 61, the movable contactor 3, and the second yoke 62 is integrally moved downward (hereinafter, for convenience of explanation, a set of the piston 53, the first yoke 61, the movable contactor 3, and the second yoke 62 is referred to as a movable body). A direction in which the piston 53 moves and a direction in which the movable contactor 3 moves by the piston 53 are the same direction. Typically, the movable body moves to a position where the contact pressure spring 41 is most compressed (the second position) (see FIG. 7). In summary, the movable contactor 3 moves to the open position where the first movable contact 31 is separated from the first fixed contact 11 and the second movable contact 32 is separated from the second fixed contact 21. At this time, the base 533 of the piston 53 moves inside the third cylindrical portion while pressing and expanding (modifying) the inner surface of the third cylindrical portion of the sleeve 522 of the case 52. Incidentally, kinetic energy of the movable body is converted into elastic energy of the contact pressure spring 41, thermal energy generated when the movable body strikes the bottom surface of the inner hollow cylinder 71, and the like.

The movable body receives an upward force from the compressed contact pressure spring 41 at a position where the contact pressure spring 41 is compressed. However, the upward movement of the movable body is blocked by a frictional force between the base 533 and the third cylindrical portion of the sleeve 522 of the case 52. As a result, the movable body stops at a position shown in FIG. 7 (the second position). In other words, the third cylindrical portion functions as a detent mechanism that mechanically holds the piston 53 after movement of the movable contactor 3 to prevent the piston 53 from returning to its original position (the first position).

Further, the downward movement of the piston 53 (movement from the first position to the second position) extends the space in the case 52 the pressure of which is increased by introduction of the gas of the squib 51 (the pressurized chamber 520). As shown in FIG. 7, extension of the pressurized chamber 520 allows the second end 502 of each channel 50 to be connected to the pressurized chamber 520. As a result, the pressurized chamber 520 and the accommodation 70 are interconnected by the channel 50. Therefore, the gas generated by the squib 51 is introduced into the accommodation 70 through the pressurized chamber 520 and the channel 50. In the present embodiment, the gas introduced into the accommodation 70 goes to the predetermined space S1 between the first movable contact 31 and the first fixed contact 11 or the predetermined space S2 between the second movable contact 32 and the second fixed contact 21 (see arrow W1 in FIG. 7).

Figure 8A:
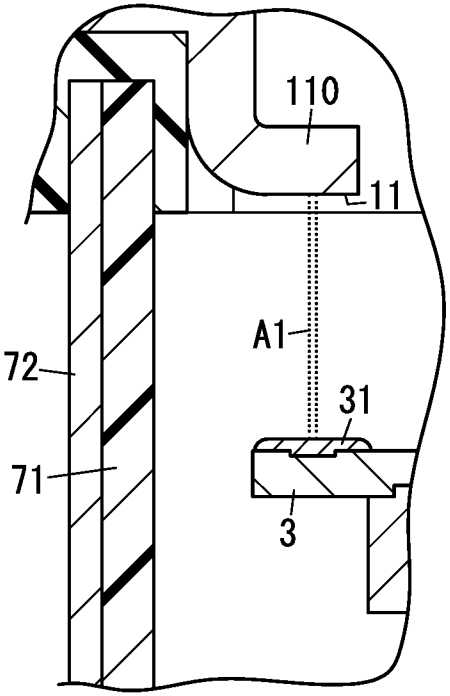
FIGS. 8A-8C are diagrams for illustration of stretch of an arc by a gas in the above circuit interrupter.

Here, when the first movable contact 31 is pulled away from the first fixed contact 11 while a current flows in the movable contactor 3, there is a possibility that an arc is generated between the first movable contact 31 and the first fixed contact 11 (see dotted line A1 in FIG. 8A). Similarly, when the second movable contact 32 is pulled away from the second fixed contact 21 while a current flows in the movable contactor 3, there is a possibility that an arc is generated between the second movable contact 32 and the second fixed contact 21.

In contrast, in the circuit interrupter 100 of the present embodiment, the gas generated by the squib 51 of the pyroactuator 5 (electrically insulating gas) is introduced into the accommodation 70, thereby increasing the pressure of the accommodation 70. The accommodation 70 forms a sealed space together with the pressurized chamber 520. The accommodation 70 accommodates the fixed contact (first fixed contact) 11 and the movable contact (first movable contact) 31 therein, and includes the predetermined space S1. The accommodation 70 is also a space where an arc occurs therein. Increase in the pressure of the accommodation 70 causes the arc generated between the contacts to be cooled. Therefore, the electrically insulating properties of the plasma of the arc discharge or the metal vapor is enhanced and the extinction of the arc is promoted.

Further, in the circuit interrupter 100 of the present embodiment, the gas introduced from the channel 50 into the accommodation 70 blows into the predetermined space S1 between the first movable contact 31 and the first fixed contact 11, or the predetermined space S2 between the second movable contact 32 and the second fixed contact 21. Thus, the arc generated between the contacts is cooled and the arc extinction is promoted.

Figure 8B:
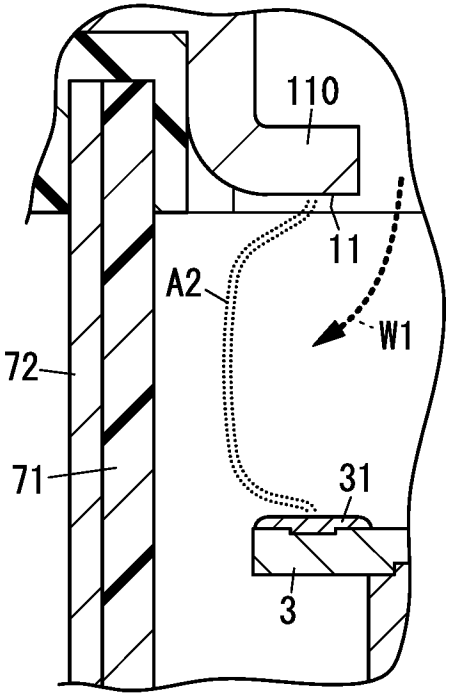
Figure 8C:
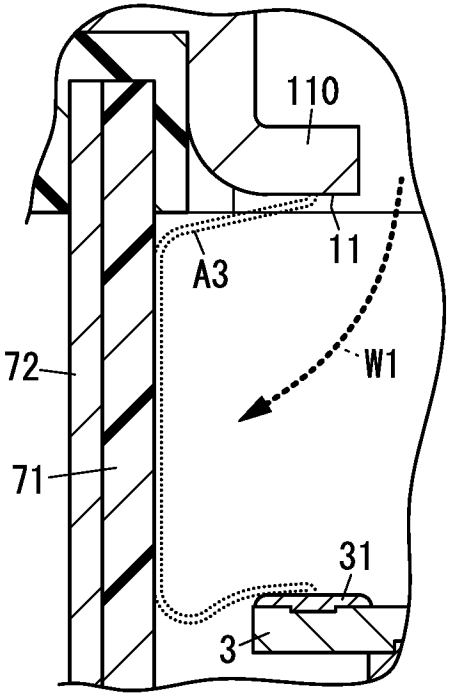

More specifically, as to a process of movement of the movable contactor 3 from the closed position to the open position, in the early stage of movement from the closed position to the open position, a positive column of the arc discharge is developed between the fixed contact (first fixed contact) 11 and the movable contactor 3 (see dotted line A1 in FIG. 8A). As the position is changed from the closed position to the open position, the gas is introduced into the accommodation 70. The gas strikes the positive column and then the positive column is deformed by the pressure of the gas, thereby stretching the arc (see dotted line A2 in FIG. 8B). Furthermore, the arc is stretched by the gas. In some cases the arc is pressed against the wall surface of the inner hollow cylinder 71 (see dotted line A3 in FIG. 8C). Thus, the arc is stretched by the gas and then the arc is interrupted. That is, the gas generated by the squib 51 is introduced into a gap between the fixed contact (first fixed contact) 11 and the movable contactor 3. Thereby, the arc extinction is promoted and the interruption performance can be improved. Incidentally, the arc generated between the second movable contact 32 and the second fixed contact 21 is blown by the gas and then stretched. Thus, the arc extinction is promoted.

Thus, in the circuit interrupter 100 of the present embodiment, the gas generated by the squib 51 is introduced into the predetermined spaces S1, S2. Thereby, it is possible to quickly extinguish the arc.

The inner wall (inner hollow cylinder 71) of the housing 7 may be made of a resin material (arc extinction gas generating member) which releases an arc extinction gas by being heated by a stretched arc. Examples of the arc extinction gas may include $CO_2$ gas, $N_2$ gas, and $H_2O$ gas. The arc extinction gas makes it possible to quickly extinguish the arc.

(1.3) Variations

The circuit interrupter 100 of one variation of embodiment 1 will be described with reference to FIGS. 9,10. Hereinafter, the circuit interrupter 100 of embodiment 1 described above is also referred to as the circuit interrupter 100 of the basic example of embodiment 1.

Figure 9:
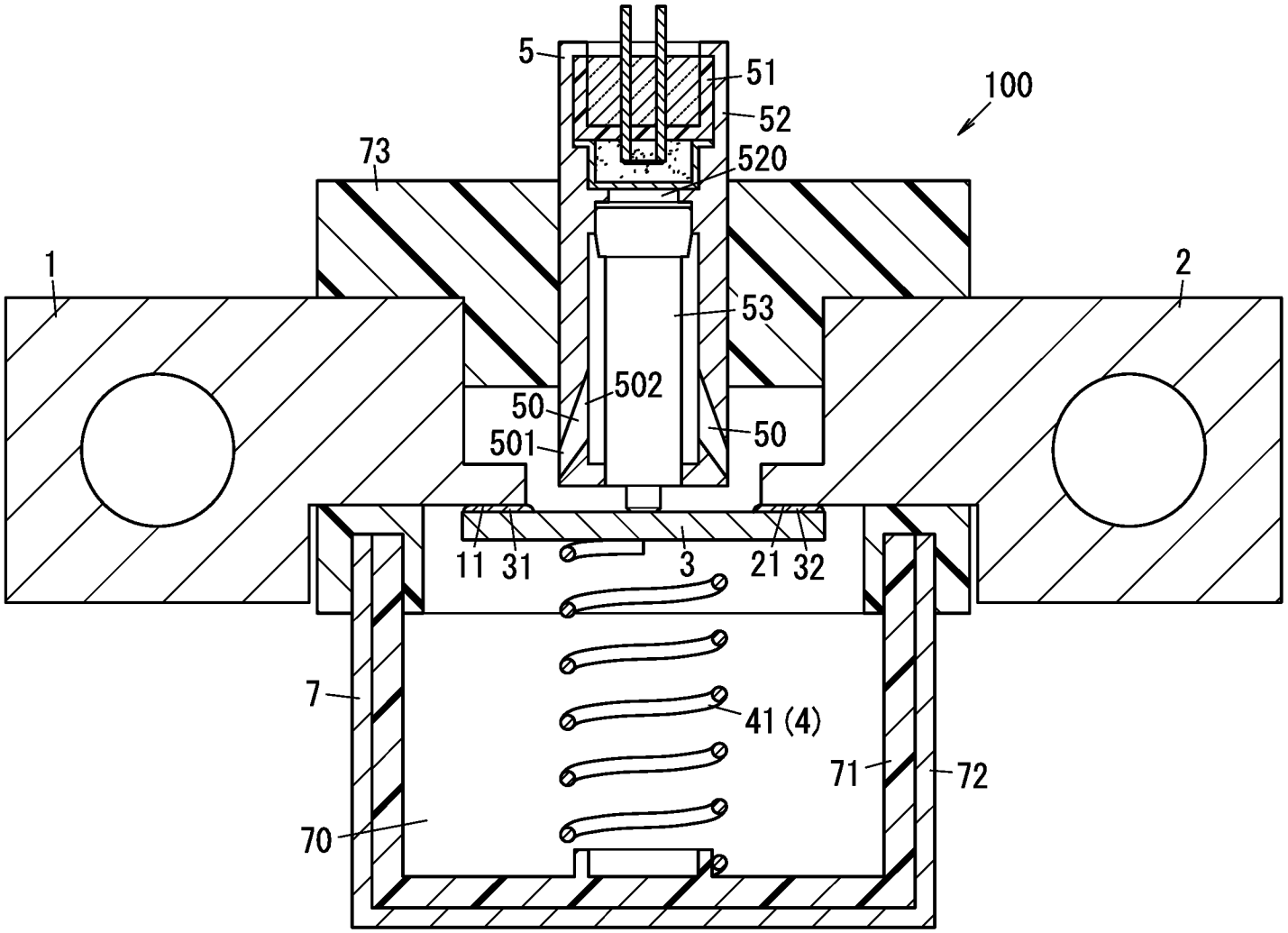
FIG. 9 is a cross-sectional view of a circuit interrupter of one variation according to embodiment 1.
Figure 10:
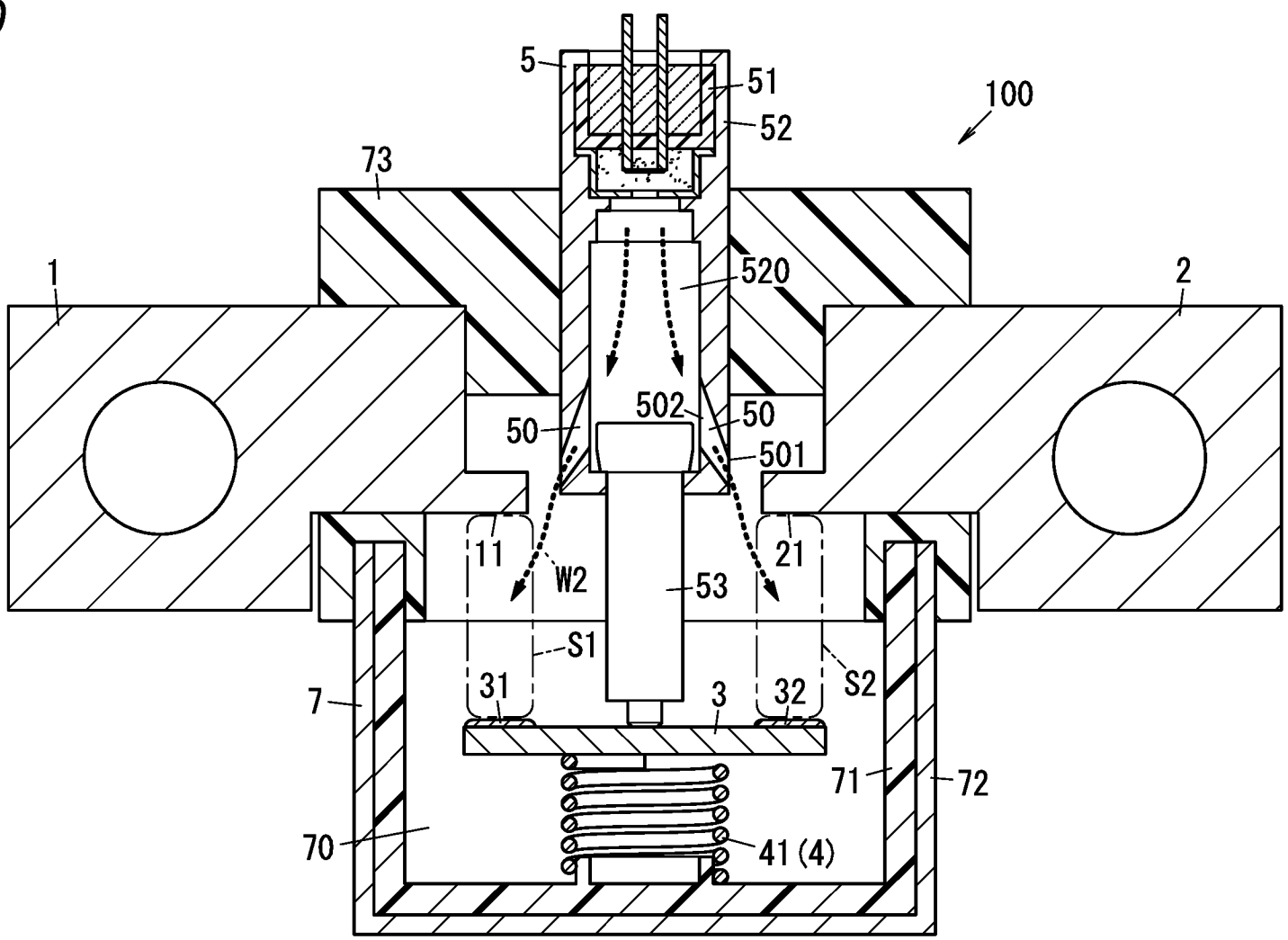
FIG. 10 is a cross-sectional view of the above circuit interrupter after operation.

FIGS. 9, 10 show cross-sectional views of the circuit interrupter 100 of one variation before and after operation. Only for convenience, the first yoke 61 and the second yoke 62 are not depicted in FIGS. 9, 10. In FIGS. 9, 10, the illustration of the case 52 is simplified. However, similarly to the circuit interrupter 100 of embodiment 1, the case 52 may include, as the detent mechanism, the second cylindrical portion (a portion having a frustoconical inner surface whose diameter decreases toward the lower side) and the third cylindrical portion (a portion having a cylindrical inner surface having a smaller diameter than the base 533 of the piston 53). Further, in the circuit interrupter 100 of one variation, the piston 53 is one molded article. Further, in the circuit interrupter 100 of one variation, although the shapes of the first fixed terminal 1 and the second fixed terminal 2 are different from those of the circuit interrupter 100 of the basic example of embodiment 1 but may be the same.

In the circuit interrupter 100 of one variation, the channel 50 has a tapered cylindrical shape which is gradually smaller in diameter toward the outside (the accommodation 70) of the case 52 than at the inside of the case 52. That is, a diameter of the first end 501 of the channel 50 (an end close to the accommodation 70) is smaller than a diameter of the second end 502. Thus, a flow rate of the gas flowing from the second end 502 to the first end 501 is increased in the channel 50. Thus, the flow rate of the gas in the predetermined space S1, S2 is increased. Therefore, it is possible to cool the arc generated between the contacts more effectively and to further promote the arc extinction.

Further, in the circuit interrupter 100 of one variation, the predetermined space S1 between the first fixed contact 11 and the first movable contact 31 while the movable contactor 3 is in the open position is located on an extension line of one channel 50 (the left one in FIGS. 9, 10). In other words, the extension line of one channel 50 intersects a line segment interconnecting the first movable contact 31 of the movable contactor 3 after movement and the first fixed contact 11 (referred to as a "first line segment"). In particular, the extension of one channel 50 intersects the first line segment in the vicinity of the first fixed contact 11. Further, the predetermined space S2 between the second fixed contact 21 and the second movable contact 32 while the movable contactor 3 is in the open position is located on an extension line of the other channel 50 (the right one in FIGS. 9, 10). In other words, the extension line of the other channel 50 intersects a line segment interconnecting the second movable contact 32 of the movable contactor 3 after movement and the second fixed contact 21 (referred to as a "second line segment"). In particular, the extension of the other channel 50 intersects the second line segment in the vicinity of the second fixed contact 21. With this configuration, in the circuit interrupter 100 of one variation, gases introduced into the accommodation 70 from the individual channels 50 goes to the predetermined spaces S1, S2 which are spaces between the contacts, and thus blow the arcs generated between the contacts directly (see arrow W2 in FIG. 10). Therefore, it is possible to cool the arc more effectively and to further promote the arc extinction. In addition, the arc can be extended more effectively and further the arc extinction can be promoted.

In the circuit interrupter 100 of the basic example and one variation of embodiment 1, the channel 50 is not limited to a columnar (cylindrical) shape formed in the side wall of the case 52. The channel 50 may be, for example, a cutout extending upward from the lower end of the side wall of the case 52.

In the circuit interrupter 100 of the basic example and one variation of embodiment 1, the pyroactuator 5 is not limited to being configured to move the movable contactor 3 by use of the piston 53. For example, the circuit interrupter 100 of embodiment 1 may be configured to allow the movable contactor 3 to receive the pressure of the gas generated in the squib 51 directly (the movable contactor 3 forms part of the outer wall of the pressurized chamber 520) and to allow the movable contactor 3 to be moved directly by the pressure of the gas. In this case, the channel 50 may not be provided in the case 52.

(2) Embodiment 2

The circuit interrupter 100 of embodiment 2 will be described with reference to FIGS. 11, 12.

The circuit interrupter 100 of embodiment 2 is mainly different from embodiment 1 in that the moving mechanism for moving the movable contactor 3 from the closed position to the open position includes a trip device 8. Configurations common to the circuit interrupter 100 of embodiment 2 and embodiment 1 are denoted by the same reference signs and explanations thereof are omitted appropriately.

(2.1) Configuration

Similarly to embodiment 1, the circuit interrupter 100 of the present embodiment includes the first fixed terminal 1, the second fixed terminal 2, the movable contactor 3, the holding unit 4 (the contact pressure spring 42 serving as an elastic part), the squib 51, the case 52, and the housing 7. However, in the circuit interrupter 100 of the present embodiment, the moving mechanism includes the trip device 8 instead of the pressurized chamber 520 and the piston 53. The trip device 8 moves the movable contactor 3 from the closed position to the open position in accordance with the abnormal current flowing in the circuit including the movable contact (first movable contact) 31 and the fixed contact (first fixed contact) 11.

Figure 11:
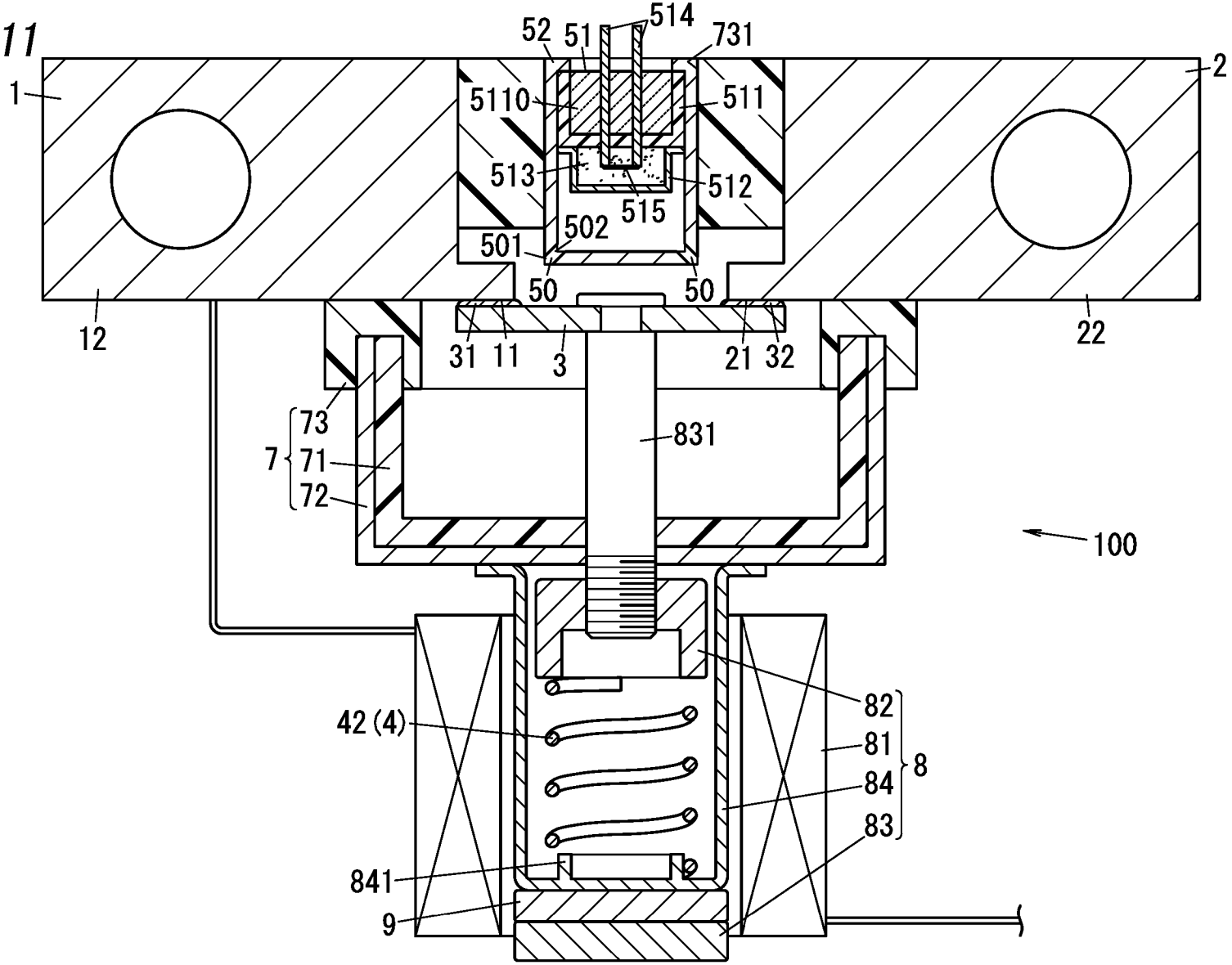
FIG. 11 is a cross-sectional view of a circuit interrupter of embodiment 2.
Figure 12:
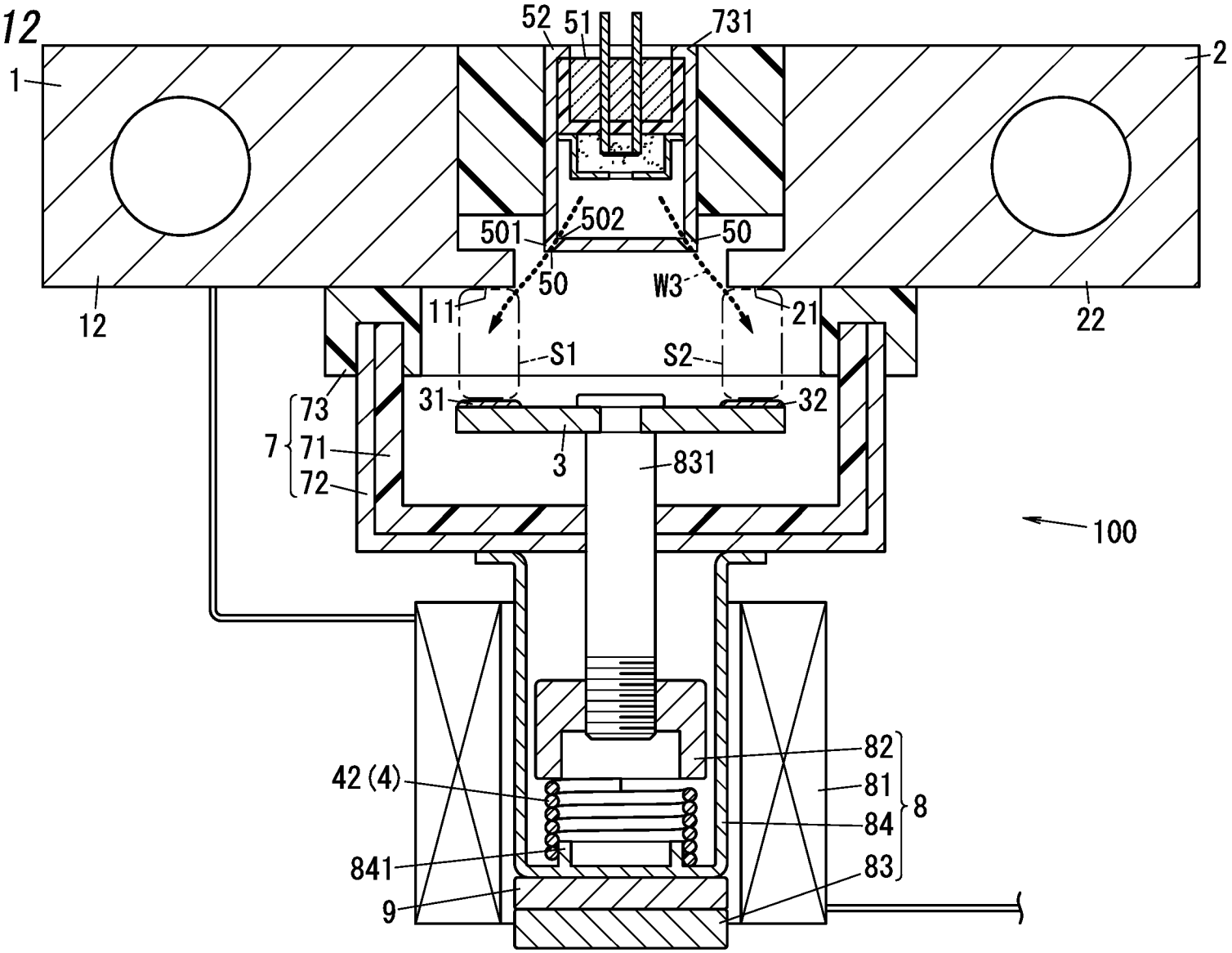
FIG. 12 is a cross-sectional view of the above circuit interrupter after operation.

As shown in FIG. 11, the trip device 8 of the present embodiment includes, an excitation coil 81, a mover 82, a stator 83, and a hollow cylindrical body 84. The trip device 8 of the present embodiment moves the movable contactor 3 to the open position by use of an electromagnetic force generated by a magnetic flux generated in the excitation coil 81 when the abnormal current flows through the excitation coil 81.

The excitation coil 81 includes a first end connected to the first fixed terminal 1. The excitation coil 81 includes a second end to be connected to the first end of the electric circuitry (circuitry constituting the power supply system 200) the second end of which is to be connected to the second fixed terminal 2. That is, the excitation coil 81 is connected in series with a series circuit of the first fixed terminal 1, the movable contactor 3, and the second fixed terminal 2 between the first end and the second end of the electric circuitry. Therefore, a current flowing through the movable contactor 3 also flows through the excitation coil 81. The excitation coil 81 is excited by this current. As shown in FIG. 11, the excitation coil 81 is wound around a lower portion of the hollow cylindrical body 84 and the stator 83.

The hollow cylindrical body 84 is made of a non-magnetic metal material. The hollow cylindrical body 84 includes a hollow cylindrical part formed in a hollow cylindrical shape and a bottom wall (lower wall) for closing one (lower) opening of the hollow cylindrical part. More specifically, the hollow cylindrical body 84 includes the hollow cylindrical part having a hollow circular cylindrical shape and the bottom wall having a circular shape, and is formed into a bottomed hollow circular cylindrical shape with an open upper surface as a whole. There is a through hole formed in a center of the bottom wall of the housing 7. The hollow cylindrical body 84 is fixed to the bottom wall of the housing 7 with its upper end (the periphery of the opening) to cover the through hole of the bottom wall of the housing 7.

The mover 82 is a moving iron core also formed in the shape of a cylinder. The mover 82 is made of a magnetic material. The mover 82 is accommodated in the hollow cylindrical body 84. The mover 82 is placed inside the hollow cylindrical body 84 to be movable in the upward/downward direction. In the hollow cylindrical body 84, the contact pressure spring 42 (the holding unit 4) is placed between the bottom wall (the upper surface thereof) of the hollow cylindrical body 84 and the mover 82 (the lower surface thereof). There is a holding rib 841 on the upper surface of the bottom wall of the hollow cylindrical body 84. The holding rib 841 is inserted into a lower end of the contact pressure spring 42. The mover 82 is pressed upward by the contact pressure spring 42. The mover 82 is movable between a first position in which the mover 82 is pressed upward by the contact pressure spring 42 and is in the upmost position (see FIG. 11) and a second position in which the mover 82 compresses the contact pressure spring 42 and is in the lowermost position (see FIG. 12). However, the mover 82 is always held in the first position by a spring force of the contact pressure spring 42. The mover 82 is coupled to the movable contactor 3 by a shaft 831 which penetrates through the through hole in the bottom wall of the housing 7.

The shaft 831 is made of a non-magnetic metallic material and has a round bar shape with a length in the upward/downward direction. An upper end of the shaft 831 is coupled to a center of the movable contactor 3. The shaft 831 passes through the through hole formed in the bottom wall of the housing 7 and a lower end thereof is coupled to the mover 82. Therefore, upward/downward movement of the mover 82 is transferred to the movable contactor 3 via the shaft 831. The movable contactor 3 moves in the upward/downward direction in synchronization with the movement of the mover 82.

As shown in FIG. 11, when the mover 82 is in the first position, the first movable contact 31 and the second movable contact 32 of the movable contactor 3 are in contact with the first fixed contact 11 and the second fixed contact 21, respectively. That is, when the mover 82 is in the first position, the movable contactor 3 is in the closed position. As shown in FIG. 12, when the mover 82 is in the second position, the first movable contact 31 and the second movable contact 32 of the movable contactor 3 are separated from the first fixed contact 11 and the second fixed contact 21, respectively. That is, when the mover 82 is in the second position, the movable contactor 3 is in the open position (see FIG. 12).

The stator 83 is a fixed iron core formed in the shape of a cylinder. The stator 83 is made of a magnetic material. The stator 83 is fixed below the bottom wall of the hollow cylindrical body 84.

In the trip device 8, all of the excitation coil 81, the mover 82 and the stator 83 have their central axes on the same straight line along the upward/downward direction.

The trip device 8 moves the mover 82 from the first position (the position shown in FIG. 11) to the second position (the position shown in FIG. 12) by the magnetic flux generated in the excitation coil 81 in response to the abnormal current which flows through the movable contactor 3 and has a value equal to or larger than the prescribed value. At this time, the movable contactor 3 is pulled by the shaft 831 to move from the closed position to the open position.

That is, the trip device 8 moves the mover 82 to the second position by the magnetic flux generated in the excitation coil 81 in response to the abnormal current flowing through the movable contactor 3, thereby forcibly separating the movable contact (first movable contact) 31 from the fixed contact (first fixed contact) 11. In the present embodiment, at this time, the second movable contact 32 is also separated from the second fixed contact 21. Hereinafter, the operation in which the trip device 8 forcibly separates the movable contact (first movable contact) 31 from the fixed contact (first fixed contact) 11 is referred to as "trip".

Here, the trip device 8 does not make trip just when the current flows through the excitation coil 81. The trip device 8 makes trip when an attraction force acting on the mover 82 from the stator 83 exceeds the spring force of the contact pressure spring 42. The attraction force acting on the mover 82 from the stator 83 changes according to the magnitude of the current flowing through the excitation coil 81 (the load current). The trip device 8 is configured so that the magnetic attraction force generated by the excitation coil 81 exceeds the spring force of the contact pressure spring 42 when the current flowing through the excitation coil 81 becomes the abnormal current with its value equal to or larger than the prescribed value.

There is a magnet 9 placed between the stator 83 and the bottom wall of the hollow cylindrical body 84. The magnet 9 is a permanent magnet and includes on its opposite surfaces in the upward/downward direction a first pole surface and a second pole surface which are different in polarities. The first pole surface (upper surface) of the magnet 9 is in contact with the bottom wall of the hollow cylindrical body 84. The second pole surface (the lower surface) of the magnet 9 is in contact with the stator 83. That is, the magnet 9 is sandwiched between the stator 83 and the bottom wall of the hollow cylindrical body 84. For example, the first pole surface and the second pole surface may be an N-pole surface and an S-pole face and vice versa.

When the trip device 8 moves the mover 82 to the second position, the magnet 9 holds the mover 82 in the second position by the magnetic flux generated by the magnet 9. That is, the circuit interrupter 100 of the present embodiment, after the trip device 8 moves the mover 82 to the second position, the mover 82 is held in the second position by the magnetic attraction force generated by the magnet 9. In other words, once the trip device 8 makes trip and the mover 82 is moved to the second position, the mover 82 is held (latched) in the second position by the magnet 9.

In the present embodiment, the magnet 9 is placed so that the direction of the magnetic flux generated in the excitation coil 81 and the direction of the magnetic flux generated in the magnet 9 are the same in the mover 82 after the mover 82 is moved to the second position by the trip device 8. That is, when the mover 82 is in the second position, the magnetic flux generated in the excitation coil 81 and the magnetic flux generated in the magnet 9 pass through the mover 82. Then, in the present embodiment, the polarities (directions of the pole surfaces) of the magnet 9 are set to generate the magnetic flux in the same direction as the magnetic flux generated by the excitation coil 81 in the mover 82.

The circuit interrupter 100 of the present embodiment includes the squib 51 and the case 52 in the pyroactuator 5 of the basic example of embodiment 1, but does not include the piston 53. In the circuit interrupter 100 of the present embodiment, the shape of the case 52 is different from that of the basic example of embodiment 1. The squib 51 of the present embodiment is the same as the basic example of embodiment 1 and explanation thereof is omitted.

The case 52 is made of metal, for example, aluminum or an aluminum alloy. The case 52 is formed in a bottomed hollow circular cylindrical shape with an open upper surface and a closed lower surface.

The squib 51 is fitted into a space in an upper portion of the case 52. An upper opening of the case 52 (the inside space thereof) is closed by the squib 51. The case 52 is fixed to the housing 7 to close the through hole 731 of the cover member 73.

There are two channels 50 interconnecting the inside and the outside of the case 52 formed in right and left side portions of the lower surface of the case 52. Each channel 50 includes a first end 501 connected to the accommodation 70 and a second end 502 connected to the inside space of the case 52. In the present embodiment, there is no airtight space inside the case 52. In the present embodiment, the gas generated in the squib 51 is directly introduced into the accommodation 70 (through the inside space of the case 52 and the channel 50).

Each channel 50 has a circular cylindrical shape having a constant diameter. One of the two channels 50 (the left channel 50 in FIGS. 11, 12) guides the gas generated by the squib 51 to blow into the predetermined space S1 between the first movable contact 31 and the first fixed contact 11 (see FIG. 12). The other of the two channels 50 (the right channel 50 in FIGS. 11, 12) guides the gas generated by the squib 51 to blow into the predetermined space S2 between the second movable contact 32 and the second fixed contact 21 (see FIG. 12). Each of the two channels 50 extends obliquely downward from the inside to the outside of the case 52.

(2.2) Operation

Next, the operation of the circuit interrupter 100 having the above-described configuration will be described with reference to FIGS. 11, 12.

In the circuit interrupter 100 of the present embodiment, the second end of the excitation coil 81 is connected to the first end of the electric circuitry (e.g., the circuitry constituting the power supply system 200) and the second electrode 22 is connected to the second end of the electric circuitry.

In the normal state of the electric circuitry, the spring force of the contact pressure spring 42 is greater than the attraction force acting on the mover 82 from the stator 83. Therefore, the movable contactor 3 is held mainly by this spring force so that the first movable contact 31 is connected to the first fixed contact 11 and the second movable contact 32 is connected to the second fixed contact 21 (see FIG. 11). That is, in the normal state of the electric circuitry, the mover 82 is in the first position farthest from the stator 83. Further, in the normal state of the electric circuitry, the movable contactor 3 is in the closed position where the first movable contact 31 is in contact with the first fixed contact 11 and the second movable contact 32 is in contact with the second fixed contact 21. At this time, a current flows from the first end of the electric circuitry to the second end of the electric circuitry by passing through the excitation coil 81, the first fixed terminal 1, the movable contactor 3, and the second fixed terminal 2 in this order.

On the other hand, when the current flowing through the electric circuitry (the excitation coil 81) becomes the abnormal current having its value greater than or equal to the prescribed value (in the abnormal state of the electric circuitry), the attraction force acting on the mover 82 from the stator 83 exceeds the spring force of the contact pressure spring 42. Thus, the trip device 8 makes trip and therefore the mover 82 is moved to the second position and the movable contactor 3 is moved to the open position. As a result, the circuit between the first fixed terminal 1 and the second fixed terminal 2 is interrupted and the current flowing through the circuit between the first fixed terminal 1 and the second fixed terminal 2 is interrupted.

Further, when the current flowing through the electric circuitry (the excitation coil 81) becomes the abnormal current with its value greater than or equal to the prescribed value, the control circuitry 207 detects the abnormal current by the current sensor 206, for example. Upon detecting the abnormal current, the control circuitry 207 makes a current flow across the pair of pin electrodes 54 of the squib 51 to energize the heating element 515. Thus, the explosive of the combustion part 513 is combusted to generate a large amount of gas and the low strength portion of the lower wall of the metal sleeve 512 is broken by the pressure of the gas and the gas is discharged to the inside space of the case 52 through the broken portion.

The gas generated by the squib 51 is introduced into the accommodation 70 through the channel 50 of the case 52. The gas introduced into the accommodation 70 goes to the predetermined space S1 between the first movable contact 31 and the first fixed contact 11 or the predetermined space S2 between the second movable contact 32 and the second fixed contact 21 (see arrow W3 in FIG. 12).

Even in the circuit interrupter 100 of the present embodiment, the gas generated by the squib 51 (electrically insulating gas) is introduced into the accommodation 70, thereby increasing the pressure of the accommodation 70. Accordingly, the arc generated between the contacts is cooled. Therefore, the electrically insulating properties of the plasma of the arc discharge or the metal vapor is enhanced and the extinction of the arc is promoted.

Further, the gas introduced from the channel 50 into the accommodation 70 blows into the predetermined space S1 between the first movable contact 31 and the first fixed contact 11, or the predetermined space S2 between the second movable contact 32 and the second fixed contact 21. Thus, the arc generated between the contacts is cooled and the arc extinction is promoted.

Thus, even in the circuit interrupter 100 of the present embodiment, the gas generated by the squib 51 is introduced into the predetermined spaces S1, S2. Thereby, it is possible to quickly extinguish the arc.

Incidentally, the timing at which the trip device 8 makes trip may be prior or subsequent to the timing at which the squib 51 starts to release the gas. The gas may be released from the squib 51 before the trip device 8 makes trip. The gas may be released from the squib 51 after the trip device 8 makes trip. The release and the trip may occur at the same time. It is preferable that the gas is released from the squib 51 after the trip device 8 makes trip.

(2.3) Variations

Figure 13:
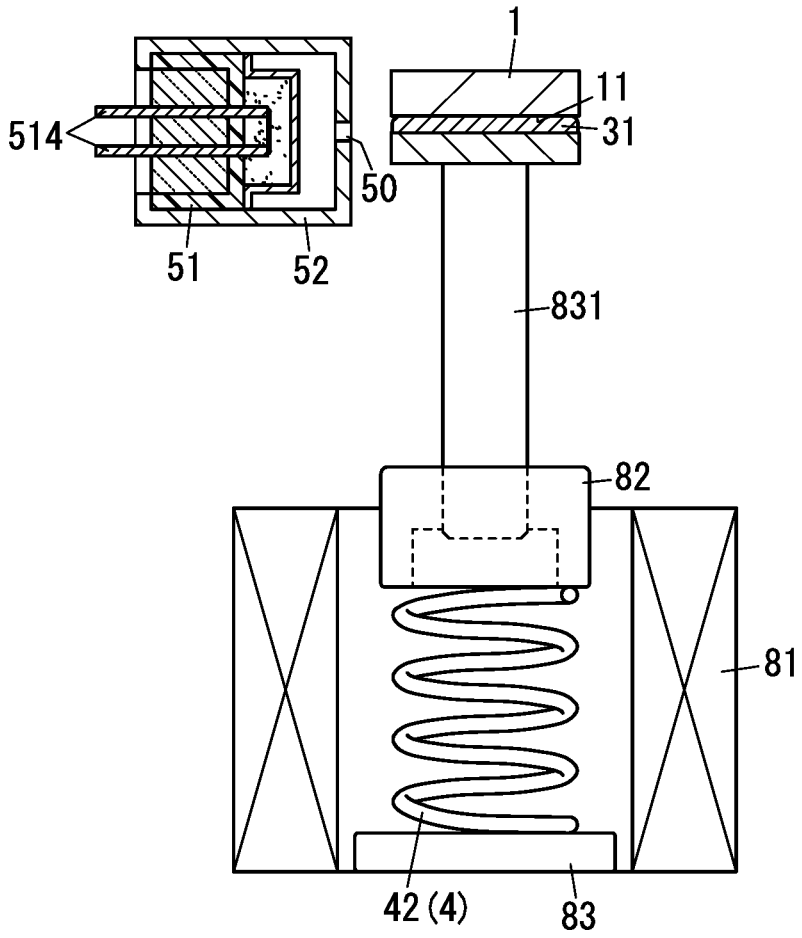
FIG. 13 is a side view of a circuit interrupter of variation 1 according to embodiment 2.
Figure 14:
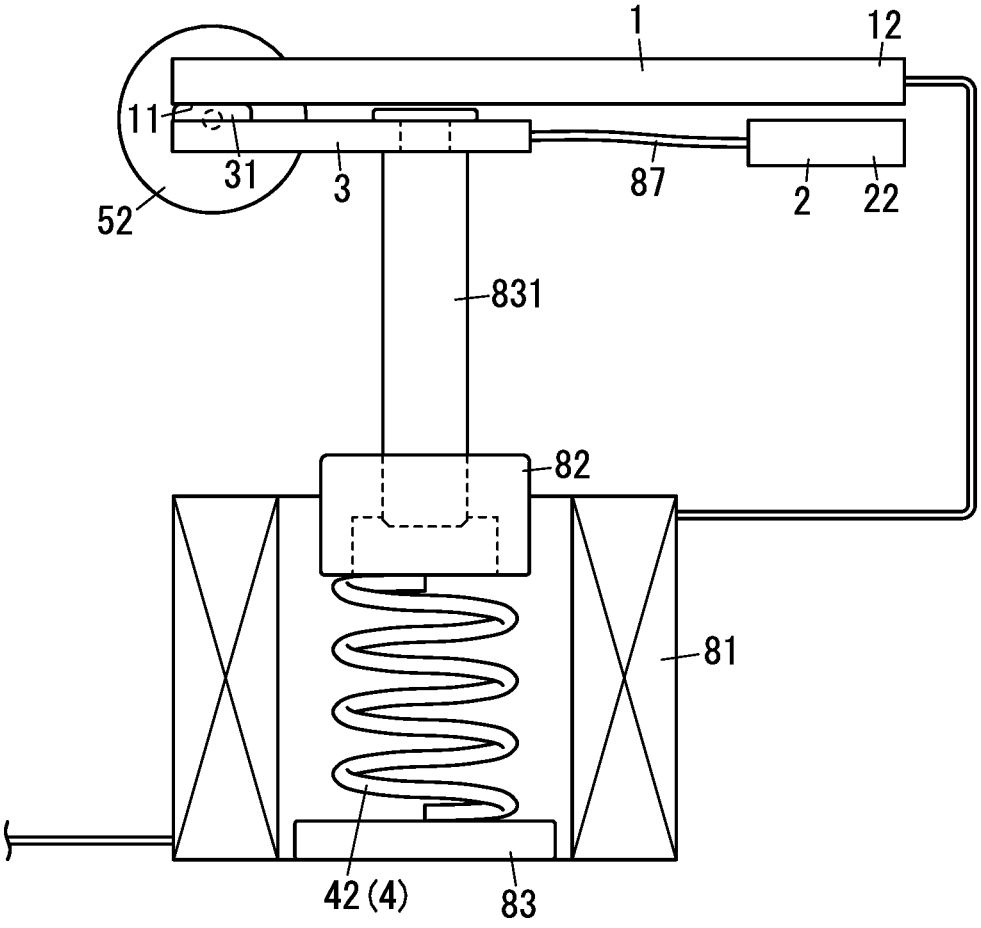
FIG. 14 is a side view in a direction perpendicular to the sheet of FIG. 13, of the above circuit interrupter after operation.
Figure 15:
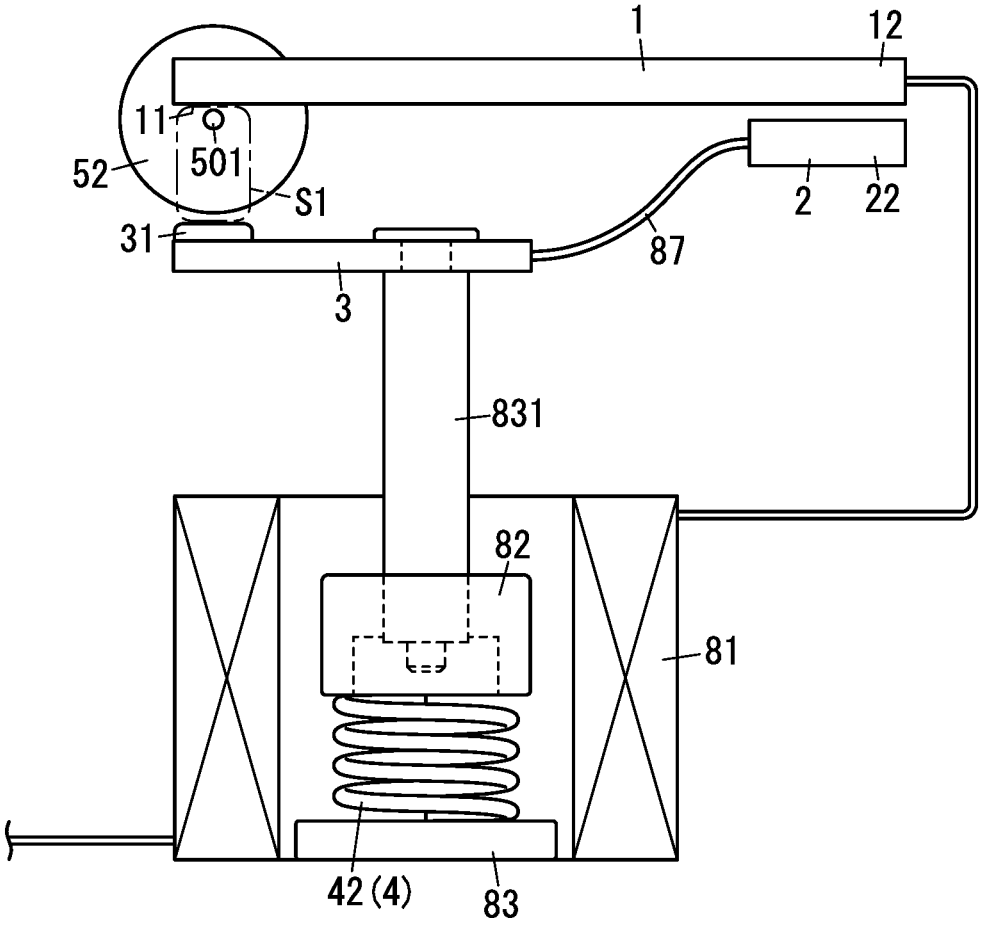
FIG. 15 is a side view of the above circuit interrupter after operation.

The circuit interrupter 100 of variation 1 of embodiment 2 will be described with reference to FIGS. 13-15. FIG. 13 is a cross-sectional view of primary part of the circuit interrupter 100 of variation 1 before operation. FIG. 14 is a side view in a direction perpendicular to the sheet of FIG. 13 (from the right), of the primary part of the circuit interrupter 100 of variation 1 before operation. FIG. 15 is a side view in the same direction as FIG. 14, of the primary part of the circuit interrupter 100 of variation 1 after operation. Hereinafter, the circuit interrupter 100 of embodiment 2 is also referred to as the circuit interrupter 100 of the basic example of embodiment 2.

As shown in FIGS. 13, 14, the circuit interrupter 100 of variation 1 includes only one set of the movable contact 31 and the fixed contact 11 in the circuit interconnecting the first electrode 12 and the second electrode 22. Specifically, the first fixed terminal 1 is a plate-shaped member made of a metal material having conductivity. The first fixed terminal 1 includes a first fixed contact 11 at a first end (a left end in FIG. 14) and a second end thereof (a right end in FIG. 14) functions as the first electrode 12. The second fixed terminal 2 is a plate-shaped member which is made of a metal material having conductivity and is shorter than the first fixed terminal 1. The second fixed terminal 2 is placed to face the first fixed terminal 1 in the upward/downward direction. The second fixed terminal 2 includes a first end (a right end in FIG. 14) which functions as the second electrode 22. The movable contactor 3 includes at a first end (a left end in FIG. 14) the movable contact 31 connected to the fixed contact 11. The movable contactor 3 and the second fixed terminal 2 are not interconnected by a contact set including a set of a movable contact and a fixed contact, but are interconnected by a braided wire 87 made by braiding copper wires.

The case 52 accommodating the squib 51 includes only one channel 50 at the center of its bottom wall. Then, the case 52 is placed to allow the first end 501 of the channel 50 to face the predetermined space S1 between the movable contact 31 and the fixed contact 11 (see FIG. 15). As a result, the gas is introduced in a direction orthogonal to the predetermined space S1.

Although there is no illustration, similarly to the basic example of embodiment 2, the circuit interrupter 100 of variation 1 also includes the housing 7 accommodating therein the first fixed contact 11, the movable contactor 3, and the upper end of the shaft 831. The squib 51 and the case 52, the braided wire 87, and part (left part) of the second fixed terminal 2 are also placed inside the housing 7 (the accommodation 70).

In the present variation, when the abnormal current flows in the electric circuitry, the excitation coil 81 is excited to move the mover 82 from the first position (the position shown in FIG. 14) to the second position (the position shown in FIG. 15). Along with this, the movable contactor 3 is moved from the open position (the position shown in FIG. 14) to the open position (the position shown in FIG. 15). Further, when the control circuitry 207 provides a current to the squib 51, the gas is generated from the squib 51 and the gas is blown into the predetermined space S1 between the movable contact 31 and the fixed contact 11. As a result, the arc generated between the contacts is cooled and therefore it is possible to quickly extinguish the arc.

Incidentally, similarly to the basic example of embodiment 2, the circuit interrupter 100 of the present variation may include the magnet 9 for holding the mover 82 at the second position.

Figure 16:
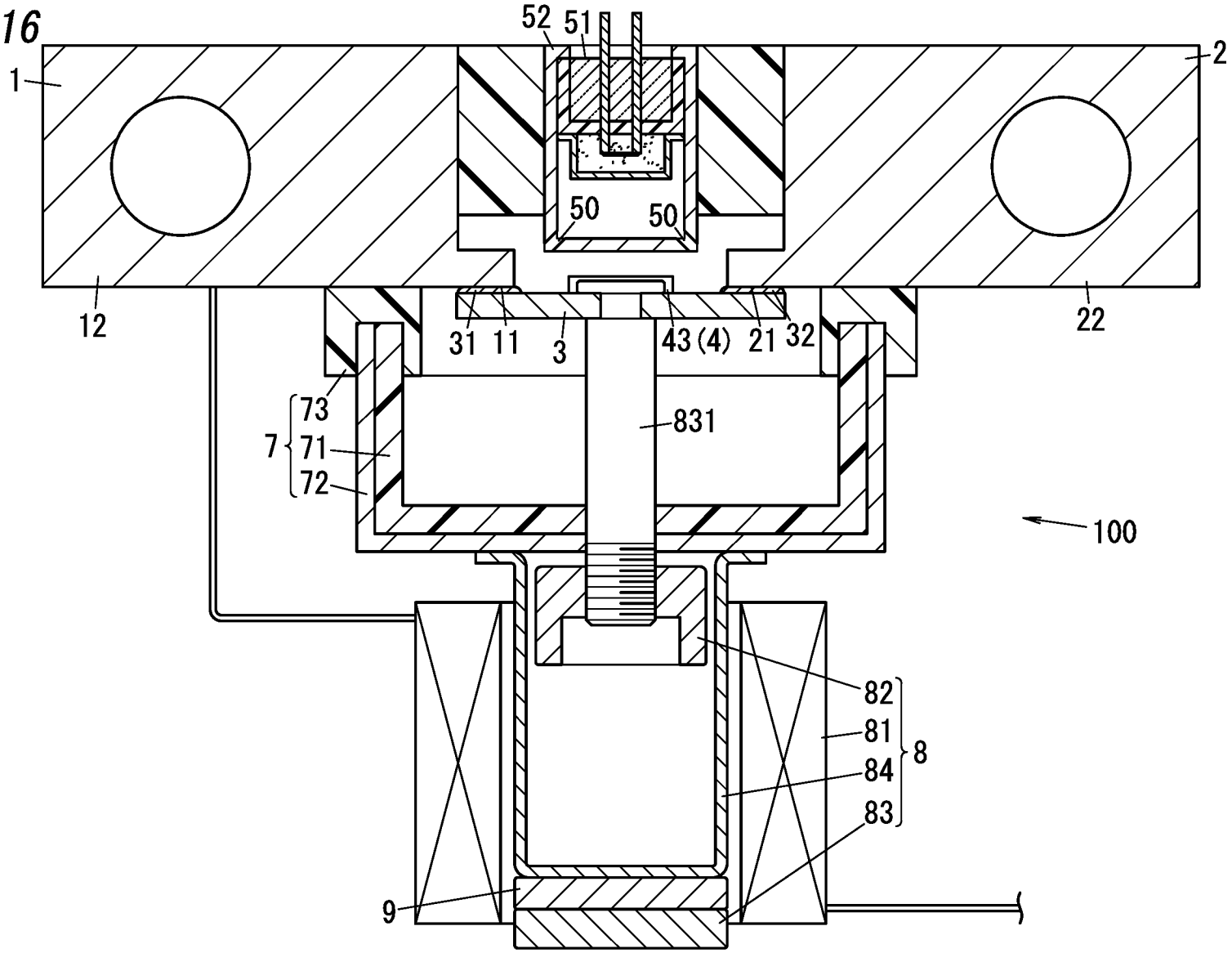
FIG. 16 is a cross-sectional view of a circuit interrupter of variation 2 according to embodiment 2.

The circuit interrupter 100 of variation 2 of embodiment 2 will be described with reference to FIGS. 16, 17.

The circuit interrupter 100 of the present variation is different from the circuit interrupter 100 of the basic example of embodiment 2 in including permanent magnets 43 as the holding unit 4 instead of the contact pressure contact spring 41. The other configurations are same as those of the circuit interrupter 100 of the basic example of embodiment 2 and therefore explanations thereof are omitted.

Figure 17:
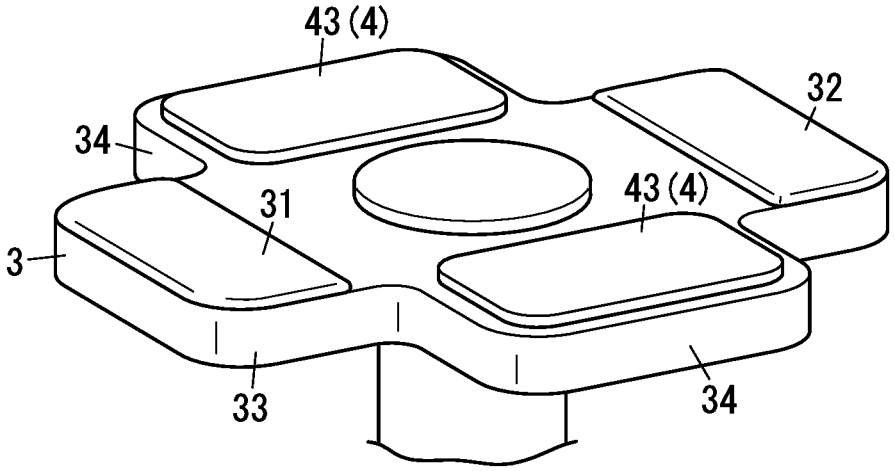
FIG. 17 is a perspective view of a movable contactor of the above circuit interrupter.

In the circuit interrupter 100 of the present variation, as shown in FIG. 17, the movable contactor 3 is formed to have a cross shape in a top view and includes a body part 33 and a pair of protrusion parts 34. The body part 33 has a length in the rightward/leftward direction and includes the first movable contact 31 and the second movable contact 32 at both ends in the length direction. The pair of protrusion parts 34 protrude in the forward/backward direction from side surfaces of the body part 33. Each of the protruding parts 34 of the movable contactor 3 is provided with a permanent magnet 43. As shown in FIG. 16, the center of the movable contactor 3 faces the bottom surface of the case 52. Further, a pair of magnetic members (not shown), in particular iron pieces are provided to the lower surface of the cover member 73 of the housing 7 to be in front and back of the case 52 (positions facing the permanent magnets 43).

In variation 2, the iron pieces are attracted by the permanent magnets 43. The first movable contact 31 and the second movable contact 32 are connected to the first fixed contact 11 and the second fixed contact 21 while the iron pieces and the permanent magnets 43 are separated from each other (see FIG. 16).

Also in the present variation, when the trip device 8 makes trip, the mover 82 is moved from the first position (the position shown in FIG. 16) to the second position against the magnetic attraction force between the iron pieces and the permanent magnets 43, and the movable contactor 3 is moved from the closed position (the position shown in FIG. 16) to the open position. Thus, the circuit between the first fixed terminal 1 and the second fixed terminal 2 is interrupted. At this time, the control circuitry 207 allows the squib 51 to generate the gas and also allows the gas to be introduced into the accommodation 70. As a result, the arc generated between the contacts is cooled and therefore it is possible to quickly extinguish the arc.

In the present variation, the magnetic member may be provided to the movable contactor 3 and the permanent magnet 43 may be provided to the cover member 73 of the housing 7. Further, a spacer may be provided between the permanent magnet 43 and the magnetic member. The movable contactor 3 may be maintained in the closed state while the permanent magnet 43 is in direct contact with the magnetic member. Further, the holding unit 4 may include both the contact pressure spring 41 and the permanent magnet 43.

The circuit interrupter 100 of variation 3 of embodiment 2 will be described with reference to FIG. 18.

The circuit interrupter 100 of the present variation is mainly different from the circuit interrupter 100 of the basic example of embodiment 2 in including as the trip device 8, a bimetallic plate 88 instead of the excitation coil 81, the mover 82, the stator 83, and the hollow cylindrical body 84. The other configurations are same as those of the circuit interrupter 100 of the basic example of embodiment 2 and therefore explanations thereof are omitted.

Figure 18:
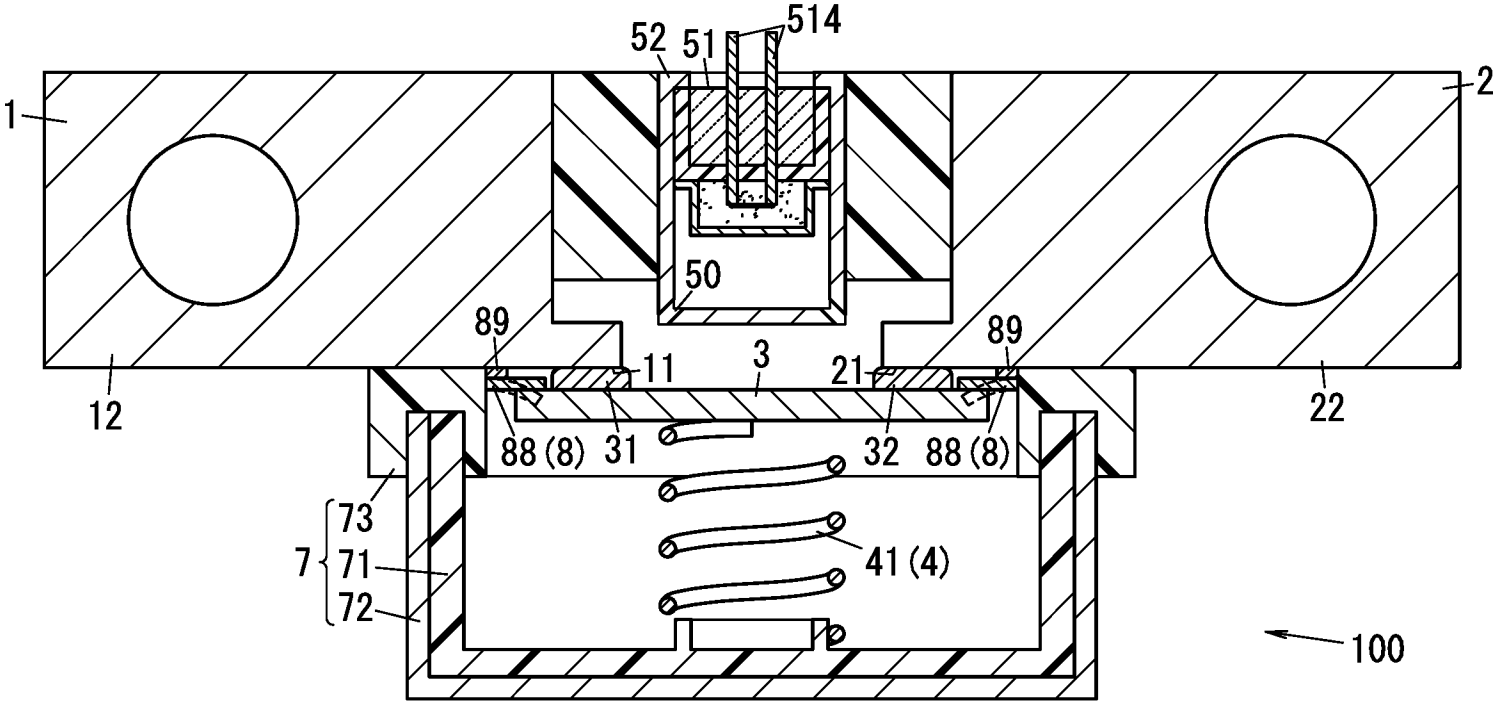
FIG. 18 is a cross-sectional view of a circuit interrupter of variation 3 according to embodiment 2.

In the circuit interrupter 100 of the present variation, as shown in FIG. 18, the movable contactor 3 is held in the closed position by the contact pressure spring 41 similarly to the basic example of embodiment 1. Further, the bimetallic plates 88 are attached to the lower surfaces of the first fixed terminal 1 and the second fixed terminal 2 with metal plates 89 in-between. The bimetallic plate 88 has its lower surface in contact with the upper surface of the movable contactor 3.

In the present variation, when the abnormal current flows in the movable contactor 3, the bimetallic plate 88 is curved downward (see the dotted line in FIG. 18). Thus, the movable contactor 3 is moved from the closed position to the open position.

That is, in the circuit interrupter 100 of the present variation, when the abnormal current flows in the circuit including the movable contact (first movable contact) 31 and the fixed contact (first fixed contact) 11, the bimetallic plate 88 is curved and thereby the movable contactor 3 is moved to the open position.

Thus, it is possible to interrupt the circuit between the first fixed terminal 1 and the second fixed terminal 2.

The present variation may be provided with a holding mechanism for holding the movable contactor 3 in the open position after the movable contactor 3 is moved to the open position by the bimetallic plate 88. For example, the holding mechanism may be a combination of a permanent magnet and a magnetic member provided to the movable contactor 3 and the inside wall of the housing 7. Further, the trip device 8 may include the bimetallic plate 88 in addition to the excitation coil 81, the mover 82, the stator 83 and the hollow cylindrical body 84.

The circuit interrupters 100 of the basic example and variations 1-3 of embodiment 2 may also include the yokes 61, 62 similarly to embodiment 1.

(3) Other Variations

The application of the circuit interrupter 100 is not limited to a fuse for the vehicle 300. The circuit interrupter 100 may be used for interrupting any electric circuitry through which a large current, such as, for example, a short circuit current may flow. Further, the circuit interrupter 100 may be a relay (electromagnetic relay) including an electromagnet device.

A guide for defining the moving direction of the movable contactor 3 may be formed in the accommodation 70 of the housing 7. The guide may be formed on the inner wall of the accommodation 70 to be long in the upward/downward direction to be in contact with the side surface of the movable contactor 3 along the moving direction of the movable contactor 3. Thus, when the movable contactor 3 is moved by the pyroactuator 5, the movable contactor 3 is less likely to tilt. The guide may be a rod extending upward from the bottom surface of the accommodation 70 and penetrating the movable contactor 3.

The configurations of the basic examples and individual variations of embodiments 1, 2 can be appropriately combined.

Figure 19:
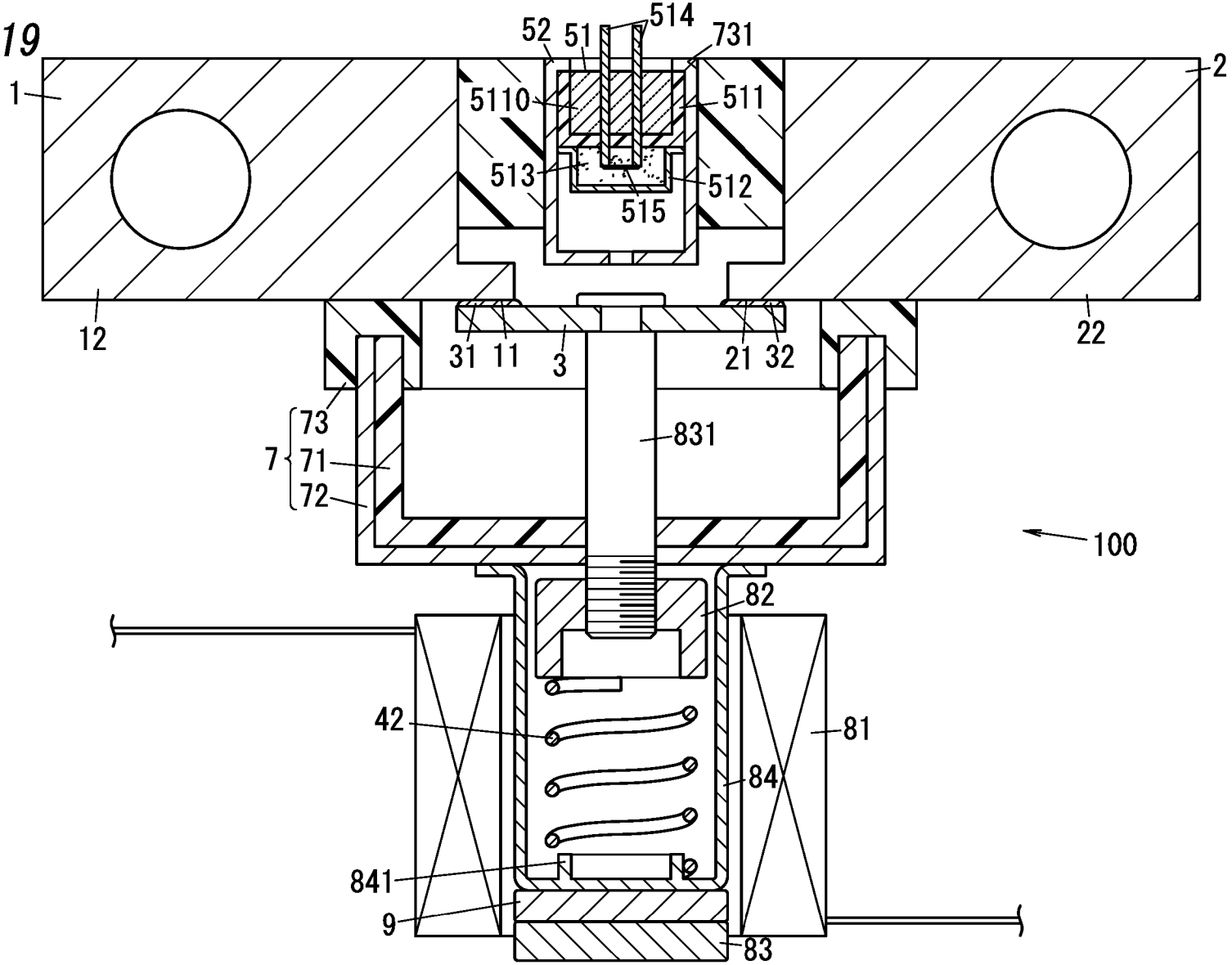
FIG. 19 is a cross-sectional view of a circuit interrupter of concrete example 1.
Figure 20:
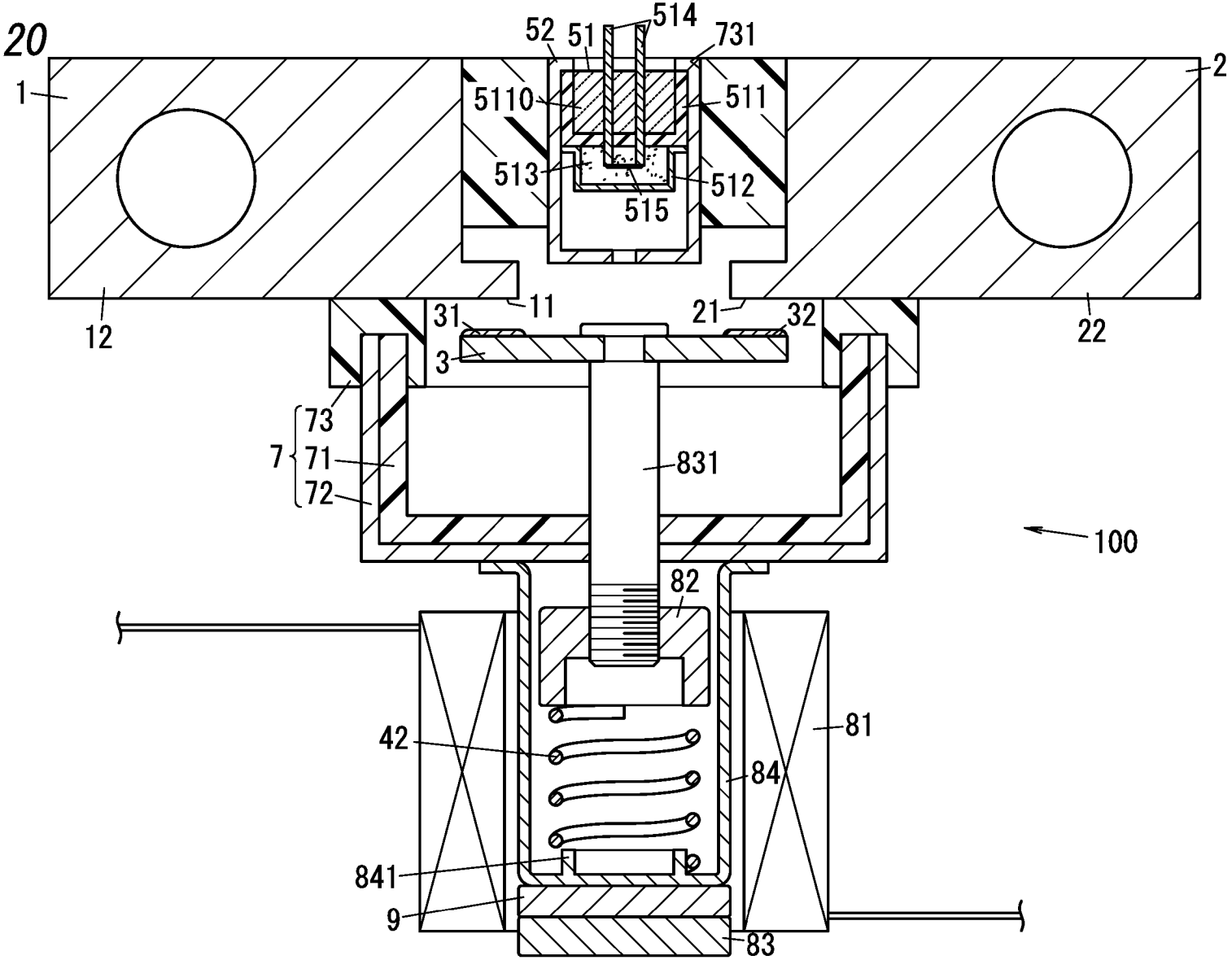
FIG. 20 is a cross-sectional view of the above circuit interrupter in its off state.
Figure 21:
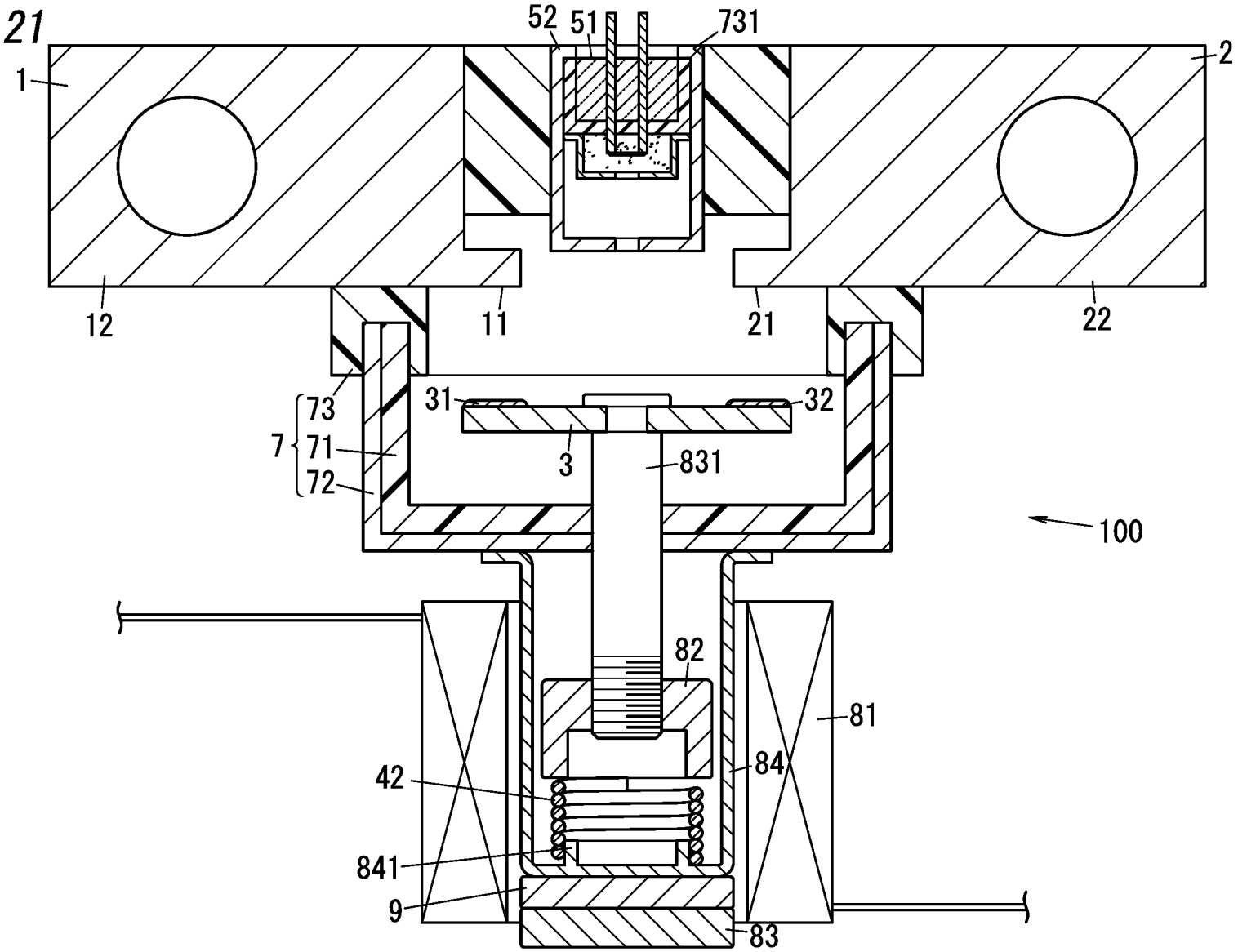
FIG. 21 is a cross-sectional view of the above circuit interrupter after operation.

Referring to FIGS. 19-21, the circuit interrupter 100 according to one concrete example (concrete example 1) of one variation obtained by combining embodiments 1, 2 will be described. The circuit interrupter 100 of the present concrete example functions as a so-called normally-on ("b"

contact) device. The circuit interrupter 100 includes the excitation coil 81, the squib 51, and the moving mechanism.

As shown in FIG. 19, the fixed contact (first fixed contact) 11 of the fixed terminal 1 (first fixed terminal) 1, the second fixed contact 21 of the second fixed terminal 2, and the movable contactor 3 including the movable contact (first movable contact) 31 and the second movable contact 32 are accommodated inside the housing 7. The squib 51 is placed to face the upper surface of the movable contactor 3. The housing 7 includes the through hole at its bottom wall and the hollow cylindrical body 84 is fixed to cover the through holes in the bottom wall. Further, the shaft 831 having its upper end coupled to the movable contactor 3 is placed so that the lower end thereof passes through the through hole in the bottom wall of the housing 7 and is exposed inside the hollow cylindrical body 84. The mover 82 and the contact pressure spring 42 are placed inside the hollow cylindrical body 84. The mover 82 is coupled to the lower end of the shaft 831. The stator 83 is fixed below the bottom wall of the hollow cylindrical body 84. The excitation coil 81 is placed to surround the peripheries of the mover 82 and the stator 83.

The movable contactor 3 is held by the spring force from the contact pressure spring 42 and the like in the closed position in which the movable contact (first movable contact) 31 is in contact with the fixed contact (first fixed contact) 11 (see FIG. 19).

The excitation coil 81 and energization thereof are controlled by the control circuitry 200. When the excitation coil 81 is energized, the magnetic flux generated by the excitation coil 81 moves the mover 82 downward. When the mover 82 moves downward, the shaft 831 and the movable contactor 3 also move downward together with the mover 82. Thereby, the movable contactor 3 is moved from the closed position (see FIG. 19) to the first open position (see FIG. 20). On the other hand, when the energization of the excitation coil 81 is stopped, the mover 82 is moved upward by the spring force of the contact pressure spring 42 and the like. The movable contactor 3 is moved to the closed position (see FIG. 19).

The moving mechanism includes a space interconnecting the squib 51 and the movable contactor 3 (a space between the squib 51 and the movable contactor 3). That is, the circuit interrupter 100 of the present concrete example allows the movable contactor 3 to receive the pressure of the gas generated in the squib 51 directly (the movable contactor 3 forms part of the outer wall of the pressurized chamber 520) and allows the movable contactor 3 to be moved directly by the pressure of the gas from the squib 51. The moving mechanism moves the movable contactor 3 from the closed position (see FIG. 19) or the first open position (see FIG. 20) to a second open position in which the movable contact (first movable contact) 31 is separated from the fixed contact (first fixed contact) 11 (see FIG. 21). The second open position here is a position of the movable contactor 3 in which the movable contact (first movable contact) 31 is farther away from the fixed contact (first fixed contact) 11 than in the case where the movable contactor 3 is in the first open position. That is, in the present concrete example, a distance between the closed position and the second open position is longer than a distance between the closed position and the first open position. When the movable contactor 3 moves downward to the second open position, the mover 82 also moves downward. The mover 82 is held (latched) in the position shown in FIG. 21 by the magnetic flux generated by the magnet 9.

Figure 22:
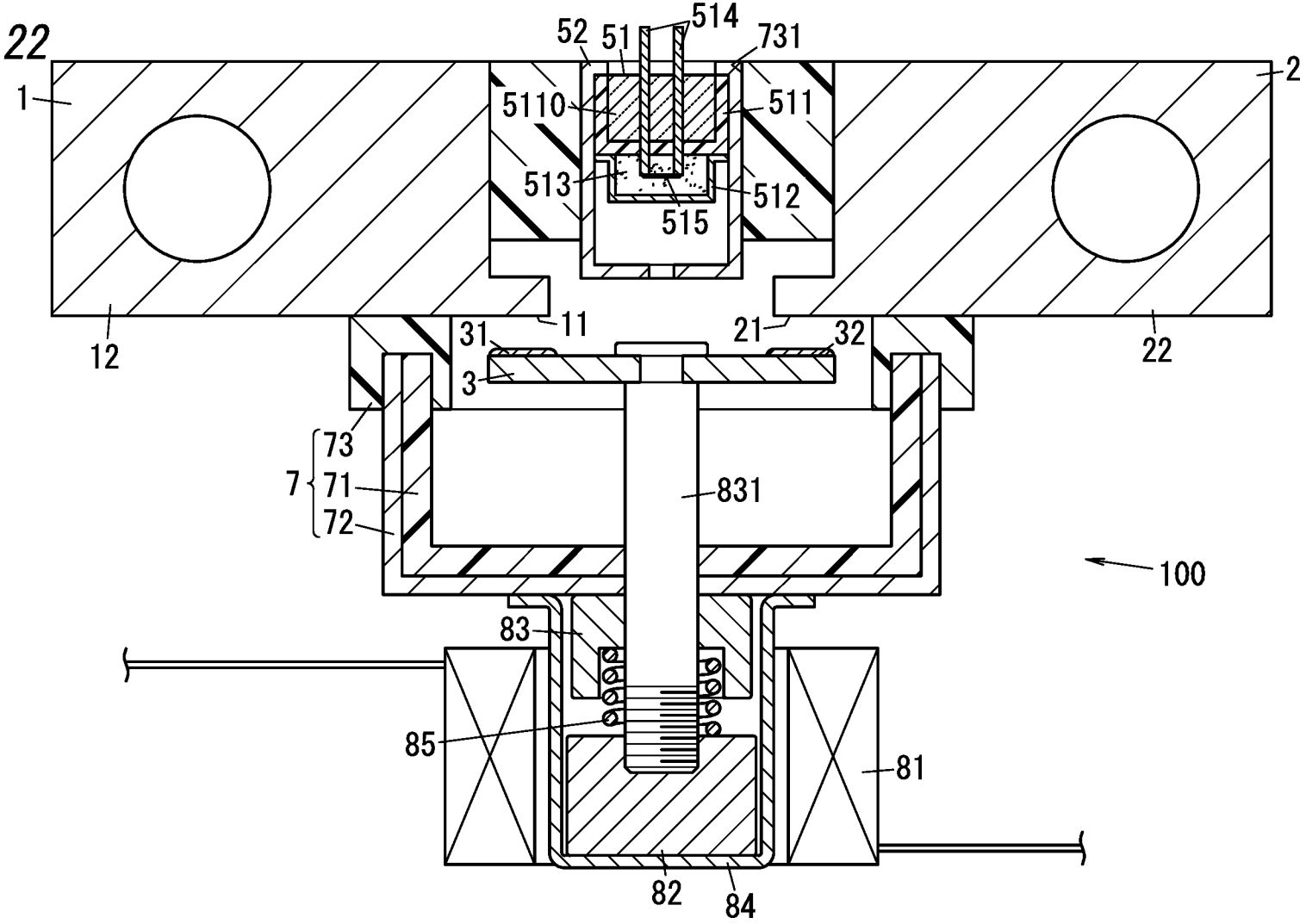
FIG. 22 is a cross-sectional view of a circuit interrupter of concrete example 2.
Figure 23:
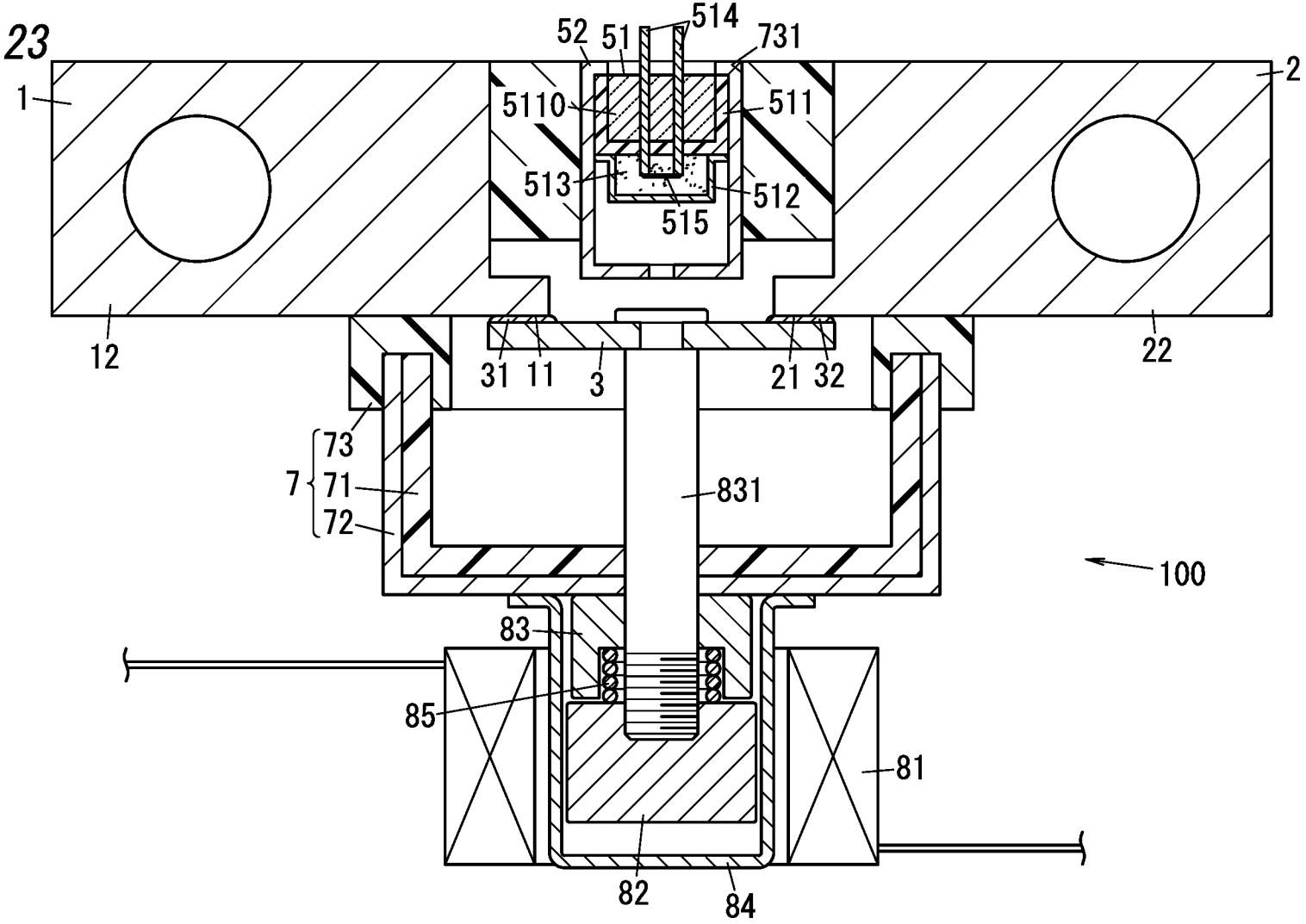
FIG. 23 is a cross-sectional view of the above circuit interrupter in its off state.

Referring to FIGS. 22, 23, the circuit interrupter 100 according to another concrete example (concrete example 2) of one variation obtained by combining embodiments 1, 2 will be described. The circuit interrupter 100 of the present concrete example functions as a so-called normally-off ("a" contact) device. Similarly to the circuit interrupter 100 of concrete example 1, the circuit interrupter 100 includes the excitation coil 81, the squib 51, and the moving mechanism. Hereinafter, a description will be given centering on different points from concrete example 1 described above.

In the circuit interrupter 100 shown in FIG. 22, the stator 83 is fixed to the bottom wall of the housing 7 inside the hollow cylindrical body 84. The stator 83 includes at its center a through hole extending in the upward/downward direction. The lower end of the shaft 831 extends downward while passing through the through hole of the bottom wall of the housing 7 and the through hole of the stator 83, and is fixed to the mover 82. A return spring 85 is placed between the mover 82 and the stator 83. The excitation coil 81 is placed to surround the peripheries of the mover 82 and the stator 83.

The movable contactor 3 is held by the spring force received by the mover 82 from the return spring 85 and the like in the first open position where the movable contact (first movable contact) 31 is separated from the fixed contact (first fixed contact) 11 (see FIG. 22).

When the excitation coil 81 is energized, the magnetic flux generated by the excitation coil 81 moves the mover 82 upward. When the mover 82 moves upward, the shaft 831 and the movable contactor 3 also move upward together with the mover 82. Thereby, the movable contactor 3 is moved from the first open position (see FIG. 22) to the closed position (see FIG. 23). On the other hand, when the energization of the excitation coil 81 is stopped, the mover 82 is moved downward by the spring force of the return spring 85 and the like. The movable contactor 3 is moved to the first open position (see FIG. 22). That is, the circuit interrupter 100 of the present concrete example functions as a so-called "a" contact type contact device.

The moving mechanism is defined by a space interconnecting the squib 51 and the movable contactor 3 (a space between the squib 51 and the movable contactor 3). That is, the movable contactor 3 directly receives the pressure of the gas from the squib 51 and then is moved. The moving mechanism is configured to move the movable contactor 3 to the second open position where the movable contact (first movable contact) 31 is separated from the fixed contact (first fixed contact) 11 (see FIG. 22). The second open position here is the same as the first open position. That is, in the present concrete example, the distance between the closed position and the second open position is equal to the distance between the closed position and the first open position. When the movable contactor 3 moves downward to the second open position, the mover 82 also moves downward.

Figure 24:
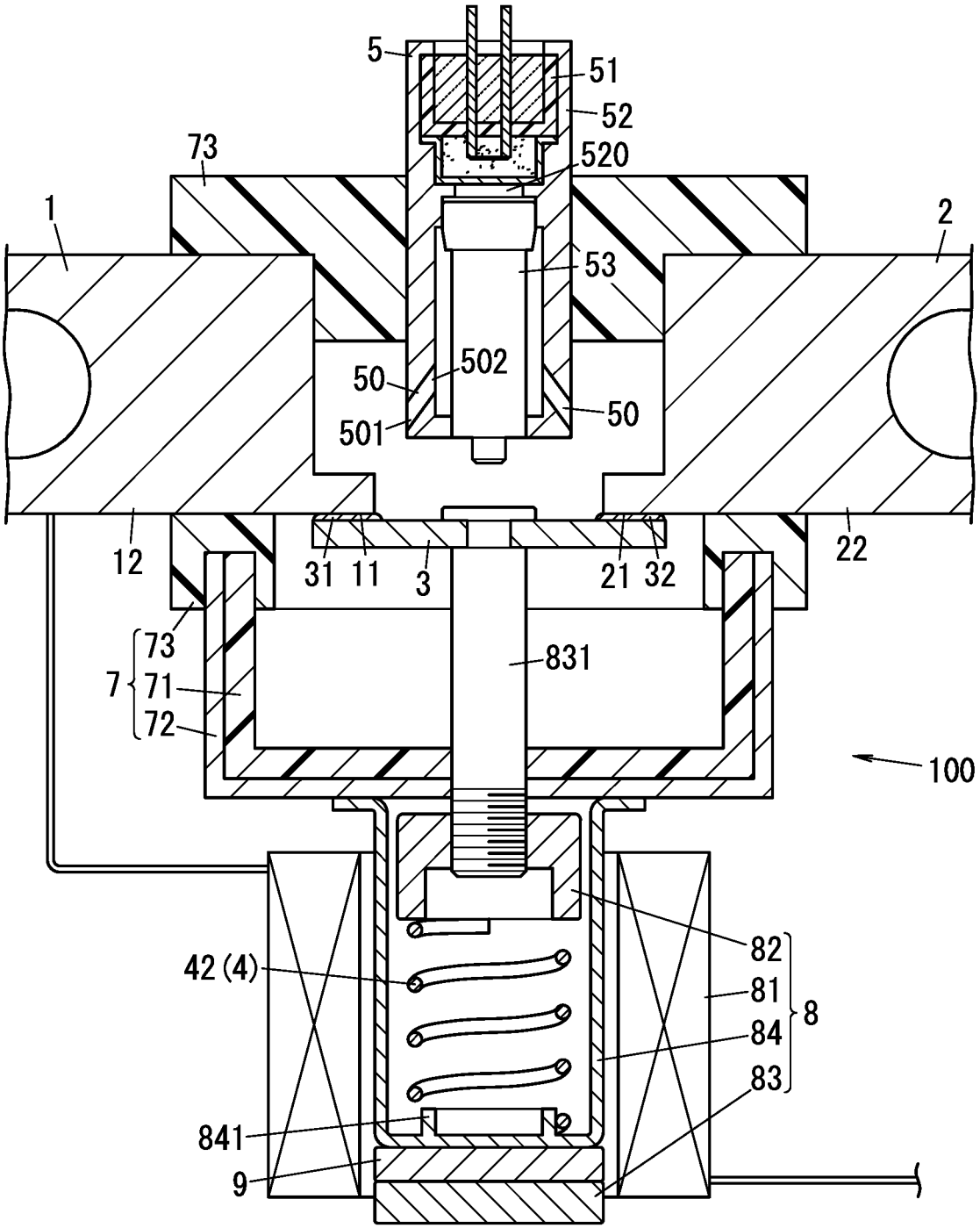
FIG. 24 is a cross-sectional view of a circuit interrupter of concrete example 3.
Figure 25:
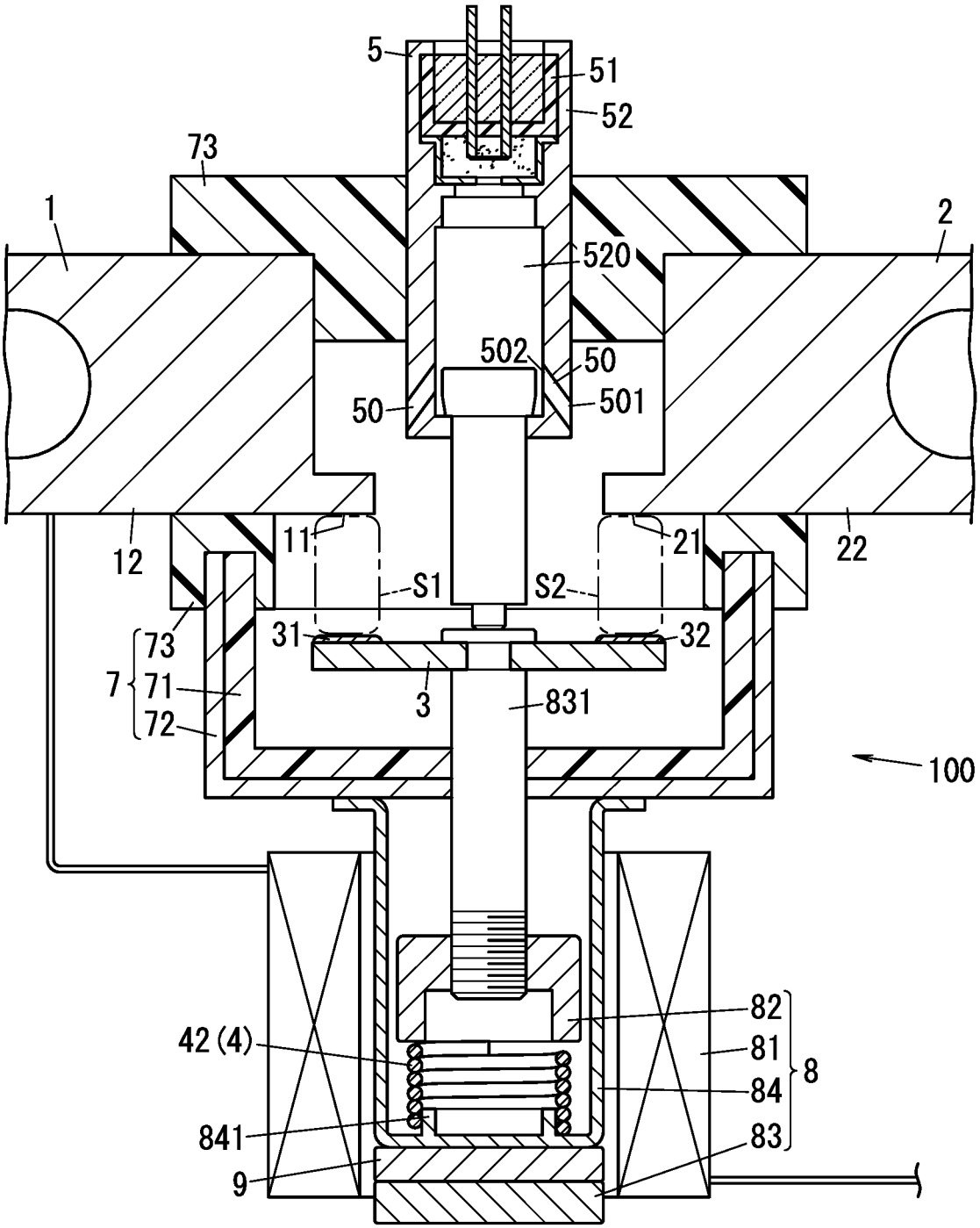
FIG. 25 is a cross-sectional view of the above circuit interrupter after operation.

Referring to FIGS. 24, 25, the circuit interrupter 100 according to another concrete example (concrete example 3) of one variation obtained by combining embodiments 1, 2 will be described. The circuit interrupter 100 of the present concrete example includes a structure of the circuit interrupter 100 of the basic example of embodiment 2 (see FIG. 11), but the pyroactuator 5 thereof is replaced with the pyroactuator 5 (the pyroactuator 5 including the piston 53; see FIG. 9) of one variation of embodiment 1.

In the circuit interrupter 100 of the present concrete example, when the gas is generated in the squib 51, the movable contactor 3 is pressed with the piston 53 which is moved by the pressure in the pressurized chamber 520. Thereby, the movable contactor 3 is moved to the open position. Further, in the circuit interrupter 100 of the present concrete example, the movable contactor 3 can be moved to the open position by also the electromagnetic force generated by the magnetic flux caused by the excitation coil 81 when the abnormal current flows in the excitation coil 81 of the trip device 8. FIG. 24 is a view of the circuit interrupter 100 of the present concrete example and shows a state where both the squib 51 and the trip device 8 do not operate. FIG. 25 is a view of the circuit interrupter 100 of the present concrete example and shows a state in which the piston 53 is pressed by the pressure of the gas from the squib 51 and the movable contactor 3 is pressed by the piston 53 to move to the open position.

Figure 26:
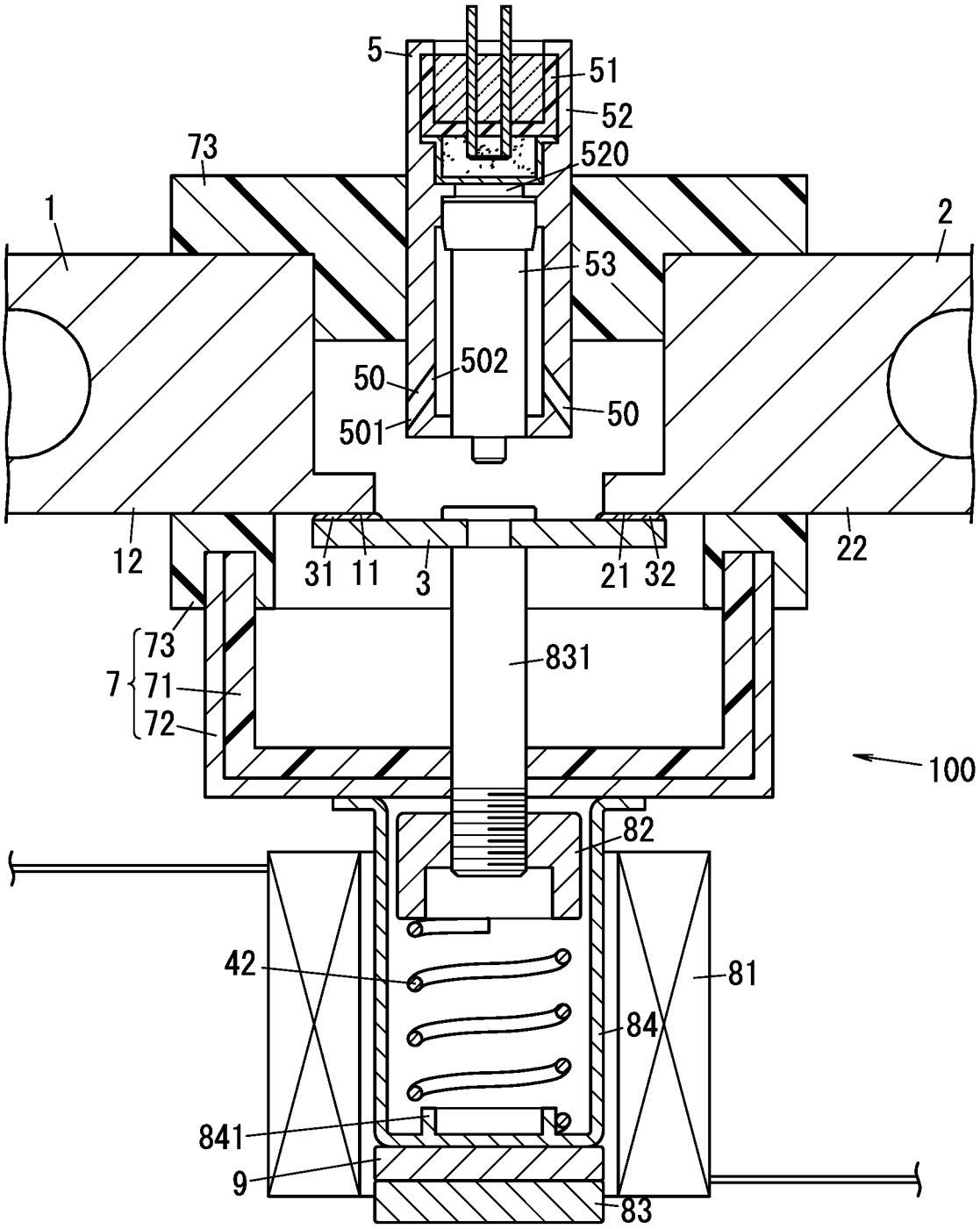
FIG. 26 is a cross-sectional view of a circuit interrupter of concrete example 4.
Figure 27:
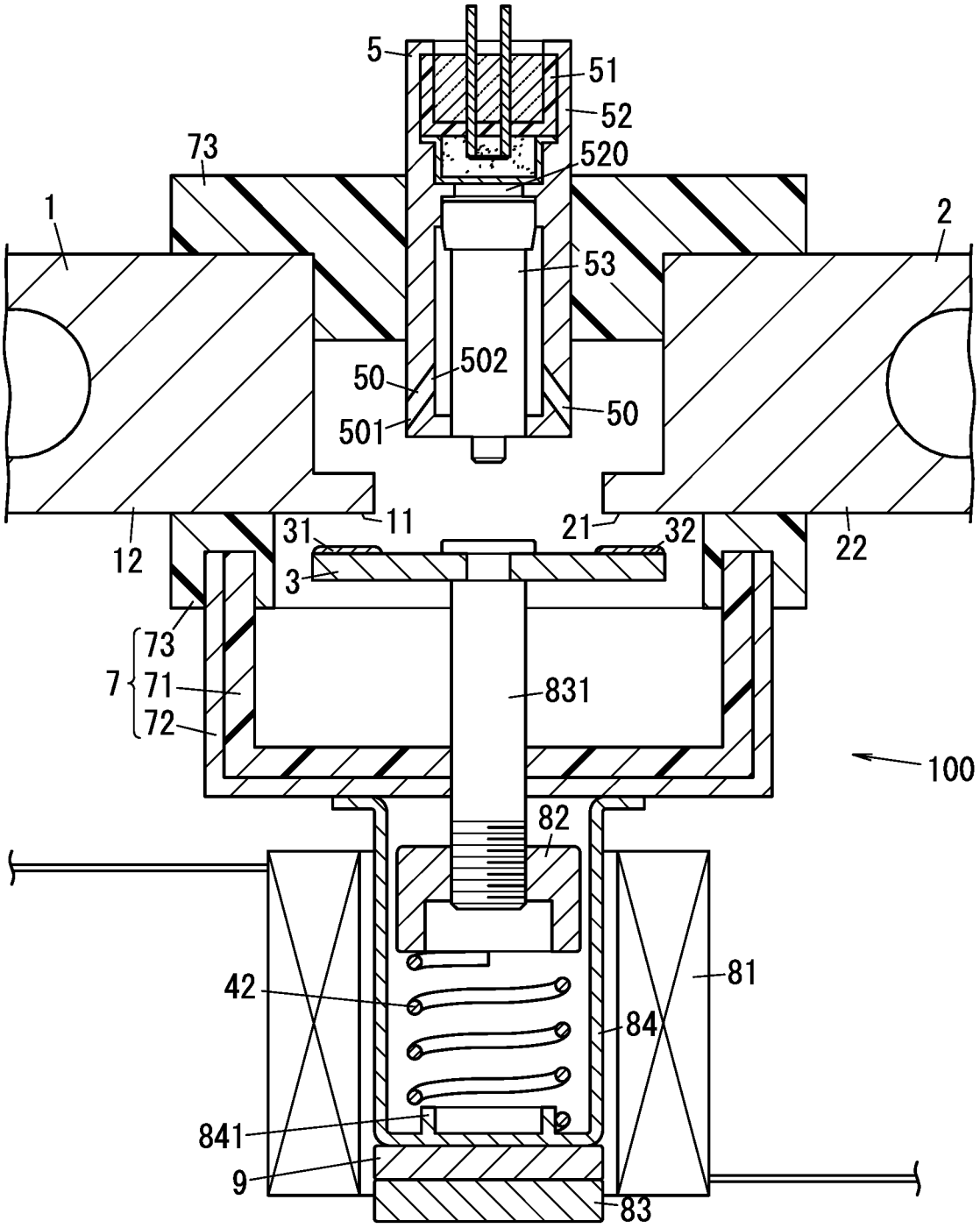
FIG. 27 is a cross-sectional view of the above circuit interrupter in its off state.
Figure 28:
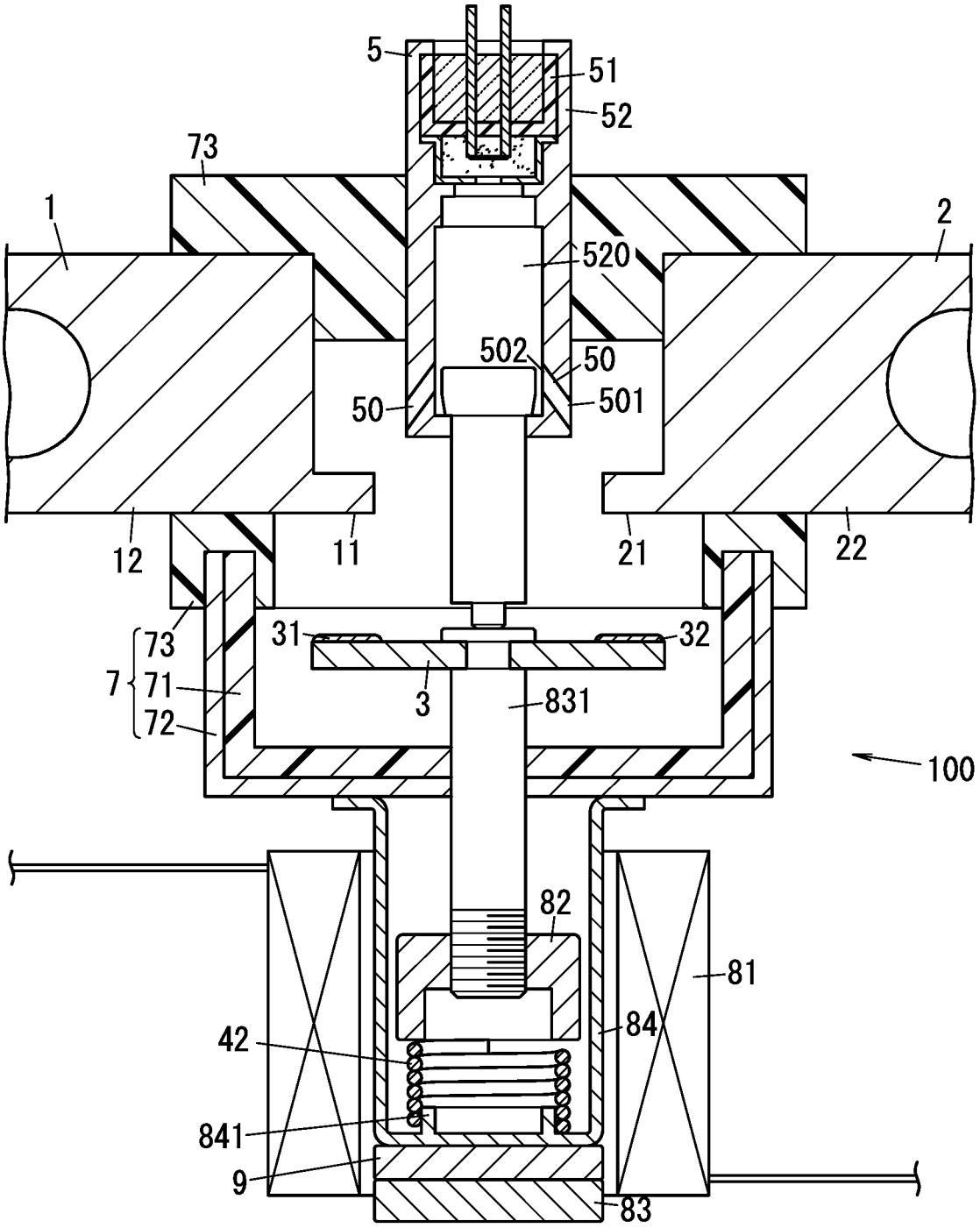
FIG. 28 is a cross-sectional view of the above circuit interrupter after operation.

Referring to FIGS. 26-28, the circuit interrupter 100 according to another concrete example (concrete example 4) of one variation obtained by combining embodiments 1, 2 will be described. The circuit interrupter 100 of the present concrete example includes a structure of the circuit interrupter 100 of concrete example 1 (see FIG. 19), but the pyroactuator 5 thereof is replaced with the pyroactuator 5 (see FIG. 9) of one variation of embodiment 1.

In the circuit interrupter 100 of the present concrete example, the movable contactor 3 moves between the closed position (see FIG. 26) and the first open position (see FIG. 27) in response to switching on and off of the energization of the excitation coil 81. That is, while the excitation coil 81 is not energized, the movable contactor 3 is held by the spring force from the contact pressure spring 42 and the like in the closed position where the movable contact (first movable contact) 31 is in contact with the fixed contact (first fixed contact) 11. Further, when the excitation coil 81 is energized, the movable contactor 3 is held by the electromagnetic force due to the magnetic flux generated in the excitation coil 81 in the first open position where the movable contact (first movable contact) 31 is separated from the fixed contact (first fixed contact) 11. Further, when the pyroactuator 5 is activated and the squib 51 generates the gas, the piston 53 is pressed downward by the pressure in the pressurized chamber 520 and the movable contactor 3 is pressed by the piston 53 to be moved to the second open position (see FIG. 28).

Figure 29:
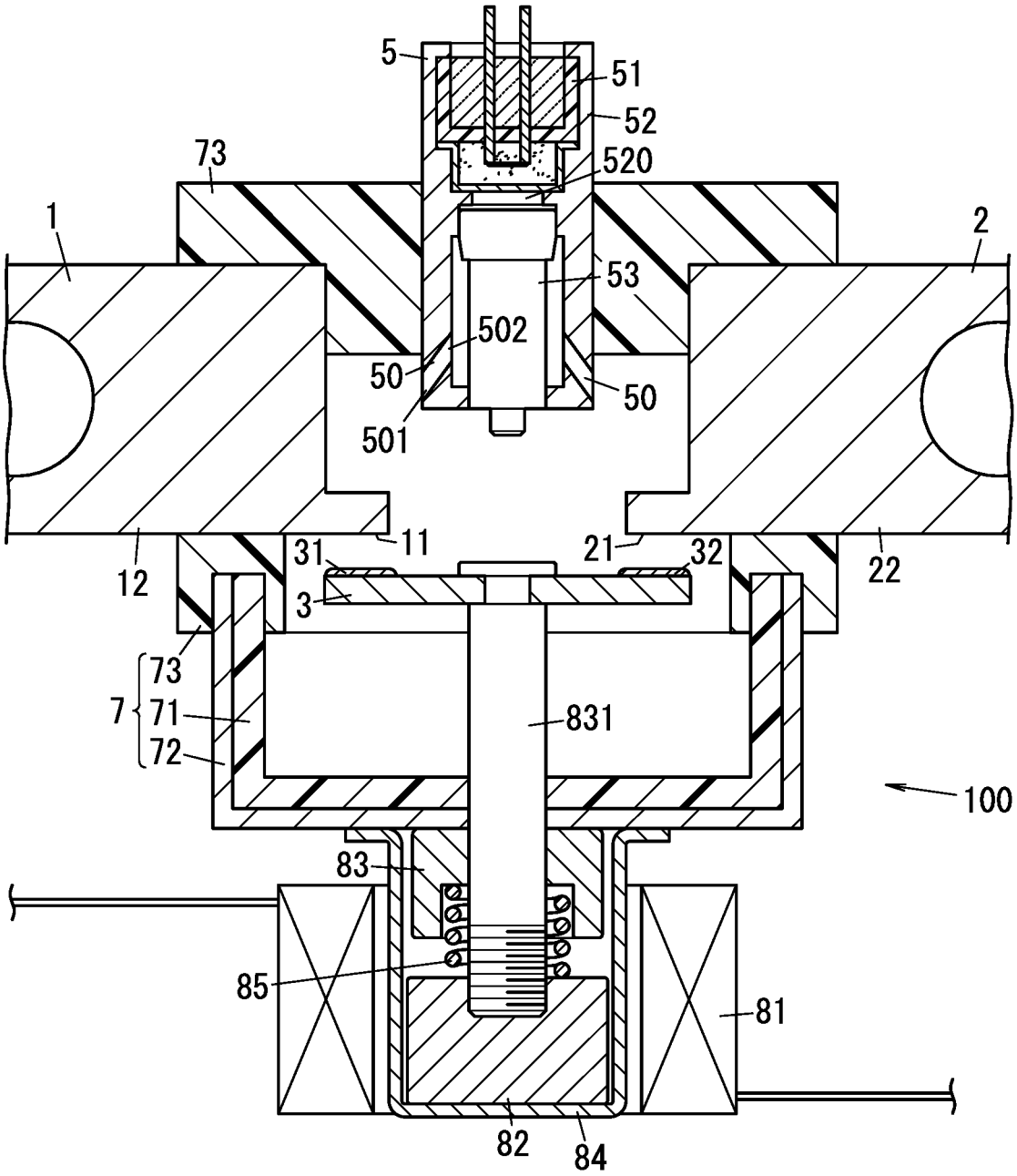
FIG. 29 is a cross-sectional view of a circuit interrupter of concrete example 5.
Figure 30:
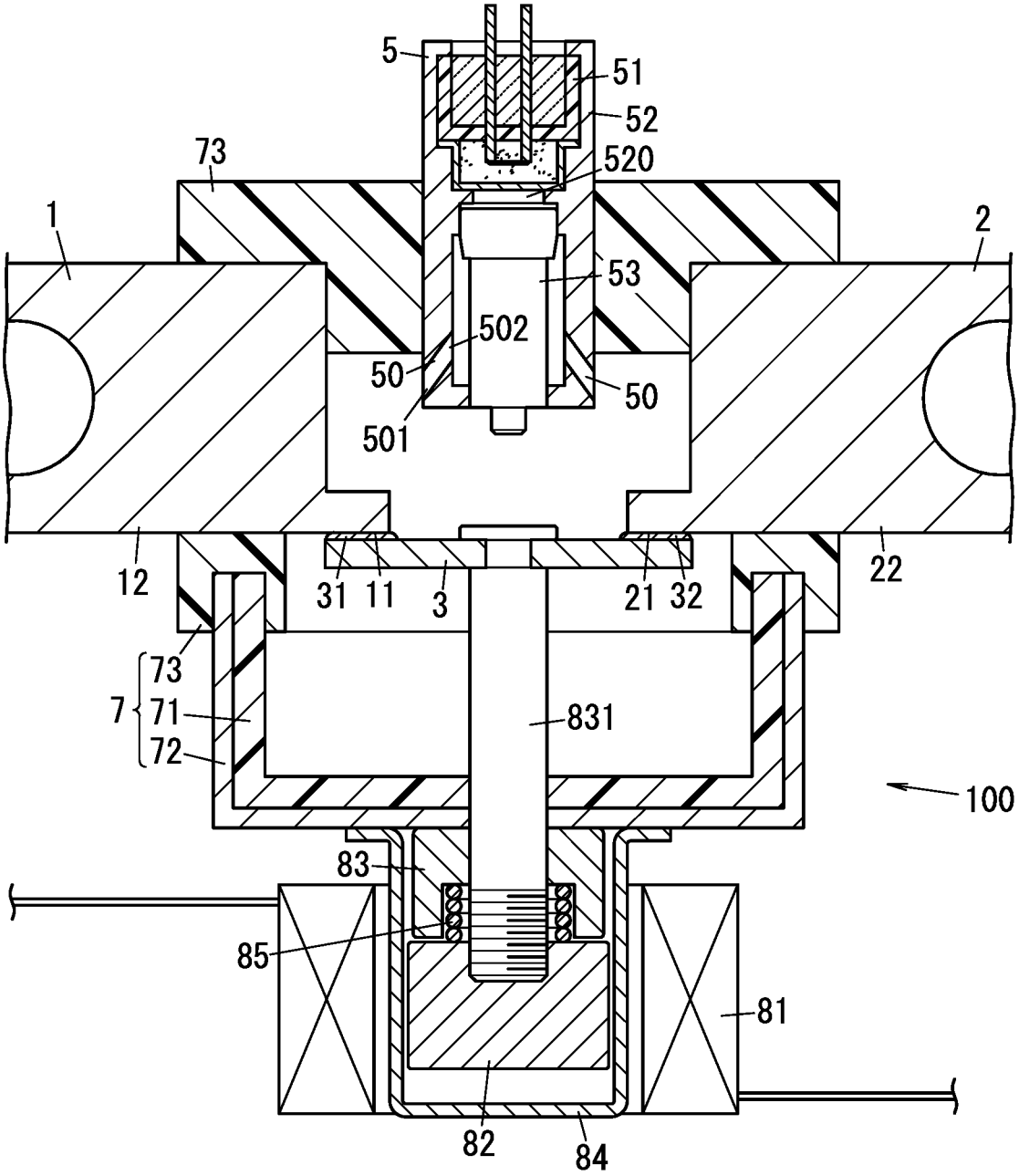
FIG. 30 is a cross-sectional view of the above circuit interrupter in its off state.
Figure 31:
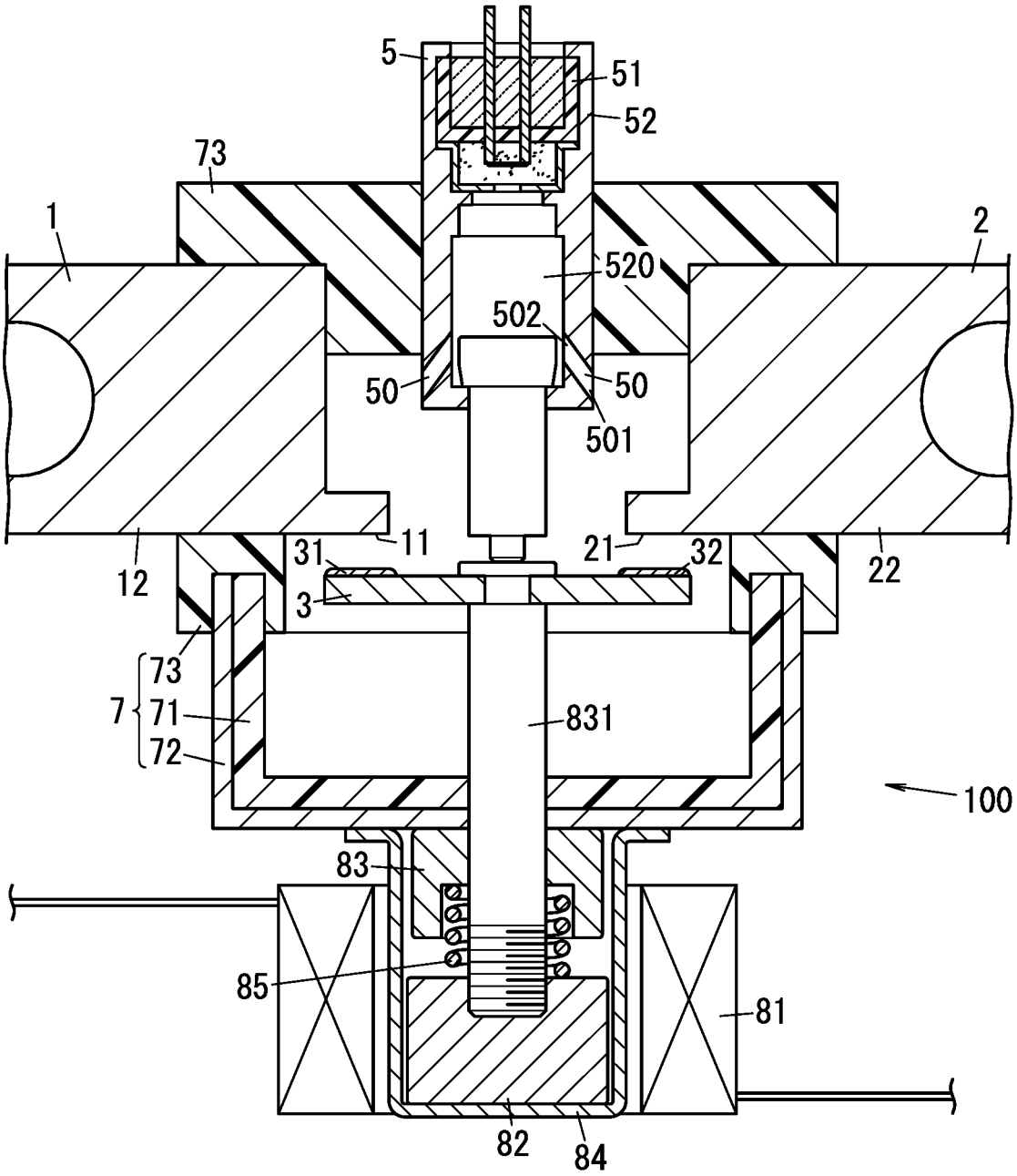
FIG. 31 is a cross-sectional view of the above circuit interrupter after operation.

Referring to FIGS. 29-31, the circuit interrupter 100 according to another concrete example (concrete example 5) of one variation obtained by combining embodiments 1, 2 will be described. The circuit interrupter 100 of the present concrete example includes a structure of the circuit interrupter 100 of concrete example 2 (see FIG. 22), but the pyroactuator 5 thereof is replaced with the pyroactuator 5 (see FIG. 9) of one variation of embodiment 1.

In the circuit interrupter 100 of the present concrete example, the movable contactor 3 moves between the closed position (see FIG. 30) and the first open position (see FIG. 29) in response to switching on and off of the energization of the excitation coil 81. That is, while the excitation coil 81 is not energized, the movable contactor 3 is held by the spring force from the return spring 85 and the like in the first open position where the movable contact (first movable contact) 31 is separated from the fixed contact (first fixed contact) 11. When the excitation coil 81 is energized, the movable contactor 3 is held by the electromagnetic force due to the magnetic flux generated in the excitation coil 81 in the closed position where the movable contact (first movable contact) 31 is in contact with the fixed contact (first fixed contact) 11. Further, when the pyroactuator 5 is activated and the squib 51 generates the gas, the piston 53 is pressed downward by the pressure in the pressurized chamber 520 and the movable contactor 3 is pressed by the piston 53 to be moved to the second open position (see FIG. 31). Here, the second open position is the same as the first open position.

In the circuit interrupters 100 of concrete examples 1-5, the gas generated by the squib 51 is introduced into the accommodation 70 of the housing 7, thereby promoting the arc extinction.

Further, in concrete examples 1, 2, 4, 5, while the pyroactuator 5 is not activated, the circuit interrupter 100 can be used as an electromagnetic relay including a contact device.

The relationship among the closed position, the first open position, and the second open position is not limited to the positional relationship shown in each of the above-described concrete examples. That is, the distance between the closed position and the first open position may be longer than, shorter than, or equal to the distance between the closed position and the second open position. The distance between the closed position and the second open position is preferably longer than the distance between the closed position and the first open position.

In addition, the circuit interrupters 100 of concrete examples 3-5 may include the pyroactuator 5 of the basic example of embodiment 1.

In each concrete example, the case 52 may include, as the detent mechanism, the second cylindrical portion (a portion having a frustoconical inner surface whose diameter decreases toward the lower side) and the third cylindrical portion (a portion having a cylindrical inner surface having a smaller diameter than the base 533 of the piston 53).

Further, in each concrete example described above, the circuit interrupter 100 may include a holder and a contact pressure spring. The holder has a rectangular box shape with open left and right surfaces to allow the movable contactor 3 to pass therethrough to penetrate in the rightward/leftward direction. The upper end of the shaft 831 is coupled to a lower wall of the holder. The contact pressure spring is placed inside the holder to be positioned between an upper surface of the lower wall of the holder and the lower surface of the movable contactor 3, thereby biasing the movable contactor 3 upward. With this configuration, it is possible to ensure a contact pressure between the movable contact (first movable contact) 31 and the fixed contact (first fixed contact) 11 and a contact pressure between the second movable contact 32 and the second fixed contact 21 while the movable contactor 3 is in the closed position.

(4) Aspects

As apparent from the aforementioned embodiments and variations, a circuit interrupter (100) of a first aspect includes a fixed terminal (1), a movable contactor (3), a moving mechanism, a squib (51), and accommodation (70). The fixed terminal (1) includes a fixed contact (11). The movable contactor (3) includes a movable contact (31) connected to the fixed contact (11). The moving mechanism is configured to move the movable contactor (3) from a closed position to an open position. The closed position is a position of the movable contactor (3) where the movable contact (31) is connected to the fixed contact (11). The open position is a position of the movable contactor (3) where the movable contact (31) is separated from the fixed contact (11). The squib (51) is configured to generate gas by combustion. The accommodation (70) is for accommodating the fixed contact (11) and the movable contactor (3). In the circuit interrupter (100), the gas is introduced into the accommodation (70).

According to the first aspect, the gas generated by the squib (51) is introduced into the accommodation (70) accommodating the fixed contact (11) and the movable contactor (3). Therefore, even when the arc is developed between the contacts, it is possible to quickly extinguish the arc by the gas.

In a circuit interrupter (100) of a second aspect referring to the first aspect, the gas is introduced into a predetermined space (S1) between the fixed contact (11) and the movable contact (31) while the movable contactor (3) is in the open position.

According to the second aspect, the gas generated by the squib (51) is introduced into the predetermined space (S1) between the fixed contact (11) and the movable contact (31) of the movable contactor (3) in the open position. Therefore, even when the arc is developed between the contacts, it is possible to quickly extinguish the arc by the gas.

A circuit interrupter (100) of a third aspect referring to the second aspect includes a channel (50) for guiding the gas to allow the gas to blow into the predetermined space (S1).

According to the third aspect, the gas blows into the arc via the channel (50). It is possible to promote the arc extinction.

In a circuit interrupter (100) of a fourth aspect referring to the second or third aspect, the gas is introduced in a direction perpendicular to the predetermined space (S1).

According to the fourth aspect, it is possible to deform or stretch the arc developed in the predetermined space (S1) efficiently. Thus, it is possible to promote the arc extinction and to improve the interruption performance.

In a circuit interrupter (100) of a fifth aspect referring to any one of the first to fourth aspects, the moving mechanism includes a pressurized chamber (520) and a piston (53). The pressurized chamber (520) is for receiving pressure of the gas. The piston (53) is for receiving pressure inside the pressurized chamber (520) and moving the movable contactor (3) in the closed position by applying a force to the movable contactor (3) in a direction toward the open position. In the circuit interrupter (100), part of the gas is introduced into the predetermined space (S1) from the pressurized chamber (520).

According to the fifth aspect, it is possible to move the movable contactor (3) with the pressure of the gas (energy) and also possible to quickly extinguish the arc generated between the contacts by introduction of the gas into the predetermined space (S1).

In a circuit interrupter (100) of a sixth aspect referring to any one of the first to fourth aspects, the moving mechanism includes a trip device (8). The trip device (8) is for moving the movable contactor (3) from the closed position to the open position in response to an abnormal current flowing through a circuit including the movable contact (31) and the fixed contact (11).

According to the sixth aspect, as to the device using the trip device (8) to interrupt the circuit (e.g., a relay), it is possible to quickly extinguish the arc developed between the contacts.

In a circuit interrupter (100) of a seventh aspect referring to the sixth aspect, the trip device (8) includes an excitation coil (81) constituting part of the circuit. The trip device (8) is configured to move the movable contactor (3) to the open position by an electromagnetic force developed by a magnetic flux caused by the excitation coil (81) in response to a flow of the abnormal current through the circuit.

According to the seventh aspect, as to the device using the electromagnetic force generated by the magnetic flux generated in the excitation coil (81), it is possible to quickly extinguish the arc developed between the contacts.

In a circuit interrupter (100) of an eighth aspect referring to the sixth or seventh aspect, the trip device (8) includes a bimetallic plate (88) which curves in response to a flow of the abnormal current through the circuit. The trip device (8) is configured to move the movable contactor (3) to the open position when the bimetallic plate (88) curves in response to a flow of the abnormal current through the circuit.

According to the eighth aspect, as to the device making the bimetallic plate (88) curve to interrupt the circuit, it is possible to quickly extinguish the arc developed between the contacts.

A circuit interrupter (100) of a ninth aspect referring to any one of the first to eighth aspects includes an elastic part (contact pressure springs 41, 42) for providing an elastic force in a direction toward the closed position, to the movable contactor (3).

According to the ninth aspect, it is possible to hold the movable contactor (3) in the closed position.

A circuit interrupter (100) of a tenth aspect referring to any one of the first to ninth aspects includes a permanent magnet (43) for holding the movable contactor (3) in the closed position.

According to the tenth aspect, it is possible to hold the movable contactor (3) in the closed position.

A circuit interrupter (100) of an eleventh aspect referring to any one of the first to tenth aspects includes a space which includes the accommodation (70) and in which the gas is sealed.

According to the eleventh aspect, the gas is introduced into the space in which the gas is sealed and thus the pressure in this space is increased. Accordingly, it is possible to quickly extinguish the arc developed between the contacts.

A circuit interrupter (100) of a twelfth aspect includes a fixed terminal (1), a movable contactor (3), an excitation coil (81), and a moving mechanism. The fixed terminal (1) includes a fixed contact (11). The movable contactor (3) includes a movable contact (31) connected to the fixed contact (11). The squib (51) is configured to generate gas by combustion. The excitation coil (81) is configured to move the movable contactor (3) from a closed position where the movable contact (31) is connected to the fixed contact (11) to a first open position where the movable contact (31) is separated from the fixed contact (11). The moving mechanism is configured to move the movable contactor (3) to a second open position where the movable contact (31) is separated from the fixed contact (11).

Configurations according to the second to eleventh aspects are optional configurations for the circuit interrupter (100) and can be omitted appropriately.

REFERENCE SIGNS LIST

100 Circuit Interrupter
1 First Fixed Terminal (Fixed Terminal)
11 First Fixed Contact (Fixed Contact)
3 Movable Contactor
31 First Movable Contact (Movable Contact)
41 Contact Pressure Spring (Elastic Part)
42 Contact Pressure Spring (Elastic Part)
43 Permanent Magnet
50 Channel
51 Squib
520 Pressurized Chamber
53 Piston
70 Accommodation
8 Trip Device
81 Excitation Coil
88 Bimetallic Plate
S1 Predetermined Space

The invention claimed is:

1. A circuit interrupter, comprising:

a fixed terminal including a fixed contact;

a movable contactor including a movable contact connected to the fixed contact;

a moving mechanism configured to move the movable contactor from a closed position where the movable contact is connected to the fixed contact to an open position where the movable contact is separated from the fixed contact;

a squib configured to generate gas by combustion;

a case accommodating the squib and having a sleeve;

an accommodation for accommodating the fixed contact and the movable contactor; and a channel provided to a side wall of the sleeve and connecting between the sleeve and the accommodation, wherein the moving mechanism includes a piston accommodated in the sleeve;

while the squib generates the gas, the gas presses the piston from a first position to a second position; and when the piston is in the second position, the gas is introduced into the accommodation via the channel.

2. The circuit interrupter according to claim 1, wherein the gas is introduced into a predetermined space between the fixed contact and the movable contact while the movable contactor is in the open position.

3. The circuit interrupter according to claim 2, wherein the gas is introduced in a direction perpendicular to the predetermined space.

4. The circuit interrupter according to claim 1, wherein the moving mechanism further includes a pressurized chamber for receiving pressure of the gas, the piston receives pressure inside the pressurized chamber and moves the movable contactor in the closed position by applying a force to the movable contactor in a direction toward the open position, and part of the gas is introduced into the accommodation from the pressurized chamber.

5. The circuit interrupter according to claim 1, wherein the moving mechanism includes a trip device for moving the movable contactor from the closed position to the open position in response to an abnormal current flowing through a circuit including the movable contact and the fixed contact.

6. The circuit interrupter according to claim 5, wherein the trip device includes an excitation coil constituting part of the circuit, and the trip device is configured to move the movable contactor to the open position by an electromagnetic force developed by a magnetic flux caused by the excitation coil in response to a flow of the abnormal current through the circuit.

7. The circuit interrupter according to claim 5, wherein the trip device includes a bimetallic plate which curves in response to a flow of the abnormal current through the circuit, and the trip device is configured to move the movable contactor to the open position when the bimetallic plate curves in response to the flow of the abnormal current through the circuit.

8. The circuit interrupter according to claim 1, further comprising:

an elastic part for providing an elastic force in a direction toward the closed position, to the movable contactor.

9. The circuit interrupter according to claim 1, further comprising:

a permanent magnet for holding the movable contactor in the closed position.

10. The circuit interrupter according to claim 1, further comprising:

a space which includes the accommodation and in which the gas is sealed.

11. The circuit interrupter according to claim 1, wherein the piston is configured to move the movable contactor from the closed position to the open position by applying a force, and an inner diameter of the sleeve is tapered so as to become narrower in a direction from the first position to the second position and configured to hold the piston to maintain the force on the movable contactor in the direction toward the open position.

12. A circuit interrupter, comprising:

a fixed terminal including a fixed contact;

a movable contactor including a movable contact connected to the fixed contact;

a squib configured to generate gas by combustion;

a first moving mechanism including an excitation coil configured to move the movable contactor from a closed position where the movable contact is connected to the fixed contact to a first open position where the movable contact is separated from the fixed contact and a shaft with the movable contact coupled to one end and configured to move inside the excitation coil in the first open position; and a second moving mechanism including the squib and configured to move the movable contactor to a second open position where the movable contact is separated from the fixed contact to interrupt an abnormal current.

13. The circuit interrupter according to claim 12, wherein a distance between the fixed contact and the movable contact in the second open position is larger than a distance between the fixed contact and the movable contact in the first open position.

14. A circuit interrupter, comprising:

a fixed terminal including a fixed contact;

a movable contactor including a movable contact connected to the fixed contact;

a moving mechanism configured to move the movable contactor from a closed position where the movable contact is connected to the fixed contact to an open position where the movable contact is separated from the fixed contact;

a squib configured to generate gas by combustion;

a case accommodating the squib and having a sleeve; and an accommodation for accommodating the fixed contact and the movable contactor;

wherein the moving mechanism includes a piston accommodated in the sleeve;

the gas moves the piston from a first position to a second position, and the piston moves the movable contactor from the closed position to the open position, when the squib generates the gas; and an inner diameter of the sleeve is tapered so as to become narrower in a direction from the first position to the second position and configured to hold the piston to maintain the force on the movable contactor in the direction toward the open position.

* * * * *